US010622203B2

(12) United States Patent
Veryovkin et al.

(10) Patent No.: US 10,622,203 B2
(45) Date of Patent: Apr. 14, 2020

(54) MULTIMODE ION MIRROR PRISM AND ENERGY FILTERING APPARATUS AND SYSTEM FOR TIME-OF-FLIGHT MASS SPECTROMETRY

(71) Applicant: The Board of Trustees of The University Of Illinois, Urbana, IL (US)

(72) Inventors: Igor Vladimirovich Veryovkin, Darien, IL (US); Luke Hanley, Chicago, IL (US)

(73) Assignee: THE BOARD OF TRUSTEES OF THE UNIVERSITY OF ILLINOIS, Urbana, IL (US)

( * ) Notice: Subject to any disclaimer, the term of this patent is extended or adjusted under 35 U.S.C. 154(b) by 0 days.

(21) Appl. No.: 15/768,965

(22) PCT Filed: Nov. 30, 2016

(86) PCT No.: PCT/US2016/064113
§ 371 (c)(1),
(2) Date: Apr. 17, 2018

(87) PCT Pub. No.: WO2017/095863
PCT Pub. Date: Jun. 8, 2017

(65) Prior Publication Data

US 2018/0323053 A1 Nov. 8, 2018

Related U.S. Application Data

(60) Provisional application No. 62/260,987, filed on Nov. 30, 2015.

(51) Int. Cl.
*H01J 49/00* (2006.01)
*H01J 49/48* (2006.01)
(Continued)

(52) U.S. Cl.
CPC ..... *H01J 49/486* (2013.01); *H01J 49/004* (2013.01); *H01J 49/10* (2013.01); *H01J 49/405* (2013.01); *H01J 49/401* (2013.01)

(58) Field of Classification Search
USPC ..... 250/287
See application file for complete search history.

(56) References Cited

U.S. PATENT DOCUMENTS 7,385,187 B2 * 6/2008 Verentchikov ..... H01J 49/406 250/281
7,919,748 B2 * 4/2011 Flory ..... H01J 49/406 250/287

(Continued)

OTHER PUBLICATIONS

Supplementary European Search Report issued in European Patent Application No. 16871386 dated May 23, 2019.

*Primary Examiner* — Phillip A Johnston
(74) *Attorney, Agent, or Firm* — Marshall, Gerstein & Borun LLP

(57) ABSTRACT

A mass analyzing apparatus and system are disclosed for time-of-flight ("TOF") mass spectrometry analysis. A representative system includes a first electrostatic mirror prism to reflect a first ion beam and provide an intermediate ion beam having an intermediate TOF focus and having a spatial dispersion of ions proportional to ion kinetic energies; and a second electrostatic mirror prism to reflect the second ion beam and converge the spatial dispersion of ions to provide a third, recombined ion beam having an output TOF focus; and an ion detector arranged at the output TOF focus to receive and detect the ions of the third ion beam. A bandpass filter may be arranged at the intermediate TOF focus to selectively allow propagation of ions of the second ion beam having a selected range of ion kinetic energies. Configura-
(Continued)

tions having additional electrostatic mirror prisms are disclosed, including for tandem MS-MS and selectable time-of-flight.

28 Claims, 25 Drawing Sheets

(51) Int. Cl.
*H01J 49/40* (2006.01)
*H01J 49/10* (2006.01)

(56) References Cited

U.S. PATENT DOCUMENTS

| | | | | |
|---|---|---|---|---|
| 8,389,929 | B2 * | 3/2013 | Schoen | H01J 49/26 250/281 |
| 8,395,115 | B2 * | 3/2013 | Makarov | H01J 49/406 250/287 |
| 8,642,951 | B2 * | 2/2014 | Li | H01J 49/405 250/287 |
| 9,082,602 | B2 * | 7/2015 | Shchepunov | H01J 49/408 |
| 2006/0163469 | A1 | 7/2006 | Vestal | |

* cited by examiner

MULTIMODE ION MIRROR PRISM AND ENERGY FILTERING APPARATUS AND SYSTEM FOR TIME-OF-FLIGHT MASS SPECTROMETRY

CROSS-REFERENCE TO RELATED APPLICATIONS

This application is a U.S. national phase under 35 U.S.C. Section 371 and claims the benefit of and priority to International Application No. PCT/US2016/064113 filed Nov. 30, 2016, inventors Igor Vladimirovich Veryovkin et al., titled "Multimode Ion Mirror Prism and Energy Filtering Apparatus and System for Time-Of-Flight Mass Spectrometry", which is a nonprovisional of and claims the benefit of and priority to U.S. Provisional Patent Application No. 62/260,987, filed Nov. 30, 2015, inventor Igor Veryovkin, titled "Right Angle Ion Mirror-Prism (RAIMP)", which is commonly assigned herewith, and all of which is hereby incorporated herein by reference in its entirety with the same full force and effect as if set forth in its entirety herein.

FIELD OF THE INVENTION

The present invention, in general, relates to time of flight mass spectrometry, and more particularly, relates to a multimode ion mirror prism and energy filtering apparatus and system to provide kinetic energy filtering, selectable or configurable time-of-flight and time-of-flight focusing, and stigmatic imaging for use as a mass analyzer in time-of-flight mass spectrometry ("TOF-MS").

BACKGROUND OF THE INVENTION

A mass spectrometry ("MS") system generally includes an ion source, a mass analyzer, and an ion detector (or ion detection system). The ion source provides for ionizing atoms or molecules of a sample (or analyte) of interest. Various ion optics are also part of the MS system to efficiently extract and accelerate ions from the ion source to form an ion beam (or ion stream) which can be efficiently delivered through the mass analyzer to the ion detector. Provided such ions have the same kinetic energies "E" after extraction and acceleration, their velocities "v" will vary inversely to their corresponding mass-to-charge ratios (also referred to equivalently as "m/z" ratios, or more simply "masses"), with ions of comparatively smaller mass having greater velocities, and ions of comparatively larger mass having lower velocities, as $$v = \left[\frac{2E}{(m/z)}\right]^{1/2}.$$

In a time-of-flight ("TOF") MS system, a pulsed ion stream (as a pulse or "packet") is provided to the mass analyzer, so that the ions traverse a known distance from the ion source to the ion detector, with ions having the greater velocities arriving comparatively earlier in time at the ion detector and ions having the lesser velocities arriving comparatively later in time at the ion detector. Counting ions at the ion detector simultaneously with recording their differing arrival times thus allows for separation of the ions based on their differing masses. A TOF-MS analysis produces a mass spectrum, which is a series of peaks indicative of the relative abundances of detected ions as a function of their arrival times, corresponding to their m/z ratios. Mass spectrometers are commonly used to determine the chemical composition of solid, liquid and gaseous substances by precise measurement of the mass-to-charge ratio of the constituent atomic and molecular ions.

It is a widely acknowledged consensus in the field of mass spectrometry that there is no ideal mass analyzer for all applications. In TOF-MS, the state of the art is represented by two distinct technologies: reflectrons and electrostatic sectors. Each of these two families of mass analyzers has its own strengths and weaknesses.

As an example, FIG. 1 is a block diagram illustrating such a prior art TOF-MS system embodiment having orthogonal acceleration of ions for the mass analyzer, which is popular (although not dominant) in many molecular MS applications. The prior art TOF-MS system 50 may generally include, in series of ion process flow along the drift axis, a pulsed ion source 54 (comprising an ion source 52, ion optics 56 (optionally including one or more ion guides, not separately illustrated), and an ion accelerator 62), a time-of-flight (TOF) mass analyzer 58 having a reflectron 60 (for this example), an ion detector 64, and a computing device 68. Sample molecules or atoms are introduced into the ion source 52, and the ion source 52 produces ions from sample molecules or atoms and transmits the ions to the ion optics 56, which in turn focus the ions as an ion beam (or stream) 66 and transmit the ions to the ion accelerator 62. The ion optics 56 may perform additional ion processing functions such as compressing the ion beam, and/or thermalizing (cooling) the ions, for example. For entry into the mass analyzer 58, the ions are generally injected as a pulse or packet of ions 70 (using ion accelerator 62), orthogonally to the drift direction (in this case) and toward the reflectron 60. The ions are reflected (generally about 180 degrees) by the reflectron 60 and travel to the ion detector 64, having dispersed based on differing flight times (due to their differing mass-to-charge (m/z) ratios). The ion detector 64 generates a signal, based upon arrival times and/or arrival locations, that is then utilized by the computing device 68 to calculate actual times-of-flight from which m/z ratios are correlated, and provide a mass spectrum descriptive of the sample molecules as appreciated by persons skilled in the art.

A significant problem with these various prior art TOF-MS systems, however, is a potentially large variance in the kinetic energies of the ions generated by the ion source 52. When there is a significant range of kinetic energies of the ions comprising the ion beam, ions having the same masses but differing kinetic energies will have different arrival times at the ion detector 64. Instead of having a narrow peak of arrival times in the mass spectrum for a given mass, there will be a significant spread of arrival times, providing a comparatively wide peak with large tails in the mass spectrum, and potentially obscuring and interfering with detection of ions of nearby masses. In fact, the reflectron TOF-MS was developed from the earlier linear TOF-MS design to compensate for broad ion kinetic energy distributions, although the reflectron does not fully resolve this problem. With mass resolving power defined in any TOF-MS as T/ΔT, the time-of-flight "T" from the ion source to the detector, as divided by the width of the mass spectrum at one-half the maximum ("ΔT"), a larger variance of kinetic energies generates a larger ΔT, due to the corresponding spreading of velocities and flight arrival times, decreasing mass resolving power, and also decreasing the signal-to-noise ratio ("SNR"). Excessive ion kinetic energy distributions can also reduce the mass accuracy, defined as the deviation in the calculated mass from the actual mass of a measured ion.

A need remains, therefore, for a TOF-MS apparatus and system which can select and/or control the kinetic energies of the ions comprising the ion beam, to create an ion beam having a selectable and comparatively narrow band of kinetic energies. Such a TOF-MS apparatus and system should also provide for selectable or configurable time-of-flight "T" and TOF focusing in various system embodiments, and may include multiple TOF focuses and tandem operation. Such a TOF-MS apparatus and system should also selectively preserve spatial information in the ion beam at detection, to allow for stigmatic imaging. In addition, such a TOF-MS apparatus and system should be capable of multimode operation, to selectively operate or configure the TOF-MS apparatus and system for these various features and in various combinations.

BRIEF SUMMARY OF THE INVENTION

The representative embodiments of the present invention provide numerous advantages. The representative apparatus and system embodiments, using a selected electrostatic mirror prism arrangement of a plurality of representative electrostatic mirror prism arrangements, can select and/or control the kinetic energies of the ions comprising the (pulsed) ion beam, to create an ion beam having a selectable and comparatively narrow band of kinetic energies. Various representative apparatus and system embodiments also provide for selectable or configurable time-of-flight and TOF focusing, and may include multiple TOF focuses and tandem operation. Such representative apparatus and system embodiments also selectively preserve spatial information in the ion beam at detection, to allow for stigmatic imaging. In addition, various representative apparatus and system embodiments are capable of multimode operation, to selectively operate or configure the representative apparatus and system embodiments for these various features and in various combinations. Lastly, representative apparatus and system embodiments provide for both ultra-high mass resolution and significantly improved accuracy compared to other TOF-MS devices.

A representative embodiment of a mass analyzing system for time-of-flight ("TOF") mass spectrometry analysis is disclosed, with the representative system embodiment coupleable to a pulsed ion source providing a first, pulsed ion beam having an input TOF focus. Such a representative system embodiment comprises: an electrostatic mirror prism arrangement coupled to an ion detector, with the electrostatic mirror prism arrangement comprising: a first electrostatic mirror prism having a first plurality of electrodes to generate a first retarding electric field to reflect the first ion beam and provide a second, intermediate ion beam having a spatial dispersion of ions proportional to ion kinetic energies, the second ion beam having an intermediate TOF focus; and a second electrostatic mirror prism spaced apart from the first electrostatic mirror prism by a first predetermined distance and further arranged to have a predetermined first angular offset from the first electrostatic mirror prism, the second electrostatic mirror prism having a second plurality of electrodes to generate a second retarding electric field to reflect the second ion beam and converge the spatial dispersion of ions to provide a third, recombined ion beam, the third ion beam having an output TOF focus; and the ion detector arranged at the output TOF focus to receive the third ion beam, the ion detector adapted to detect a plurality of ions of the third ion beam.

In a representative embodiment, the detector may be further adapted to detect ion impact position on the detector surface to generate a stigmatic image of a cross-section of the third ion beam.

In a representative embodiment, the predetermined first angular offset may be ninety degrees. In another representative embodiment, the predetermined first and second angular offsets may each be greater than or equal to 45° and less than or equal to 135°.

Also in a representative embodiment, the third, recombined ion beam has cancelled the spatial dispersion of ions of the second, intermediate ion beam.

In a representative embodiment, the electrostatic mirror prism arrangement may further comprise: a bandpass filter having a moveable energy bandpass control slit, the bandpass filter arranged at the intermediate TOF focus to selectively allow propagation of ions of the second ion beam having a selected range of ion kinetic energies.

In a representative embodiment, the first plurality of electrodes and the second plurality of electrodes each comprises: a first, front electrode having a first, ground electrical potential; a second electrode having a second electrical potential; and a third, rear electrode having a third electrical potential.

In a representative embodiment, each electrode of the first plurality of electrodes and the second plurality of electrodes comprise at least one electrode type selected from the group consisting of: a grid electrode, a solid electrode, a solid electrode having a central opening, and combinations thereof.

In another representative embodiment, the electrostatic mirror prism arrangement may further comprise: a first reflectron arranged spaced apart from the first electrostatic mirror prism in a first direction; and a second reflectron arranged spaced apart from the second electrostatic mirror prism in a second direction opposite the first direction; wherein the first and second reflectrons each have a corresponding central axis, the first and second reflectrons further arranged with each central axis aligned and coextensive with the second ion beam.

In such a representative embodiment, when the first and second electrostatic mirror prisms are in an off state, the second ion beam is reflected between the first and second reflectrons to provide a selectable number of reflections proportional to a selected time-of-flight.

Such a representative embodiment may further comprise: a processor coupled to the electrostatic mirror prism arrangement, the processor adapted to control on and off states of the first and second electrostatic mirror prisms to determine the number of reflections between the first and second reflectrons in response to the selected time-of-flight. For such a representative embodiment, when the second electrostatic mirror prism is in an on state, the second ion beam is reflected to provide the third ion beam.

In another representative embodiment, the electrostatic mirror prism arrangement further comprises: a third electrostatic mirror prism having a third plurality of ion-transparent electrodes to generate a third retarding electric field to reflect the first ion beam or a seventh ion beam and provide a fourth ion beam having a spatial dispersion of ions proportional to ion kinetic energies, the fourth ion beam having a fourth TOF focus; a fourth electrostatic mirror prism spaced apart from the third electrostatic mirror prism by a second predetermined distance and further arranged to have a predetermined second angular offset from the third electrostatic mirror prism, the fourth electrostatic mirror prism having a fourth plurality of electrodes to generate a fourth retarding electric field to reflect the fourth ion beam and converge the spatial dispersion of ions to provide a fifth, recombined ion beam, the fifth ion beam having a fifth TOF focus; a fifth electrostatic mirror prism having a fifth plurality of electrodes to generate a fifth retarding electric field to reflect the fifth ion beam and provide a sixth ion beam having a spatial dispersion of ions proportional to ion kinetic energies, the sixth ion beam having a sixth TOF focus; and a sixth electrostatic mirror prism spaced apart from the fifth electrostatic mirror prism by a third predetermined distance and further arranged to have a predetermined third angular offset from the fifth electrostatic mirror prism, the sixth electrostatic mirror prism having a sixth plurality of ion-transparent electrodes to generate a sixth retarding electric field to reflect the sixth ion beam and converge the spatial dispersion of ions to provide the seventh, recombined beam, the seventh ion beam having a seventh TOF focus collocated with the first TOF focus.

For such a representative embodiment, when the third electrostatic mirror prism and the sixth electrostatic mirror prism are in an off state, the first ion beam is transmitted to the first electrostatic mirror prism. Also for such a representative embodiment, when the third electrostatic mirror prism is in an off state, the seventh ion beam is transmitted to the first electrostatic mirror prism.

For such a representative embodiment, when the third electrostatic mirror prism, the fourth electrostatic mirror prism, the fifth electrostatic mirror prism, and the sixth electrostatic mirror prism are in an on state, the fourth, fifth, sixth and seventh ion beams are generated cyclically to provide a selectable number of reflections proportional to a selected time-of-flight.

Such a representative embodiment may further comprise: a processor coupled to the electrostatic mirror prism arrangement, the processor adapted to control the on and off states of the third and sixth electrostatic mirror prisms to determine the number of reflections in response to the selected time-of-flight. In such a representative embodiment, the time-of-flight may be user selectable to provide predetermined levels of a mass resolving power and a signal-to-noise ratio.

In a representative embodiment, the first electrostatic mirror prism, the second electrostatic mirror prism, the third electrostatic mirror prism, the fourth electrostatic mirror prism, the fifth electrostatic mirror prism, and the sixth electrostatic mirror prism may be coplanar in an energy dispersion plane.

Another representative embodiment of a mass analyzing system for time-of-flight ("TOF") mass spectrometry analysis is disclosed, with the representative system embodiment coupleable to a pulsed ion source providing a first, pulsed ion beam having an input TOF focus. Such a representative system embodiment comprises: an electrostatic mirror prism arrangement coupled to an ion detector, with the electrostatic mirror prism arrangement comprising: a first electrostatic mirror prism having a first plurality of electrodes to generate a first retarding electric field to reflect the first ion beam and provide a second, intermediate ion beam having a spatial dispersion of ions proportional to ion kinetic energies, the second ion beam having an second, intermediate TOF focus; a second electrostatic mirror prism spaced apart from the first electrostatic mirror prism by a first predetermined distance and further arranged to have a predetermined first angular offset from the first electrostatic mirror prism, the second electrostatic mirror prism having a second plurality of electrodes to generate a second retarding electric field to reflect the second ion beam and converge the spatial dispersion of ions to provide a third, recombined ion beam, the third ion beam having a third TOF focus; a third electrostatic mirror prism having a third plurality of electrodes to generate a third retarding electric field to reflect the third ion beam and provide a fourth ion beam having a spatial dispersion of ions proportional to ion kinetic energies, the fourth ion beam having a fourth, intermediate TOF focus; and a fourth electrostatic mirror prism spaced apart from the third electrostatic mirror prism by a second predetermined distance and further arranged to have a predetermined second angular offset from the third electrostatic mirror prism, the fourth electrostatic mirror prism having a fourth plurality of electrodes to generate a fourth retarding electric field to reflect the fourth ion beam and converge the spatial dispersion of ions to provide a fifth, recombined ion beam, the fifth ion beam having a fifth, output TOF focus; and the ion detector arranged at the fifth, output TOF focus to receive the fifth ion beam, the ion detector adapted to detect a plurality of ions of the fifth ion beam.

Such a representative embodiment may further comprise: a dissociation device adapted to generate a laser beam or an electron beam to fragment molecules of the third ion beam at the third TOF focus.

Such a representative embodiment may further comprise: a processor coupled to the dissociation device, the processor adapted to control the on and off states of the dissociation device to selectively fragment molecules of the third ion beam at the third TOF focus. For such a representative embodiment, the processor may be further adapted to turn the dissociation device on or off at a selected duty cycle to provide a tandem operating mode for mass spectra having a plurality of fragment molecules and mass spectra having fragment-free molecules.

For such a representative embodiment, the electrostatic mirror prism arrangement may further comprise: a first bandpass filter having a moveable energy bandpass control slit, the first bandpass filter arranged at the second, intermediate TOF focus to selectively allow propagation of ions of the second ion beam having a first selected range of ion kinetic energies; and a second bandpass filter having a moveable energy bandpass control slit, the bandpass filter arranged at the fourth, intermediate TOF focus to selectively allow propagation of ions of the fourth ion beam having a second selected range of ion kinetic energies In such a representative embodiment, the first electrostatic mirror prism, the second electrostatic mirror prism, the third electrostatic mirror prism, and the fourth electrostatic mirror prism may be coplanar in an energy dispersion plane. In another representative embodiment, the third electrostatic mirror prism and the fourth electrostatic mirror prism may not be coplanar with the first electrostatic mirror prism and the second electrostatic mirror prism.

Another representative embodiment of a mass analyzing system for time-of-flight ("TOF") mass spectrometry analysis is disclosed, with the representative system embodiment coupleable to a pulsed ion source providing a first, pulsed ion beam having an input TOF focus. Such a representative system embodiment comprises: a plurality of pairs of electrostatic mirror prisms, a bandpass filter, and an ion detector, with each pair of electrostatic mirror prisms of the plurality of pairs of electrostatic mirror prisms comprising: a first electrostatic mirror prism having a first plurality of electrodes to generate a first retarding electric field to reflect the first ion beam or a next recombined ion beam and provide an intermediate ion beam having a spatial dispersion of ions proportional to ion kinetic energies, the intermediate ion beam having a intermediate TOF focus; and a second electrostatic mirror prism spaced apart from the first electrostatic mirror prism by a first predetermined distance and further arranged to have a predetermined first angular offset from the first electrostatic mirror prism, the second electrostatic mirror prism having a second plurality of electrodes to generate a second retarding electric field to reflect the intermediate ion beam and converge the spatial dispersion of ions to provide the next recombined ion beam, the next recombined ion beam having a combined output-input TOF focus; with the bandpass filter having a moveable energy bandpass control slit, the bandpass filter arranged at at least one intermediate TOF focus of a plurality of intermediate TOF focuses provided by the plurality of pairs of electrostatic mirror prisms, to selectively allow propagation of ions of a corresponding intermediate ion beam having a selected range of ion kinetic energies; and with the ion detector arranged at the combined output-input TOF focus to receive the next recombined ion beam provided by a last pair of electrostatic mirror prisms of the plurality of pairs of electrostatic mirror prisms, the ion detector adapted to detect a plurality of ions of the next recombined ion beam.

Numerous other advantages and features of the present invention will become readily apparent from the following detailed description of the invention and the embodiments thereof, from the claims and from the accompanying drawings.

BRIEF DESCRIPTION OF THE DRAWINGS

The objects, features and advantages of the present invention will be more readily appreciated upon reference to the following disclosure when considered in conjunction with the accompanying drawings, wherein like reference numerals are used to identify identical components in the various views, and wherein reference numerals with alphabetic characters are utilized to identify additional types, instantiations or variations of a selected component embodiment in the various views, in which.

DETAILED DESCRIPTION OF REPRESENTATIVE EMBODIMENTS

Figure 1:
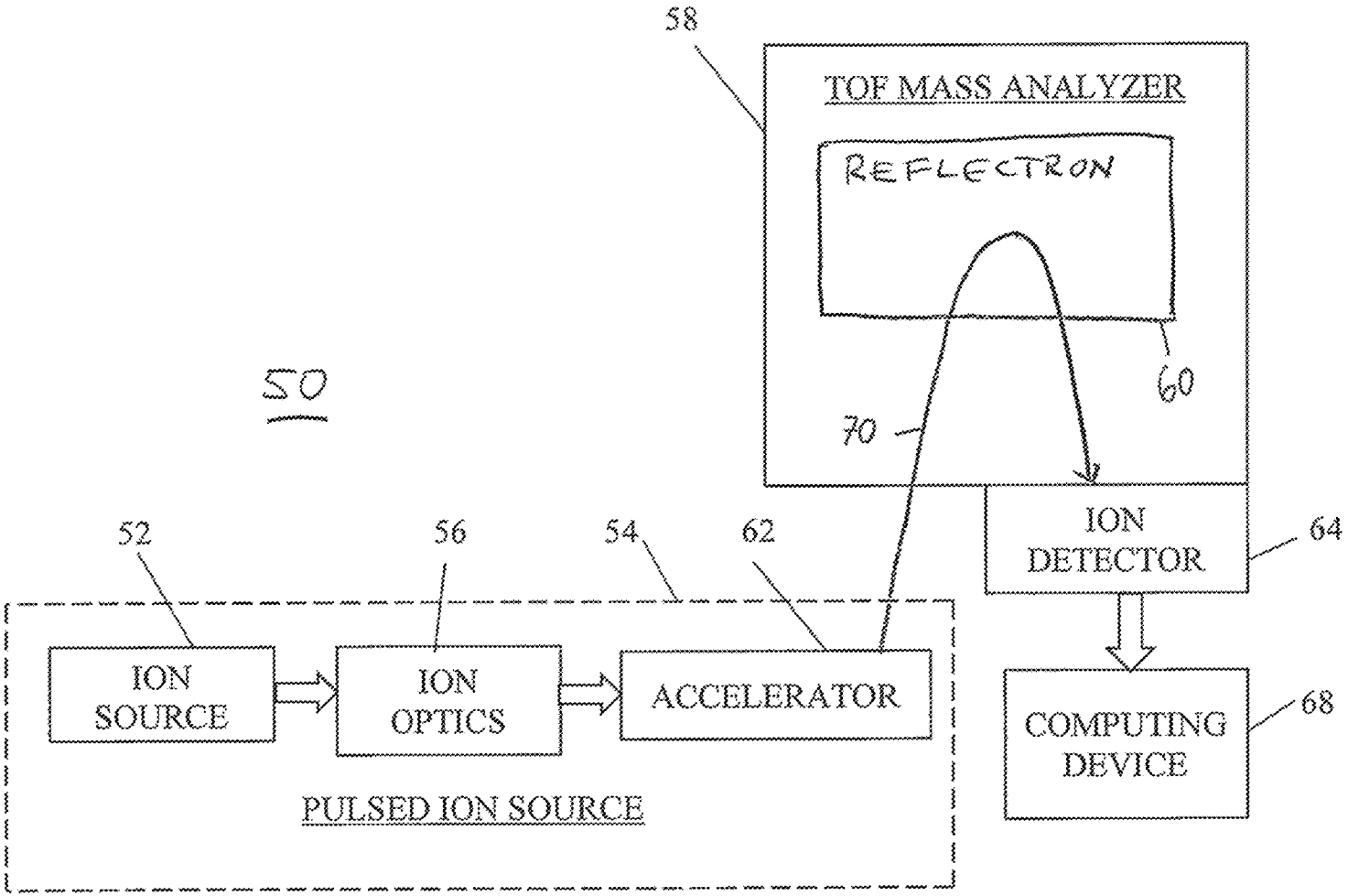
FIG. 1 (PRIOR ART)
FIG. 1 is a block diagram illustrating a prior art TOF-MS system embodiment.

While the present invention is susceptible to embodiment in many different forms, there are shown in the drawings and will be described herein in detail specific exemplary embodiments thereof, with the understanding that the present disclosure is to be considered as an exemplification of the principles of the invention and is not intended to limit the invention to the specific embodiments illustrated. In this respect, before explaining at least one embodiment consistent with the present invention in detail, it is to be understood that the invention is not limited in its application to the details of construction and to the arrangements of components set forth above and below, illustrated in the drawings, or as described in the examples. Methods and apparatuses consistent with the present invention are capable of other embodiments and of being practiced and carried out in various ways. Also, it is to be understood that the phraseology and terminology employed herein, as well as the abstract included below, are for the purposes of description and should not be regarded as limiting.

As mentioned above and as discussed in greater detail below, the representative embodiments of a TOF-MS apparatus 100, 100A and system 200, 200A, using a selected electrostatic mirror prism arrangement of a plurality of representative electrostatic mirror prism arrangements, can select and/or control the kinetic energies of the ions comprising the (pulsed) ion beam, to create an ion beam having a selectable and comparatively narrow band of kinetic energies. Such embodiments of a TOF-MS apparatus 100, 100A and system 200, 200A also provide for selectable or configurable time-of-flight and TOF focusing in various system embodiments, and may include multiple TOF focuses and tandem operation. Such embodiments of a TOF-MS apparatus 100, 100A and system 200, 200A also selectively preserve spatial information in the ion beam at detection, to allow for stigmatic imaging. In addition, such embodiments of a TOF-MS apparatus 100, 100A and system 200, 200A are capable of multimode operation, to selectively operate or configure the embodiments of a TOF-MS apparatus 100, 100A and system 200, 200A for these various features and in various combinations. Lastly, such embodiments of a TOF-MS apparatus 100, 100A and system 200, 200A provide for both ultra-high mass resolution and significantly improved accuracy compared to other TOF-MS devices.

Figure 2:
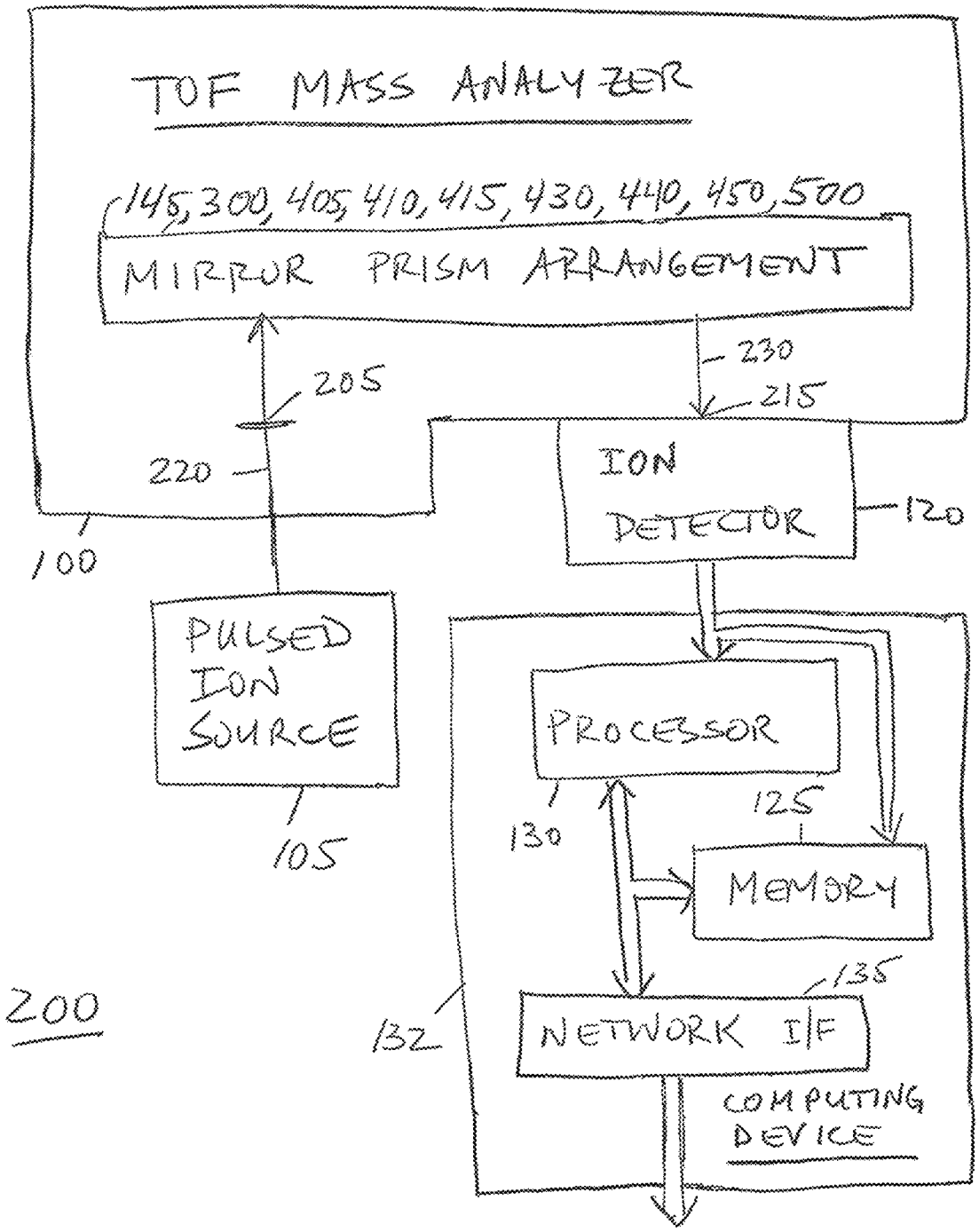
FIG. 2 is a block diagram illustrating a representative TOF mass analyzer 100 apparatus embodiment and a representative TOF-MS system embodiment.
Figure 3:
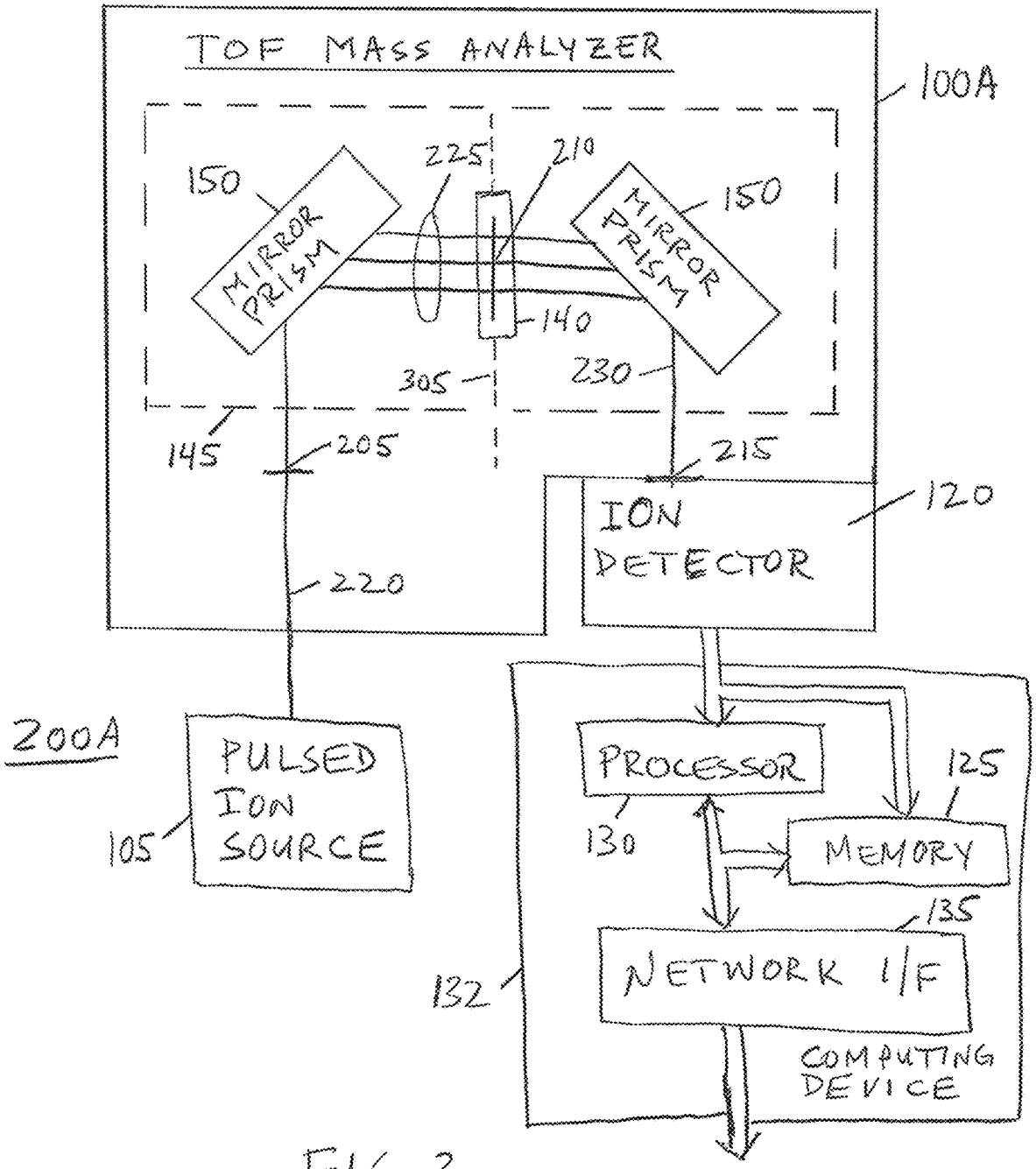
FIG. 3 a block diagram illustrating a representative TOF mass analyzer apparatus embodiment, as a first representative embodiment having a representative first electrostatic mirror prism arrangement, and a representative TOF-MS system embodiment, as a first representative embodiment.

FIG. 2 is a block diagram illustrating a representative TOF mass analyzer 100 apparatus embodiment and a representative TOF-MS system 200 embodiment. FIG. 3 is a block diagram illustrating a representative TOF mass analyzer 100A apparatus embodiment, as a first representative embodiment of a TOF mass analyzer 100 apparatus, and a representative TOF-MS system 200A embodiment, as a first representative embodiment of a TOF-MS system 200. FIG.

Figure 5A:
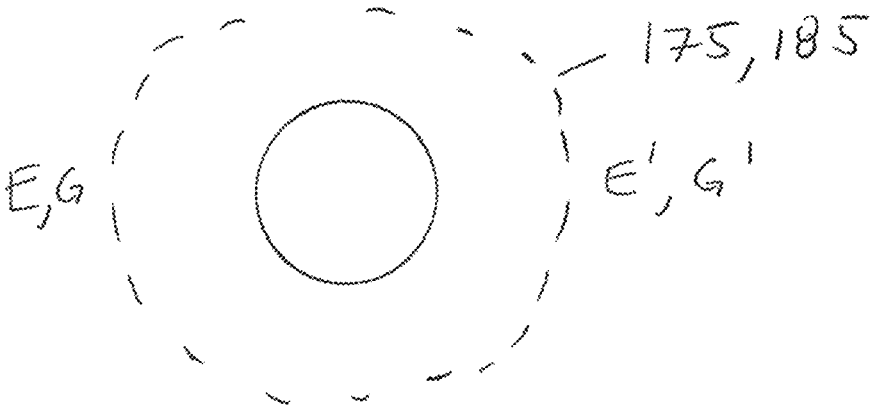
FIGS. 5A and 5B are cross-sectional, schematic diagrams illustrating, in FIG. 5A, a cross-section of a primary ion beam (or an output beam) provided to a representative TOF mass analyzer apparatus embodiment, and in FIG. 5B, a cross-section of a secondary ion beam spatially-dispersed by the electrostatic mirror prism within the representative TOF mass analyzer apparatus embodiment and the representative TOF-MS system embodiment.
Figure 5B:
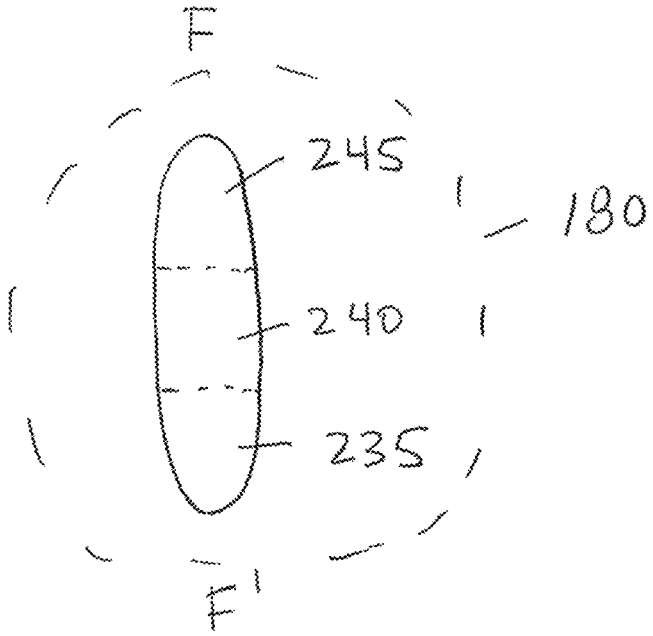
Figure 6:
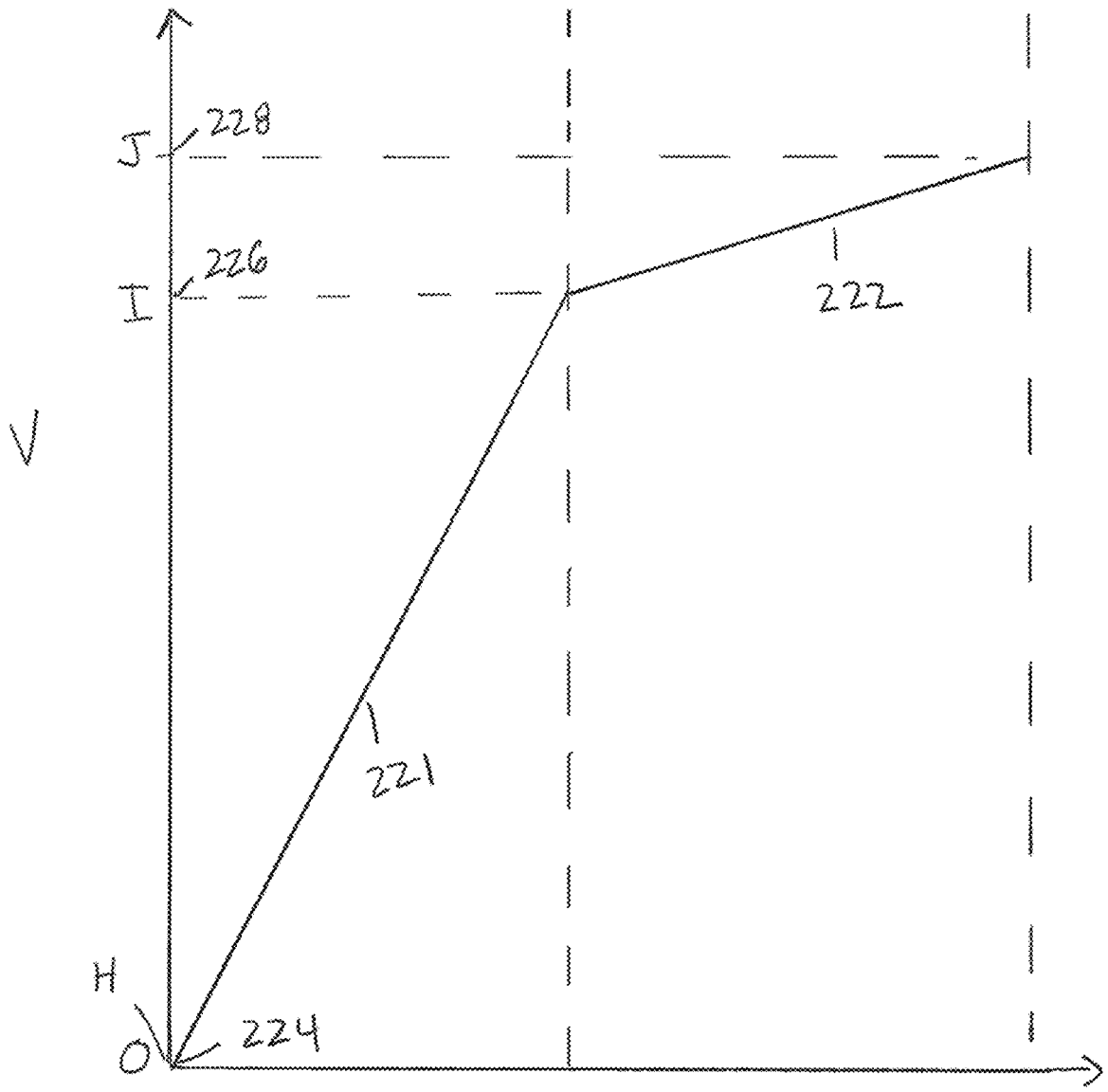
FIG. 6 is a graphical diagram illustrating representative electrical potentials applied within representative electrostatic mirror prisms in a representative TOF mass analyzer apparatus embodiment and a representative TOF-MS system embodiment.
Figure 7:
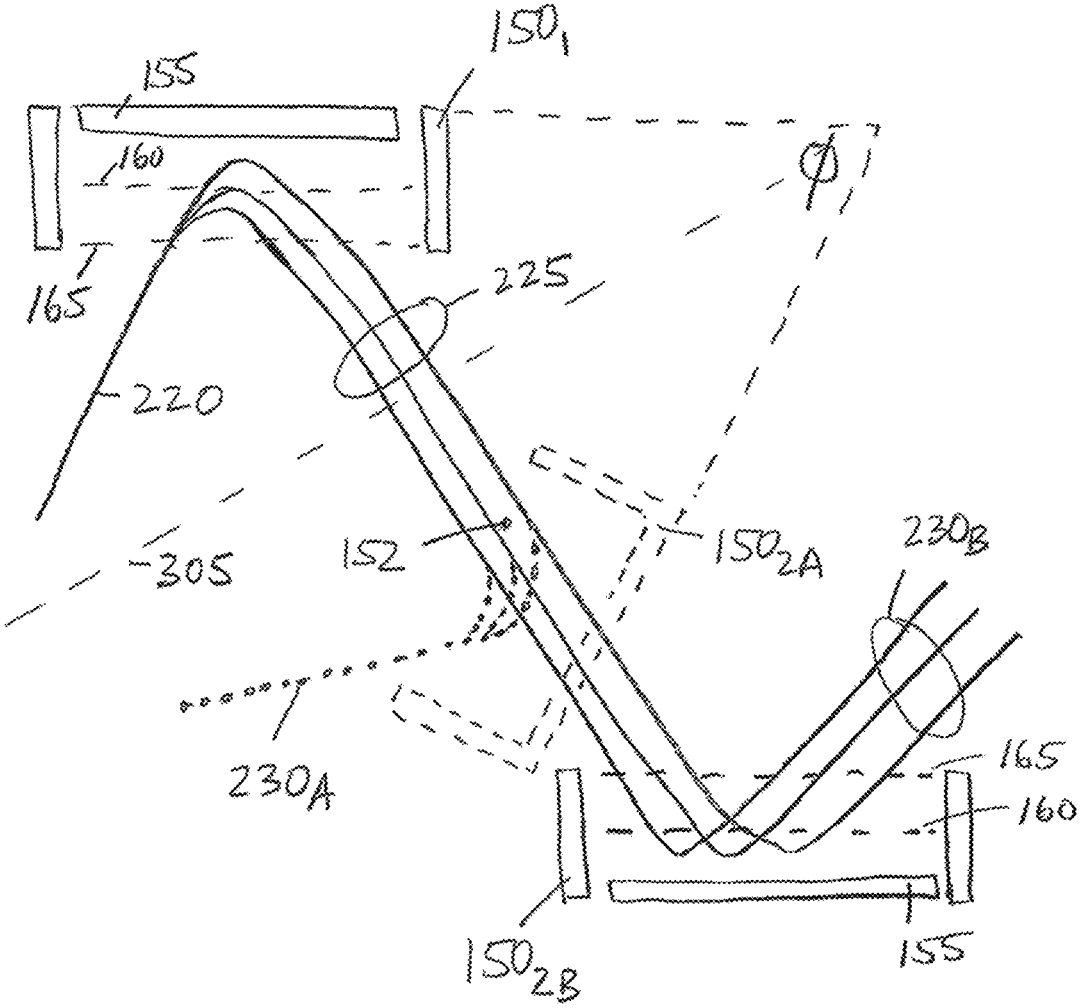
FIG. 7 is a cross-sectional, schematic plan view diagram illustrating a representative spatially-dispersed secondary ion beam, with corresponding angular offsets of representative electrostatic mirror prisms, to generate either a recombined and/or convergent tertiary ion beam or an additionally spatially-dispersed or divergent tertiary ion beam.
Figure 8A:
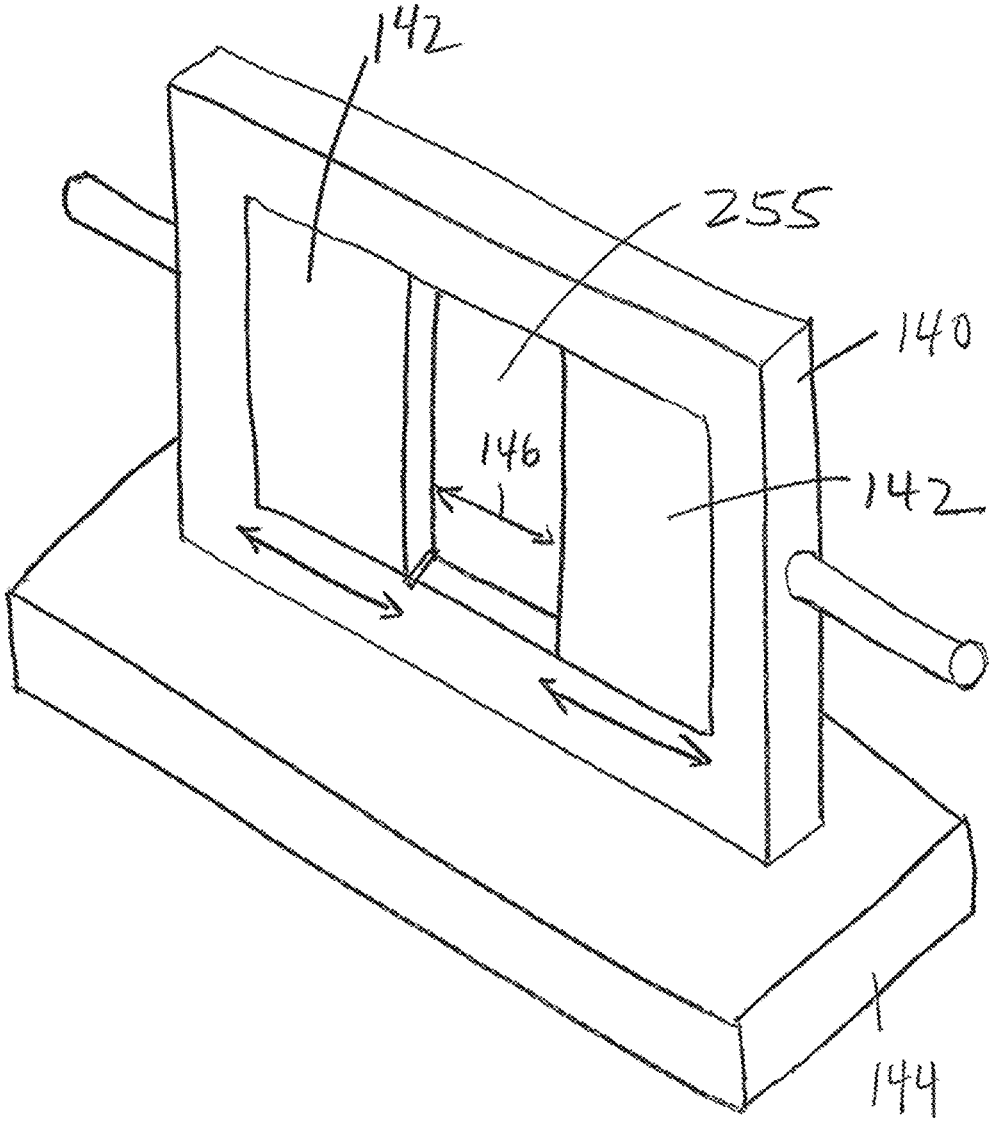
FIGS. 8A and 8B are isometric diagrams illustrating, in FIG. 8A, a representative band-pass filter for a representative TOF mass analyzer apparatus embodiment and a representative TOF-MS system embodiment, and in FIG. 8B, representative sliding plates forming the energy bandpass control slit.
Figure 8B:
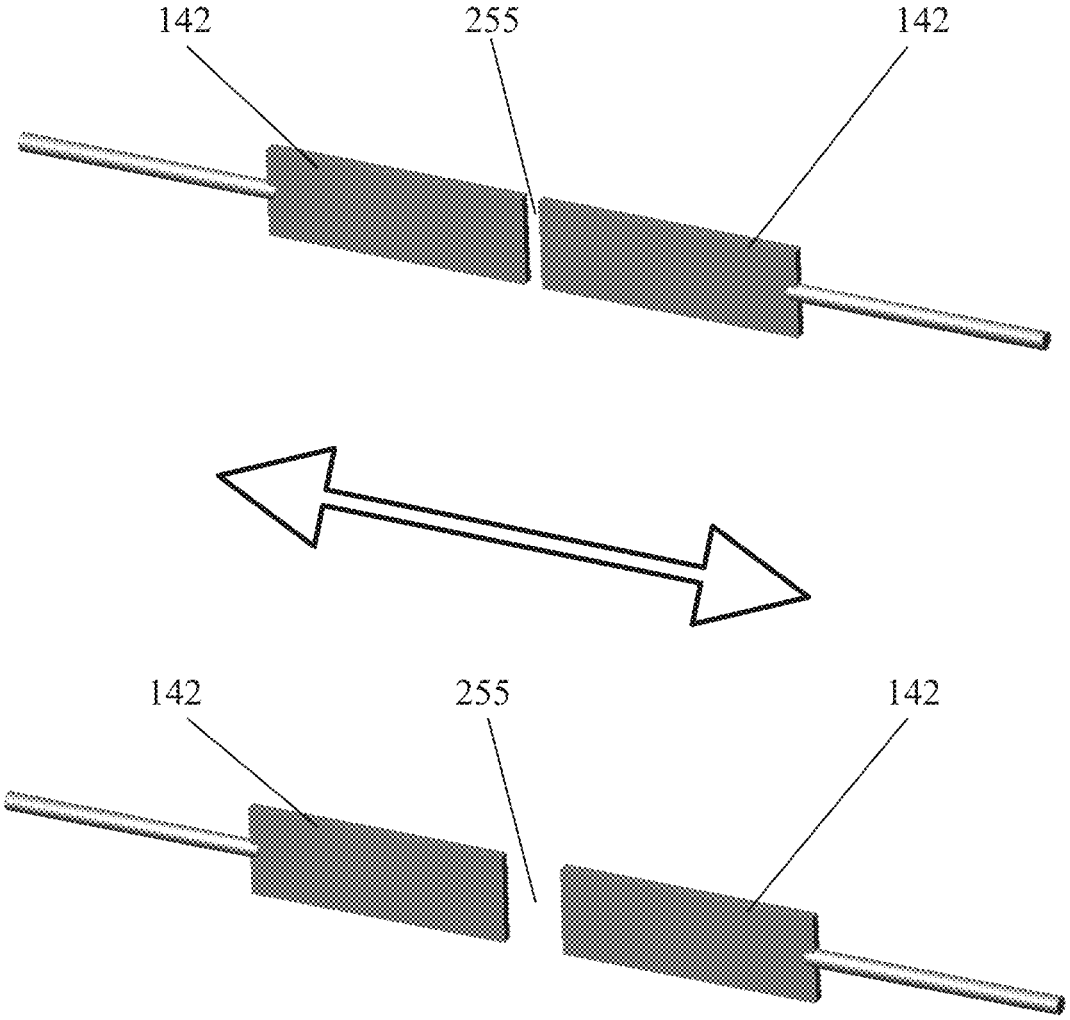

4 is a cross-sectional, schematic plan view diagram illustrating a representative electrostatic mirror prism arrangement 145, for a representative TOF mass analyzer 100A apparatus embodiment and a representative TOF-MS system 200A embodiment, having arranged or configured first embodiments of electrostatic mirror prisms 150. FIGS. 5A and 5B are cross-sectional, schematic diagrams illustrating, in FIG. 5A, a cross-section of a primary ion beam (or an output beam) provided to a representative TOF mass analyzer 100 apparatus embodiment, and in FIG. 5B, a cross-section of a secondary ion beam spatially-dispersed by the electrostatic mirror prism 150 within the representative TOF mass analyzer 100, 100A apparatus embodiments. FIG. 6 is a graphical diagram illustrating representative electrical potentials applied within representative electrostatic mirror prisms 150 in a representative TOF mass analyzer 100 apparatus embodiment and a representative TOF-MS system 200 embodiment. FIG. 7 is a cross-sectional, schematic plan view diagram illustrating a representative spatially-dispersed secondary ion beam, with corresponding angular offsets of representative electrostatic mirror prisms 150, to generate either a recombined and/or convergent tertiary ion beam or an additionally spatially-dispersed or divergent tertiary ion beam, depending upon the mutual geometrical arrangements of the electrostatic mirror prisms 150. FIGS. 8A and 8B are isometric diagrams illustrating, in FIG. 8A, representative band-pass filter (or filter system) 140 for a representative TOF mass analyzer 100 apparatus embodiment and a representative TOF-MS system 200, 200A embodiment, and in FIG. 8B, representative sliding plates 142 forming the energy bandpass control slit 255.

Referring to FIGS. 2 and 3, a representative TOF-MS system 200, 200A comprises a TOF mass analyzer 100 apparatus, an ion detector 120, and a pulsed ion source 105. A representative TOF mass analyzer 100, 100A apparatus embodiment comprises at least one electrostatic mirror prism arrangement 145, 300, 400, 405, 410, 415, 430, 440, 450, or 500, which is coupled to the ion detector 120. An electrostatic mirror prism arrangement 145, 300, 400, 405, 410, 415, 430, 440, 450, 500 comprises at least two electrostatic mirror prisms 150, which are referred to herein as "mirror prisms" because each such electrostatic mirror prism 150 concurrently reflects the incoming ion beam and also disperses (or conversely, converges of focuses) the ions of the ion beam according to their kinetic energies, as discussed in greater detail below. Also as discussed in greater detail below, a representative TOF-MS system 200, 200A may also comprise, optionally, a computing device 132 having a processor 130, a memory 125, and a network interface ("network I/F") 135.

Figure 4:
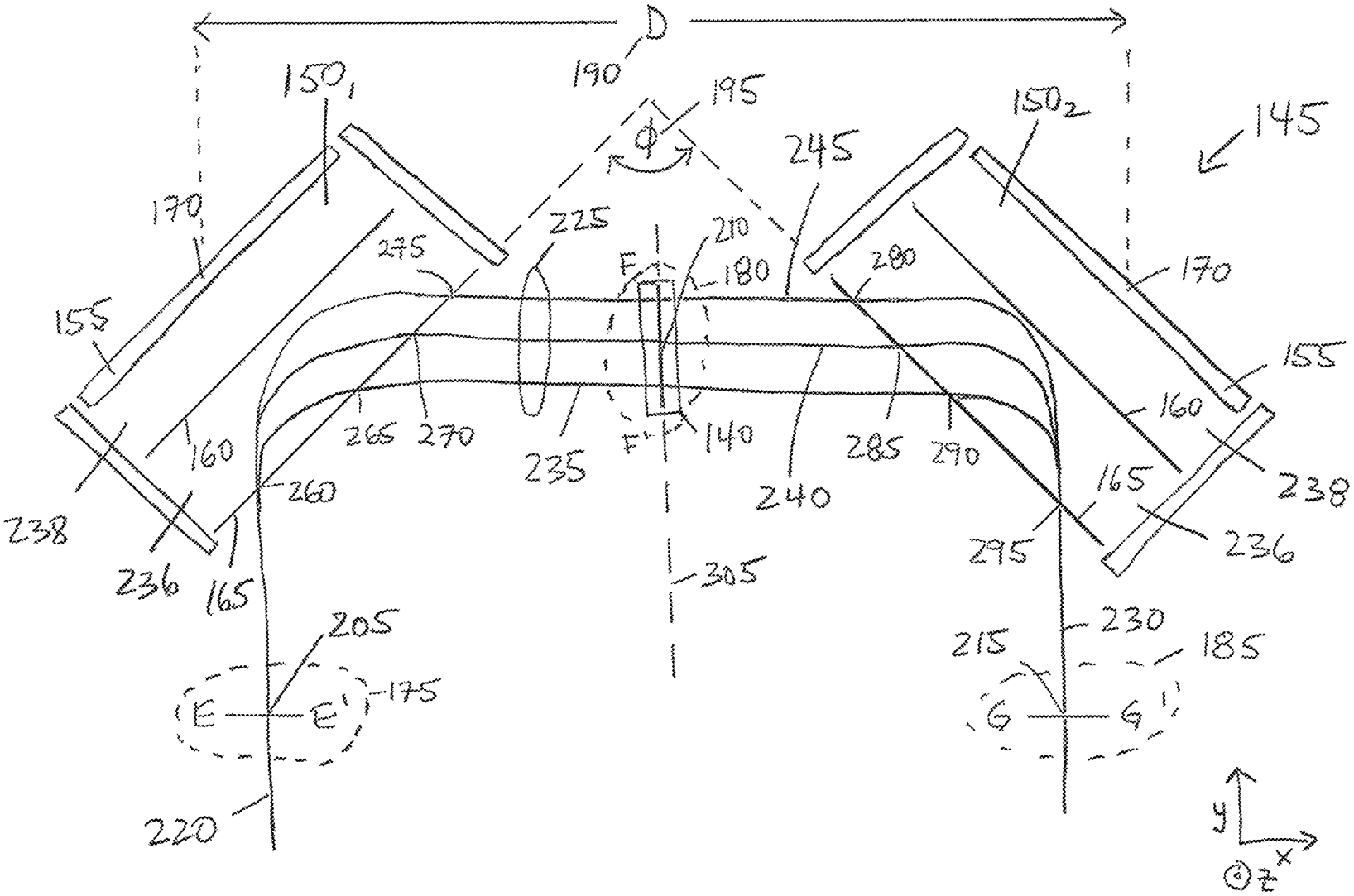
FIG. 4 is a cross-sectional, schematic plan view diagram illustrating in greater detail the representative first electrostatic mirror prism arrangement, for a representative TOF mass analyzer apparatus embodiment and a representative TOF-MS system embodiment.

Referring to FIGS. 2-8, for the representative TOF mass analyzer 100 apparatus embodiment and the representative TOF-MS system 200, 200A, each representative electrostatic mirror prism arrangement 145, 300, 400, 405, 410, 415, 430, 440, 450, 500 comprises at least two electrostatic mirror prisms 150 arranged or configured, as a pair, to be spaced apart from each other a predetermined distance "D" (which may be measured between any corresponding locations of the electrostatic mirror prisms 150) and further arranged or configured to have a predetermined angular offset "ϕ" from each other. As illustrated in FIGS. 3 and 4, for a representative TOF mass analyzer 100A apparatus embodiment, the first electrostatic mirror prism arrangement 145 comprises at least two electrostatic mirror prisms 150, shown in FIG. 4 as a first electrostatic mirror prism $\mathbf{150}_1$ and second mirror prism $\mathbf{150}_2$ having a predetermined angular offset ϕ of about ninety degrees. For the representative TOF mass analyzer 100, 100A apparatus embodiments and the representative TOF-MS system 200, 200A, a representative electrostatic mirror prism arrangement 145, 300, 400, 405, 410, 415, 430, 440, 450, 500 may also comprise a bandpass filter 140 which is arranged or configured in between the first and second electrostatic mirror prisms $\mathbf{150}_1$ and $\mathbf{150}_2$, as discussed in greater detail below.

Also as discussed in greater detail below, the various representative electrostatic mirror prism 150 arrangements 145, 300, 400, 405, 410, 415, 430, 440, 450, 500 may comprise additional electrostatic mirror prisms 150, pairwise, in increments of two electrostatic mirror prisms 150 taken together, with the electrostatic mirror prisms 150 arranged or configured, as a pair, to be spaced apart from each other a predetermined distance "D" (190) and further arranged or configured to have a predetermined angular offset "ϕ" (195) from each other, both of which may be the same or different between and among each such pair of electrostatic mirror prisms 150. Any of the various representative electrostatic mirror prism arrangements 145, 300, 400, 405, 410, 415, 430, 440, 450, 500 may also comprise other components, such as one or more reflectrons 420, 425, such as illustrated and discussed below with reference to FIG. 27. Any of the various representative electrostatic mirror prism arrangements 145, 300, 400, 405, 410, 415, 430, 440, 450, 500 may also comprise other components for configuring the representative TOF-MS system 200, 200A embodiments for tandem operation, such as illustrated and discussed below with reference to FIG. 29.

The predetermined distance "D" 190 may be measured in any way, and as illustrated, is measured along a transverse, "x" axis, from the respective centers 170 of the back (or rear) electrodes 155 of the first electrostatic mirror prism $\mathbf{150}_1$ and second mirror prism $\mathbf{150}_2$. Similarly, the predetermined angular offset ϕ 195 also may be measured in any way, and as illustrated, is measured along a transverse x-y plane, using lines extending from the respective front planes or first (or front) electrodes 165 (or equivalently, from the third or rear electrodes 155) of the first electrostatic mirror prism $\mathbf{150}_1$ and second mirror prism $\mathbf{150}_2$. As illustrated in FIG. 4, the predetermined angular offset ϕ between the first electrostatic mirror prism $\mathbf{150}_1$ and second mirror prism $\mathbf{150}_2$ is about ninety degrees (90°), for example and without limitation, with other predetermined angular offsets illustrated and discussed below with reference to FIGS. 9-11 and 26. In this configuration, the electrostatic mirror prisms 150 are right angle ion mirror prisms ("RAIMPs"), which has maximized energy filtering functionality because their ability to disperse ions with different kinetic energies in space across a bandpass filter 140 is the highest among electrostatic mirror prism arrangements 145, 300, 400, 415, 430, 450, 500 with other angular offsets ϕ.

As discussed in greater detail below, the representative TOF mass analyzer 100, 100A apparatus embodiments allow the ions to travel to the ion detector 120, with corresponding masses determined based on differing flight times (due to their differing mass-to-charge (m/z) ratios). The ion detector 120, typically together with other processing devices such as a programmed processor 130, as a detection system) measures ion signal intensities (i.e., counts the ions) and records the time that each ion arrives at (impacts) the ion detector 120. In some embodiments, the ion detector 120 will also measure and record the location of ion impacts. In some embodiments, the representative TOF mass analyzer 100, 100A apparatus is operated at a multi-pulsing (or multiplexing) rate, with multiple packets of ions provided as the first, incoming ion beam 220. Such an ion detector 120 may be implemented as known in the MS arts. The ion detector 120 produces an ion signal that is then utilized by a processor 130 to calculate actual times-of-flight from which m/z ratios are correlated, and construct a mass spectrum descriptive of the sample atoms and molecules, as appreciated by persons skilled in the art.

The ion detector 120, such as MCP plate or electron multiplier, does not detect arrival times but detects ion currents. The arrival times are detected by data acquisition hardware such as time-to-digital converter or signal digitizer, such as embodied within a processor 130. This hardware works with the ion currents amplified by the ion detector 120.

In some embodiments of the present disclosure, the ion detector 120 is a multi-channel ion detector, which may be position-sensitive, such as for use in the stigmatic imaging capability discussed below. Such a multi-channel ion detector is configured for collecting and measuring the flux (or current) of mass-discriminated ions over a plurality of channels, with each channel, or pixel, corresponding to a discrete detection area or spot on the detector face. Such an ion detector 120 is capable of detecting the impact of an ion at that detection spot and converting it into an independent electron shower, whose current to the electron collector (anode) can be measured as an electrical signal. An example of a multi-channel detector is a micro-channel plate (MCP) detector. When provided as a position-sensitive ion detector, such as an ion detector 120 (based on MCP technology) is capable of making multiple independent measurements at multiple positions on the electron collector, and thus generating independent measurement signal outputs for each detection (ion impact) spot. In other embodiments, the ion detector 120 can be an electron multiplier (EM) optimized for TOF-MS applications.

A representative TOF-MS system 200, 200A may further comprise a pulsed pulsed ion source 105 (which may optionally include any ion optics, ion guides or ion accelerators), which provides a first or primary ion beam 220 to the TOF mass analyzer 100, 100A. The ion source embodiment which generates the ions may be any type of continuous-beam or pulsed ion source suitable for producing analyte ions for spectrometry, although as provided to the TOF mass analyzer 100, 100A, the first or primary ion beam 220 is comprised of a one or more pulses or packets of ions, i.e., is a pulsed ion beam, which may be implemented using any mechanism, such as known pulsed ion extraction optics or modulation. Depending on the type of ionization implemented, the pulsed ion source 105 may be arranged in a vacuum chamber or may operate at or near atmospheric pressure. Typical ion sources 105 may include, for example and without limitation, electron ionization (EI) sources, chemical ionization (CI) sources, photo-ionization (PI) sources, electrospray ionization (ESI) sources, atmospheric pressure chemical ionization (APCI) sources, atmospheric pressure photo-ionization (APPI) sources, field ionization (FI) sources, plasma or corona discharge sources, laser desorption ionization (LDI) sources, and matrix-assisted laser desorption ionization (MALDI) sources. In some system embodiments, the pulsed ion source 105 may include two or more ionization devices, which may be of the same type or different type. The sample material to be analyzed may be introduced to the pulsed ion source 105 by any suitable means, including by many of those ion sources discussed above.

As mentioned above, a pulsed ion source 105, as used herein, also generally may include any ion optics or ion guides, such as those described as examples in greater detail below. Also as mentioned above, the representative TOF-MS system 200, 200A embodiments may further comprise a computing device 132 having a processor 130, a memory 125, and a network interface 135, such as those described as examples in greater detail below. The processor 130 is adapted to or configured for control, monitor and/or time various functional aspects of the TOF-MS system 200, 200A described herein, such as for multimode operations and for use in selecting and controlling the time-of-flight "T". Such a computing device 132 may be, or be embodied in, for example and without limitation, a network computer, a mainframe computer, a desktop computer, laptop computer, portable computer, tablet computer, handheld computer, mobile computing device, personal digital assistant (PDA), smartphone, and so on. The processor 130 may also control all voltage sources (not separately illustrated), as well as timing controllers, clocks, frequency/waveform generators and the like as needed for applying voltages to various components of the TOF-MS system 200, 200A, including voltages applied to electrostatic mirror prisms 150 and other components of representative electrostatic mirror prism arrangements 145, 300, 400, 405, 410, 415, 430, 440, 450, 500, as described below. The processor 130 may also be adapted or configured to receive the ion detection signals from the ion detector 120 and perform tasks relating to data acquisition and signal analysis as necessary to generate chromatograms, drift spectra, and mass (m/z ratio) spectra characterizing the sample under analysis. For example and without limitation, the processor 130 may also be adapted or configured to apply mass calibration methods and calculating ion mass, as known in the art. The processor 130 may also be adapted or configured to control a user interface (not separately illustrated) that provides screen displays of spectrometric data and other data and receives user input, for example and without limitation. For all such purposes, the computing device 132, via network I/F 135, may be in communication with various components of the TOF-MS system 200, 200A via wired or wireless communication links. The various components of the computing device 132 are also discussed in greater detail below.

For purposes of the present disclosure, all that is required of the pulsed ion source 105 is that it generate a pulsed ion beam which is provided to the TOF mass analyzer 100, 100A as a first or primary (pulsed) ion beam 220, without any kinetic energy filtering being required. Accordingly, the first or primary ion beam 220 may be and generally is comprised of a plurality of ions, in packets or pulses, having a wide range of kinetic energies.

Each of the electrostatic mirror prisms 150, when turned on and electrostatically biased to deflect ions, provides a retarding electric field using corresponding voltages applied to the electrodes 155, 160, 165 of the electrostatic mirror prisms 150. In order to shape the retarding electric field for high mass resolving power, the electrostatic mirror prisms 150 may use at least one ion-transparent electrode 160 (e.g., a grid or gridless and having an opening 312) to separate the field into at least two different regions, as illustrated in FIGS. 4 and 6, with a first region 236 having an electric field with a first gradient (illustrated using line 221 in FIG. 6) and a second region 238 having a second electric field with a second gradient (illustrated using line 222 in FIG. 6), with the first gradient greater than the second gradient. Alternatively, the electrostatic mirror prisms 150 may be gridless, as illustrated for various embodiments discussed below. For ease of discussion, the description of how the electrostatic mirror prisms 150 operate uses a comparatively simple geometry with two electrodes 155, 160, having applied voltages and the first, front electrode 165 having a ground potential. For example, as illustrated in FIG. 6, a first (and lowest) voltage 224 (having a voltage level "H", such as a ground potential (zero)) is applied to the first, front electrode 165 (illustrated in cross-section in FIG. 4 as a grid electrode), a second voltage 226 (having a voltage level "I") is applied to the second, middle electrode 160 (also illustrated in cross-section in FIG. 4 as a grid electrode), and a third (highest) voltage 228 (having a voltage level "J") is applied to the third, back electrode 155 (illustrated in cross-section in FIG. 4 as a solid, planar electrode). Depending upon the number of electrodes utilized in the electrostatic mirror prisms 150, one or more additional voltages will be applied to each corresponding intermediate electrode (i.e., any one or more electrodes located between the first and back electrodes 165, 155). Known structures, such as a resistive voltage divider, may be utilized to supply these different voltages to the various electrodes of the electrostatic mirror prisms 150, with the corresponding voltages and electrode shapes, configurations and layouts utilized to shape the resulting electric field. Not separately illustrated in the Figures, the various electrodes 155, 160, 165 may be separated from each other by resistors or other resistive components, and further are typically electrically isolated from any housing or enclosure (typically provided at a ground potential), such as using various insulators or other dielectric materials.

In the representative embodiments, as novel features, the electrostatic mirror prisms 150, such as configured as right angle ion mirror prisms, based on a set of several closely positioned electrodes 155, 160, 165 are utilized for several purposes, namely, for ion deflection, for time-of-flight focusing (e.g., within a TOF-MS analyzer 100), and further for separation of ions over kinetic energies (e.g., as electrostatic prisms). As illustrated in FIGS. 3, 4 and 9-15, the geometry of the electrostatic mirror prisms 150 may be planar/rectangular, e.g. in the shape of a rectangular box, a parallelepiped, a trapezoid (FIGS. 3, 4, 10-12, 14-18), or cylindrical (FIGS. 9, 13), for example and without limitation. As shown in FIGS. 3 and 4, a first or primary ion beam 220 may enter the first electrostatic mirror prism $\mathbf{150}_1$ at a 45° angle of incidence from the normal to the retarding electric field plane, for example and without limitation. Thus the first or primary ion beam 220 resembles an event of "ion ricochet" from this retarding electric field plane, and the main axis of symmetry of the first electrostatic mirror prism $\mathbf{150}_1$ may be turned by 45° with respect to that of the first or primary ion beam 220 provided by the pulsed ion source 105.

The use of the retarding electric field makes the electrostatic mirror prisms 150 operate as an ion mirror, and instead of reflecting ions back within a rather sharp angle, as reflectrons do, the electrostatic mirror prisms 150 deflect the ion beams by certain angles depending on the sector angle and the kinetic energies of the ions. As illustrated for the configurations of FIGS. 3 and 4, the electrostatic mirror prisms 150 deflect ions by a 90° angle, thereby acting as a right angle ion mirror. At the same time, the first electrostatic mirror prism $\mathbf{150}_1$ separates the reflected ions into spatially resolved parallel beams corresponding to their kinetic energies, thereby acting as an electrostatic prism. This configuration of the electrostatic mirror prisms 150 enables new capabilities and functionalities in TOF-MS analysis.

Referring to FIG. 4, the first or primary ion beam 220 (pulsed, and typically collimated or parallel and having ions with a range of kinetic energies) enters the TOF mass analyzer 100, 100A and has a first, input (or initial) TOF focus (or focal plane) 205, namely, a point of simultaneous arrival of ions of the same mass and charge but with different kinetic energies, i.e., an ion packet origination plane. The first or primary ion beam 220 enters the first electrostatic mirror prism $\mathbf{150}_1$ and is deflected (in this case by) 90° to form a second or secondary ion beam 225, which has a second (or secondary) TOF focus (or focal plane) 210. In addition, as discussed in greater detail below, the ions comprising the second or secondary ion beam 225 have been spatially-dispersed and separated into different bands having different kinetic energies, illustrated in FIG. 4 as kinetic energy bands 235, 240, 245. For selection of a kinetic energy band of the second or secondary ion beam 225, the bandpass filter 140 may be placed at the second TOF focus 210. In turn, the second or secondary ion beam 225 enters the second electrostatic mirror prism $\mathbf{150}_2$ and is deflected (in this case also by 90°) to form a third or tertiary ion beam 230, which has a third, output TOF focus (or focal plane) 215. In addition, as discussed in greater detail below, the spatially-dispersed ions (according to their kinetic energies) comprising the second or secondary ion beam 225 have now been recombined and/or converged into the third or tertiary ion beam 230 (in which the ions are no longer spatially-dispersed according to their kinetic energies), with spatial information of the ions (of the first or primary ion beam 220) preserved in the third or tertiary ion beam 230. An ion detector 120 is typically placed at this third TOF focus 215 to detect the arrival times (and/or positions) of the ions of the third or tertiary ion beam 230.

For other representative electrostatic mirror prism arrangements 300, 400, 415, 430, 440, 450, 500 having additional electrostatic mirror prisms 150, an ion detector 120 is placed at the last such TOF focus, which provides the same functionality as the third TOF focus 215. In addition, for the various cascaded electrostatic mirror prism arrangements 300, 400, 415, 430, 440, 450, 500, in which a plurality of pairs of electrostatic mirror prisms 150 are utilized: (1) there will be a corresponding plurality of second or secondary ion beams in between the two electrostatic mirror prisms 150 forming the pair, each of which has ions which are spatially-dispersed or spread according to their respective kinetic energies, which are referred to herein as "intermediate" ion beams; (2) there will be a corresponding plurality of second (or secondary) TOF focuses (or focal planes), each in between the two electrostatic mirror prisms 150 forming the pair, which are referred to herein as "intermediate" TOF focuses or focal planes, and a bandpass filter 140 may be placed at any of these intermediate TOF focuses; (3) a third or tertiary ion beam 230 provided by the second electrostatic mirror prism 150 of a pair will be an incoming, first or primary ion beam 220 to the first electrostatic mirror prisms 150 of the next pair, and may be referred to herein as a combined output-input beam; and (4) a third TOF focus 215 provided by the second electrostatic mirror prism 150 of a pair will be an incoming, first or initial TOF focus 205 to the first electrostatic mirror prisms 150 of the next pair, and may be referred to herein as a combined output-input focus.

Referring to FIGS. 5A and 5B, cross-sections of the first, second and third ion beams 220, 225, 230 are illustrated, from regions 175, 180, and 185 of FIG. 4. As illustrated in FIG. 5A, the first and third ion beams 220, 230 are generally collimated beams, having generally circular cross-sections, with any spatial information of the first or primary ion beam 220 preserved or maintained in the third or tertiary ion beam 230. As illustrated in FIG. 5B, in contrast, the ions forming the second or secondary ion beam 225 has been spatially-dispersed or spread according to their respective kinetic energies, with: (1) those ions having higher energies having entered deeper into and remained a longer period of time within the first electrostatic mirror prism 150$_1$, exiting as kinetic energy band 245 of the second or secondary ion beam 225; (2) those ions having lesser energies having entered less deeply into and remained a shorter period of time within the first electrostatic mirror prism 150$_1$, exiting as kinetic energy band 240 of the second or secondary ion beam 225; and (3) those ions having even lower or the least energies having entered less or least deeply into and remained a shorter or least period of time within the first electrostatic mirror prism 150$_1$, exiting as kinetic energy band 235 of the second or secondary ion beam 225. In the various Figures, the second or secondary ion beam 225 has been illustrated as having three spatially-dispersed energy bands 235, 240, 245 for ease of explanation only, and those having skill in the art will recognize that the second or secondary ion beam 225 comprises a continuous spectrum of kinetic energies. Any specific separation of the second or secondary ion beam 225 into individuated kinetic energy bands 235, 240, 245 (or more kinetic energy bands) may be user selectable and determined using the bandpass filter system 140.

It is important to note that the two electrostatic mirror prisms 150 forming the pair, and the trajectories of ions passing from the first, input TOF focus 205 through the second (intermediate) TOF focus 210 to the third, output TOF focus 215 are generally in the same plane in order to enable the cancellation of chromatic aberrations. The spatial dispersion of ions with different energies, in the second or secondary ion beam 225, in the region between the electrostatic mirror prisms 150 occurs in the same plane called an "energy dispersion plane", illustrated in cross-section in FIG. 5B.

In accordance with the representative embodiments, the second (or intermediate) TOF focus 210 provides a desired location to arrange or install a bandpass filter 140, e.g., having an energy bandpass control slit (aperture or opening) 255 (which may be adjustable) as illustrated in FIG. 8, to cut off ions with undesired energies and thus suppress "tails" of TOF mass spectral peaks and filter out low energy ions formed due to fragmentation or multiple scattering along the ion flight path. For such bandpass energy filtering, in a representative embodiment and as illustrated in FIGS. 8A and 8B, the energy bandpass control slit 255 has an adjustable and/or moveable width (e.g., using first and second moveable plates 142, and also may have a moveable position, both of which may be adjusted manually (such as using a micrometer), or automatically by a vacuum or a motor 144 (such as a servomotor), to control the slit 255 width and position of the bandpass filter 140), such as under the control of the processor 130 and configurable within the bandpass filter 140, e.g., to increase or decrease the width 146 of the energy bandpass control slit 255 and/or to move the filter 140, and correspondingly select more or less of the second or secondary ion beam 225. In a representative embodiment, the moveable plates 142 are utilized, each comprised of solid molybdenum functioning as "knife edges". They are mounted as illustrated in FIG. 8A, and each are controlled through a separate vacuum linear motion feedthrough equipped with a micrometer for precise positioning. These moveable plates 142 form a slit 255 whose width and position can be precisely adjusted, as follows: (1) moving the moveable plates 142 apart opens the slit 255 and vice-versa, while (2) moving the moveable plates 142 in the same direction translates its position at the intermediate TOF focus 210 with respect to the ion beam, such as for selecting one or more of the kinetic energy bands 235, 240, 245 or parts thereof, with or without extending the width of the slit 255.

As a result, using a bandpass filter 140 (having an energy bandpass control slit 255 with adjustable width 146, and also possibly moveable, depending upon the selected embodiment) permits selecting an optimally narrow or wider range of ion energies, such as selecting one or more of the kinetic energy bands 235, 240, 245 or parts thereof. This serves to improve the signal-to-noise ratio and the effective mass resolution of the representative TOF mass analyzer 100, 100A apparatus and TOF-MS system 200, 200 embodiments. Various examples are illustrated and discussed in greater detail below.

Figure 21:
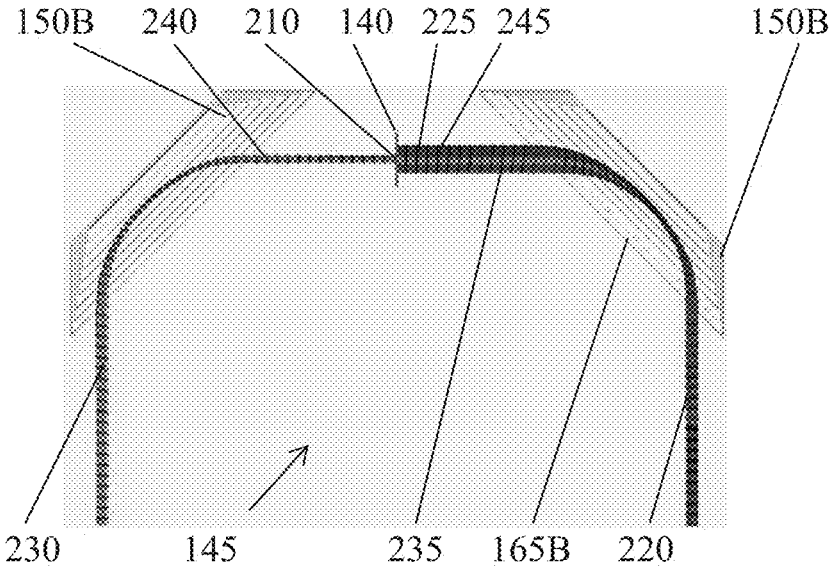
FIG. 21 is a cross-sectional diagram illustrating representative bandpass energy filtering of the second or secondary ion beam for representative TOF mass analyzer apparatus embodiments and representative TOF system embodiments.
Figure 29:
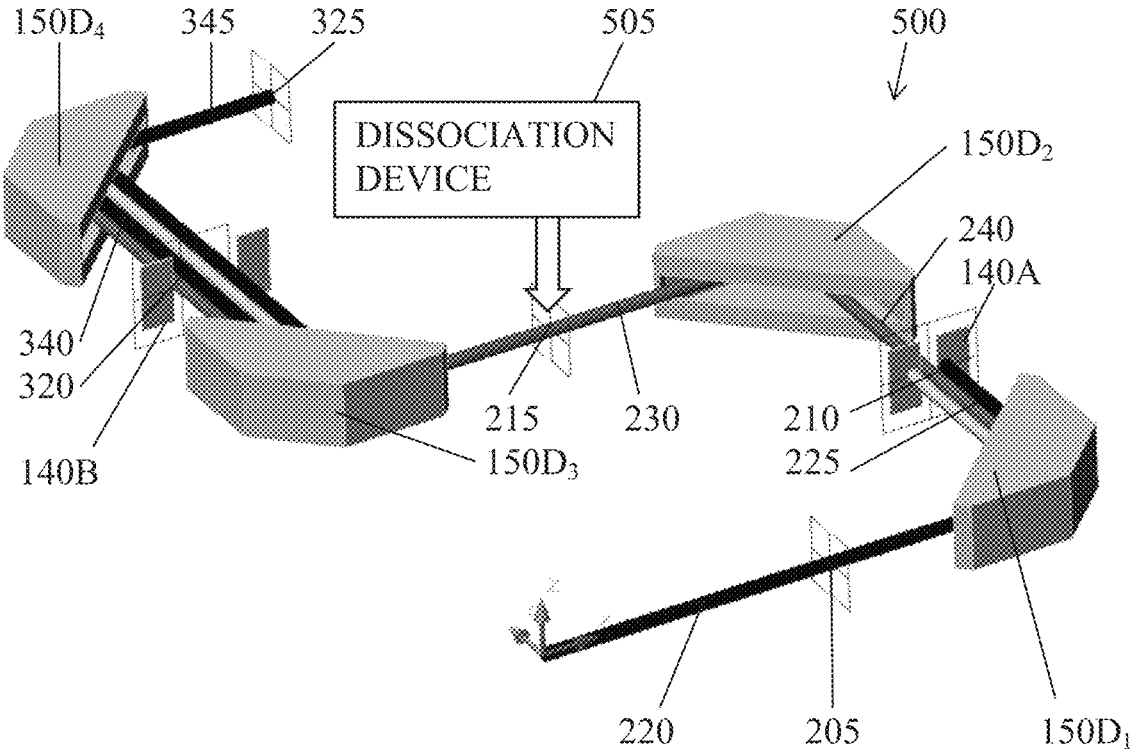
FIG. 29 is an isometric diagram illustrating a representative tenth electrostatic mirror prism arrangement having representative electrostatic mirror prisms in representative electrostatic mirror prisms having a fifth cascaded and tandem arrangement or configuration for a representative TOF mass analyzer apparatus embodiment and a representative TOF-MS system embodiment.

For example, representative bandpass energy filtering of the second or secondary ion beam 225 for representative TOF mass analyzer 100, 100A apparatus embodiments is illustrated in FIG. 21, in which the ions having the highest and lowest kinetic energizes are filtered out, and only the ions having the more intermediate kinetic energies (in band 240) pass through the bandpass filter 140. Also for example, representative bandpass energy filtering of the second or intermediate ion beams 225, 340 for representative TOF mass analyzer 100, 100A apparatus embodiments is illustrated in FIG. 29, in which the ions having the highest and lowest kinetic energizes are filtered out first, and only the ions having the more intermediate kinetic energies (in band 240) pass through a first bandpass filter 140A, while all ions of different energies of intermediate ion beam 340 are allowed to pass using a second bandpass filter 140B having a wider aperture or slit width, as illustrated.

In operation, the ions penetrate into the retarding electric field region of the electrostatic mirror prisms 150, being decelerated until about half of their initial energy at the deepest point and then accelerating back to the same energy at the exit point. The trajectory of ions in the retarding field resembles a quarter of a circle, for some electrostatic mirror prisms 150 (and depending upon their configurations and applied voltages), for example, whose radius depends on dimensions of the electrostatic mirror prisms 150 and potentials applied to its electrodes 155, 160, 165. The dimensional and electrical configuration of the section between the middle electrode (grid) 160 and the back electrode (plate) 155 may be important. For the same dimensions and potential distributions, ions with different energies will have different turn radii but, importantly, the same turn angle of 90°. Several important consequences of this are:

(1) The trajectory length will depend on the kinetic energy of ions in the ion beams: it is shorter for lower energies (because of their smaller turn radius) and longer for higher energies (because of their larger turn radius).

(2) Ions with different energies entering the first electrostatic mirror prism 150$_1$ at the same point (260) as a single beam (first or primary ion beam 220) will become spatially-dispersed and have different exit points (265, 270, 275), flying as parallel beams or bands within the second or secondary ion beam 225, as illustrated. The lateral dispersion of these beams may depend on ion energy and spatial separation between the middle electrode (grid) 160 and the back electrode (plate) 155.

(3) Ions with different energies entering the second electrostatic mirror prism 150$_2$, from the spatially-dispersed second or secondary ion beam 225, will enter the second electrostatic mirror prism 150$_2$ at different points (280, 285, 290), with the portion (band 245) of the second or secondary ion beam 225 having the highest kinetic energies entering first (point 280) and with the portion (band 235) of the second or secondary ion beam 225 having the lowest kinetic energies entering last (point 290), and will become recombined and/or converged back to a single beam, as the third or tertiary ion beam 230 having the same exit point 295, flying as a single beam or band (without kinetic energy spatial dispersion) within the third or tertiary ion beam 230, as illustrated.

If a collimated beam of ions with different kinetic energies originates from a plane corresponding to the first or initial TOF focus 205 (e.g., zero time) and perpendicular to its motion towards the first electrostatic mirror prism $\mathbf{150}_1$, then, after passing through the first electrostatic mirror prism $\mathbf{150}_1$ with the higher kinetic energy ions having higher velocities but spending more time in the first electrostatic mirror prism $\mathbf{150}_1$ and the lower kinetic energy ions having lower velocities but exiting the first electrostatic mirror prism $\mathbf{150}_1$ earlier (sooner), these ions flying as parallel beams will create, at a certain time and distance, a second or secondary TOF focus 210, i.e., a plane perpendicular to their motion out of the first electrostatic mirror prism $\mathbf{150}_1$, which they will cross at (about) the same time. For the electrostatic mirror prism arrangement 145 (using RAIMPs), the first or initial TOF focus (or plane) 205 and the secondary TOF focus (or plane) 210 will be orthogonal to each other. The position of the second or secondary TOF focus 210 will depend on (median) ion beam energy and may be controlled by choosing appropriate dimensions and potential distributions for the first electrostatic mirror prism $\mathbf{150}_1$. With the same fixed potentials, the larger these dimensions of the first electrostatic mirror prism $\mathbf{150}_1$, then the second or secondary TOF focus 210 should be a greater distance away from the first electrostatic mirror prism $\mathbf{150}_1$. With the same fixed dimensions, smaller adjustments of the position of the second or secondary TOF focus 210 may be done by varying the potentials of the middle electrode 160 and the back electrode (plate) 155.

It should be noted that the apparatus 100, 100A and the system 200, 200A can also work with imperfectly collimated (i.e. slightly diverging or converging) input or incoming ion beams. In such a case, the more divergent the input or incoming ion beam is, the more astigmatism will be seen in the ion imaging capability. This astigmatism, however, does not cancel the TOF focusing capability, which is only just slightly deteriotated. As a result, the apparatus 100, 100A and the system 200, 200A are applicable to both perfectly collimated (parallel) and imperfectly (slightly diverging or converging) ion beams.

This differs significantly from sector field analyzers in that sector field analyzers are based on some kind of a capacitor design (cylindrical, spherical, toroidal etc.), and the voltages applied to opposite electrode plates of the capacitor are symmetric with respect to ground potential. Therefore, ions passing through sector field analyzers along the central trajectory do not experience significant deceleration and acceleration, with only minor contribution of these processes for trajectories slightly off central. Thus almost no flight time is spent for deceleration/acceleration, and it is mostly the difference in trajectory lengths, which drives the TOF focusing by sector field analyzers.

It should also be noted that each pair of electrostatic mirror prisms 150 for the representative electrostatic mirror prism arrangements 145, 300, 400, 405, 410, 415, 430, 440, 450, 500, such as the first and second electrostatic mirror prisms $\mathbf{150}_1$, and $\mathbf{150}_2$, are arranged symmetrically, having a symmetry plane 305 orthogonal to the trajectories of the ions of the second or secondary ion beam 225 and located in the region of the second or secondary (or intermediate) TOF focus 210, as illustrated in FIG. 4. If this symmetry plane 305 passes precisely through the second or intermediate TOF focus 210, then the location of the third, output TOF focus 215 will be symmetrical to and mirror the location of the first, input TOF focus 205. If the symmetry plane 305 is shifted away from the second TOF focus 210, then the third, output TOF focus 215 will be correspondingly shifted from the mirror location of the first, input TOF focus 205.

Because the second electrostatic mirror prism $\mathbf{150}_2$ is located opposite the first electrostatic mirror prism $\mathbf{150}_1$ on the other side of this symmetry plane 305, spatially dispersed parallel ion beams with different kinetic energies in the second or secondary ion beam 225 enter the second electrostatic mirror prism $\mathbf{150}_2$ with same spatial dispersion of kinetic energies. Due to interactions of the ions with the retarding electric field of this second electrostatic mirror prism $\mathbf{150}_2$, the spatial dispersion is cancelled after the pass through the second electrostatic mirror prism $\mathbf{150}_2$. This is also illustrated in FIG. 7, in contrast with the additional spatial dispersion created when the first and second electrostatic mirror prisms $\mathbf{150}_1$ and $\mathbf{150}_2$ are arranged or configured to reflect the first or primary ion beam 220 in a typical prior art zig-zag configuration.

As illustrated in FIG. 7, using the symmetry discussed above, the second electrostatic mirror prism $\mathbf{150}_{2A}$ generates a third or tertiary ion beam $\mathbf{230}_A$ in which the ions having different kinetic energies are no longer spatially dispersed but are recombined and/or converged in a collimated beam, illustrated using dotted lines. For this to occur, the predetermined angular offset $\phi$ should be greater than zero degrees and less than one hundred eighty degrees (i.e., $0° < \phi < 180°$). While the predetermined angular offset $\phi$ can be more than ninety degrees, in practice, it may be limited by the ability of ions to penetrate into the retarding field regions, so that an achievable upper limit is more likely to be in the range of approximately 135 degrees. While the predetermined angular offset $\phi$ can be less than ninety degrees, in practice, it also may be limited due to correspondingly lessened prismatic capability, so that in practice an achievable lower limit is more likely to be in the range of approximately 45 degrees, for example and without limitation. Again, the maximal prismatic functionality is achieved at ninety degrees, because at that predetermined angular offset $\phi$, the spatial dispersion of ions with different kinetic energies is the largest. It should be noted that for any reference to the angular offsets, those having skill in the art will recognize that there may be fabrication tolerances, so that any reference to a specific number of degrees will be understood to mean and include such tolerances, generally in the range of about 1°-5°, such as a reference to 90° will mean and include 90°±5°, for example and without limitation.

In contrast to the TOF analyzer 100, 100A, a zig-zag multi-reflection configuration of the prior art has a point of rotational symmetry 152 located on the central ion trajectory in the middle between two opposite electrostatic mirrors, where the positional arrangement of the second electrostatic mirror $\mathbf{150}_{2B}$ can be obtained by lateral displacement of the second electrostatic mirror prism $\mathbf{150}_{2B}$ without rotation, or equivalently by rotating the first one ($\mathbf{150}_1$) around this point of rotational symmetry 152 by 180°, as illustrated in FIG. 7. In this case, the second electrostatic mirror prism $\mathbf{150}_{2B}$ generates a diverging third or tertiary ion beam 230B which has even greater, amplified spatial dispersion of ions with different kinetic energies compared to the second or secondary ion beam 225. With this amplified spatial dispersion of ions of a zig-zag configuration, there is no third or output TOF focus, and stigmatic imaging is not possible. Thus, replacing the rotational symmetry of the "zig-zag" configuration by the planar symmetry of the TOF mass analyzer 100 configuration yields one of the fundamental advantages of the TOF mass analyzer 100, 100A, namely, the recombination of spatially dispersed beams with different kinetic energies into a single ion beam containing ions of all energies that come into a new (third or output) TOF focus 215, while preserving spatial information.

Figure 9:
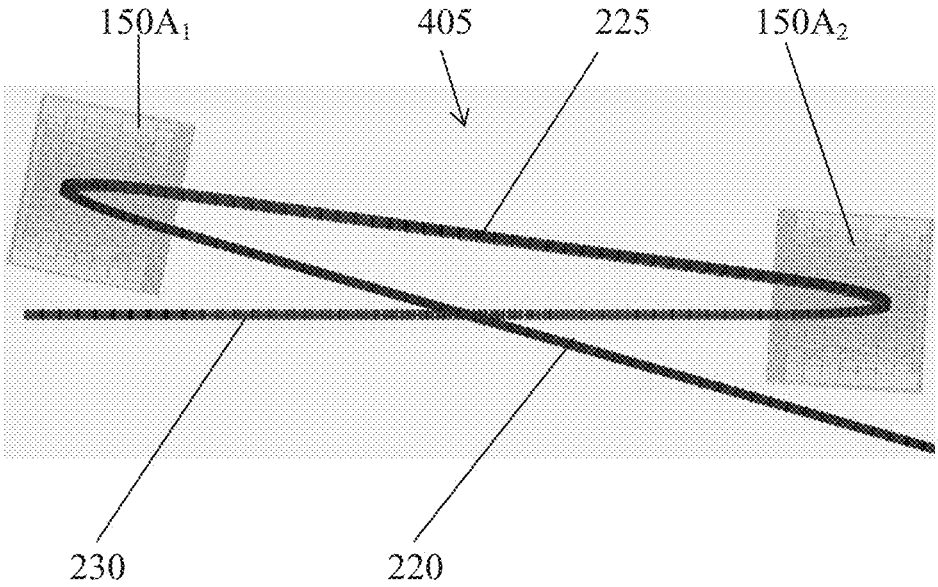
FIG. 9 is a cross-sectional, schematic plan view diagram illustrating a representative second electrostatic mirror prism arrangement having a representative primary ion beam, a representative spatially-dispersed secondary ion beam, with corresponding angular offsets of representative electrostatic mirror prisms, to generate a recombined and/or convergent tertiary ion beam, for a representative TOF mass analyzer apparatus embodiment and a representative TOF-MS system embodiment.
Figure 10:
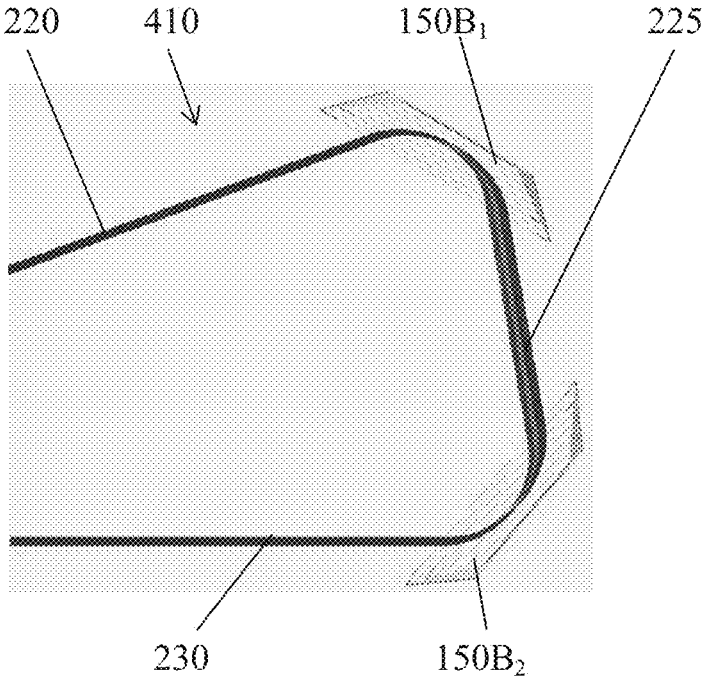
FIG. 10 is a cross-sectional, schematic plan view diagram illustrating a representative third electrostatic mirror prism arrangement having a representative primary ion beam, a representative spatially-dispersed secondary ion beam, with corresponding angular offsets of representative electrostatic mirror prisms, to generate a recombined and/or convergent tertiary ion beam, for a representative TOF mass analyzer apparatus embodiment and a representative TOF-MS system embodiment.
Figure 11:
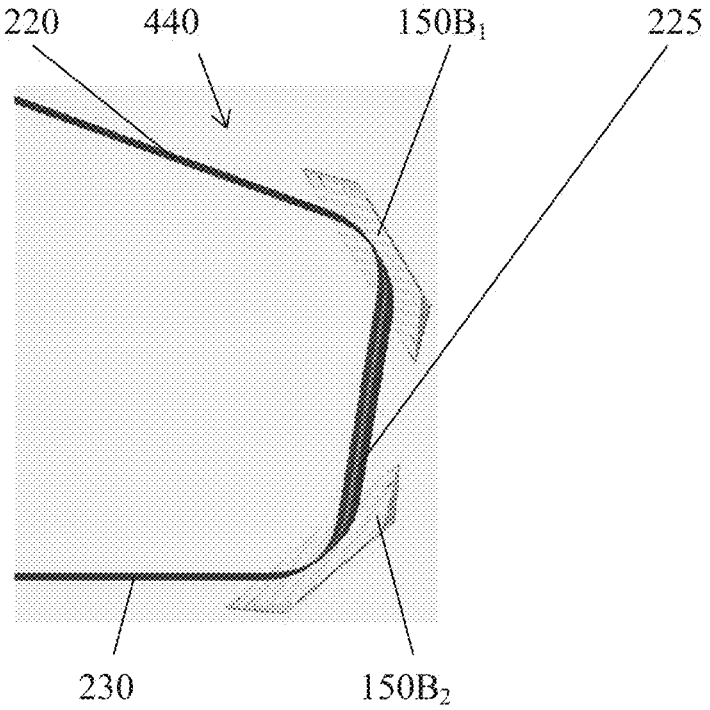
FIG. 11 is a cross-sectional, schematic plan view diagram illustrating a representative fourth electrostatic mirror prism arrangement having a representative primary ion beam, a representative spatially-dispersed secondary ion beam, with corresponding angular offsets of representative electrostatic mirror prisms, to generate a recombined and/or convergent tertiary ion beam, for a representative TOF mass analyzer apparatus embodiment and a representative TOF-MS system embodiment.

Additional symmetrical, representative second, third and fourth electrostatic mirror prism arrangements 405, 410, 440, respectively, of first and second electrostatic mirror prisms $\mathbf{150}_1$, $\mathbf{150}_2$, for a representative TOF mass analyzer 100, 100A apparatus embodiment and a representative TOF system 200, 200A apparatus embodiment, are illustrated as examples in FIGS. 9-11, which are cross-sectional, schematic plan view diagrams illustrating a representative first or primary ion beam 220, a representative spatially-dispersed second or secondary ion beam 225, with corresponding angular offsets $\phi$ of representative electrostatic mirror prisms 150 having cylindrical shapes in FIG. 9 and trapezoidal shapes in FIGS. 10 and 11, to generate a recombined and/or convergent third or tertiary ion beam 230.

It should be noted that FIGS. 9, 10, 11, 21, 22A, 22B and 22C include ion beam trajectories (ray tracing) which were obtained using the industry standard software for mass spectrometry developers, known as SIMION 8.1 ion optics modeling software.

A representative "bow-tie" second electrostatic mirror prism arrangement 405 is illustrated in FIG. 9, with a comparatively small predetermined angular offset $\phi$(providing comparatively minimal prismatic functionality), while FIGS. 10 and 11 illustrate larger predetermined angular offsets $\phi$, with FIG. 10 illustrating an angular offset $\phi$ of less than 90° (e.g., about 80°) for a representative third electrostatic mirror prism arrangement 410, and with FIG. 11 illustrating an angular offset $\phi$ of more than 90° (i.e., $90° < \phi < 180°$ (e.g., about 100°), for a representative fourth electrostatic mirror prism arrangement 440. Changing the predetermined angular offsets $\phi$, or equivalently, the angles between the input (first) and output (third) ion beams 220, 230 for each mirror can lead to unfolding the "bow-tie" and fully untying it after 90°. Any of these configurations may be utilized equivalently in a TOF mass analyzer 100, 100A, in addition to the angular offset $\phi$ of 90° discussed above, when the prismatic functionality of the electrostatic mirror prism is maximal. It is important that the "bow-tie" configuration in FIG. 9 can be operated with most known electrostatic mirror designs, such as reflectrons, and as such can serve as a multi-reflection arrangement of reflectrons as an alternative to "zig-zag". The fundamental advantage of "bow-tie" over "zig-zag" is the ability to recombine beams with different kinetic energies spatially dispersed after the first reflection into a single ion beam containing ions of all energies coming after the second reflection into a new (third or output) TOF focus 215.

FIGS. 9-11 also illustrate the additional, available angles of incidence and reflection of the various ion beams (measured from normal to the front electrode plane) within a representative TOF mass analyzer 100, 100A apparatus embodiment, which may correlate (depending on the electric fields) with the predetermined angular offsets $\phi$, as illustrated, in addition to the 45° angles discussed above. Stated another way, depending upon the selected angle of incidence of the incoming first or primary ion beam 220 and the electric field within the first electrostatic mirror prism $\mathbf{150}_1$, the second electrostatic mirror prism $\mathbf{150}_2$ will need to be arranged or positioned with a corresponding predetermined angular offset $\phi$ in order to receive the reflected, second or secondary (or intermediate) ion beam 225.

Increasing these angles allows using lower electric potentials on electrodes of the electrostatic mirror prisms 150 while preserving their reflective/retarding functionality. As such angles approach 90°, it may be more convenient to change the shape of the electrostatic mirror prisms 150 from a deep cylinder (whose height is larger than diameter, FIG. 9) to a more shallow cylinder (whose diameter is larger than height (FIG. 13), or, alternatively, to elongate the front cross-section of the electrostatic mirror prism 150 (i.e. plane parallel to its electrodes) and change its shape from round to oval/elliptical or rectangular (e.g., FIGS. 10, 11, 12, 14-18). Importantly, increasing these predetermined angular offset angles $\phi$ does not remove the effect of recombination of the spatially dispersed second or secondary ion beam 225 into the single output third or tertiary ion beam 230. The spatial dispersion of ions with different kinetic energies in the second or secondary ion beam 225 is maximized at angles near 90°, energy dispersive (prismatic) functionality of the electrostatic mirror prisms 150 is also maximized at such angles. These symmetric configurations for a pair of electrostatic mirror prisms 150 also enables stigmatic lateral imaging in combination with TOF focusing and energy filtering, as discussed in greater detail below.

In the case of "bow-tie" multi-reflectron configuration, the prismatic properties of the reflectrons are minimal because the entrance/exit angle is small. While there is still spatial dispersion of ions due to their kinetic energy spread, it is comparatively insignificant if just one reflection occurs, and it gets "amplified" by multiple reflections.

Figure 12:
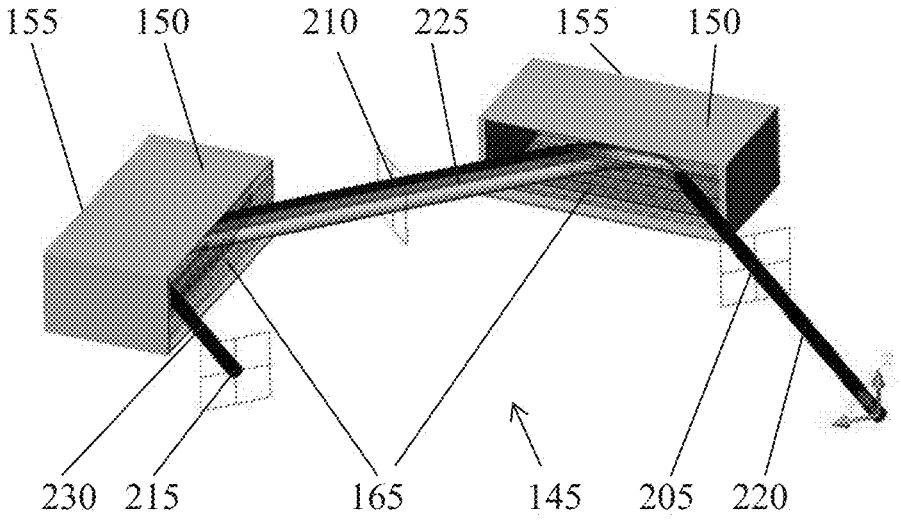
FIG. 12 is an isometric diagram illustrating the representative first embodiments of electrostatic mirror prisms having the representative first electrostatic mirror prism arrangement for a representative TOF mass analyzer apparatus embodiment and a representative TOF-MS system embodiment.
Figure 13:
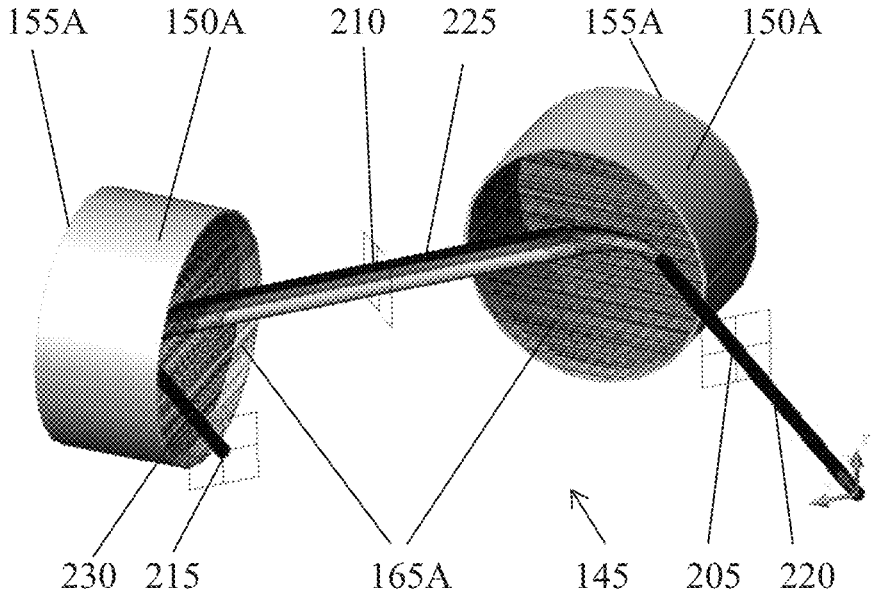
FIG. 13 is an isometric diagram illustrating representative second embodiments of electrostatic mirror prisms having the representative first electrostatic mirror prism arrangement for a representative TOF mass analyzer apparatus embodiment and a representative TOF-MS system embodiment.

A variety of structures and configurations are also available for the electrostatic mirror prisms 150, and any and all such variations are within the scope of the disclosure. For example and without limitation, the electrostatic mirror prisms 150 may have any number and placement of electrodes, may have grid electrodes, may have solid or planar electrodes, and may have various slits or openings in the electrodes. In addition, the electrostatic mirror prisms 150 may have any corresponding structure to achieve a desired configuration of the retarding electric field. FIG. 12 is an isometric diagram illustrating the representative first embodiments of rectangular (or rectangular box) electrostatic mirror prisms 150 having the first and second grid electrodes 165, 160 and a third, solid planar third or rear electrode 155, and having the representative first electrostatic mirror prism arrangement 145 for a representative TOF mass analyzer 100, 100A apparatus embodiment and a representative TOF system 200, 200A apparatus embodiment. FIG. 13 is an isometric diagram illustrating representative second embodiments of cylindrical electrostatic mirror prisms 150A, also having the first grid electrode 165A and a third, solid planar third or rear electrode 155A, with the second electrode 160 not illustrated separately in this view, and having the representative first electrostatic mirror prism arrangement 145 for a representative TOF mass analyzer 100, 100A apparatus embodiment and a representative TOF system 200, 200A apparatus embodiment. As illustrated in FIGS. 12 and 13, each grid electrode (165A, 165B) typically comprises a series of spaced-apart, parallel and comparatively thin wires or conductors, which have a corresponding applied voltage to provide the desired electric field, while also allowing the various ions to pass through the grid electrode and move deeper into the electrostatic mirror prism 150.

Figure 14:
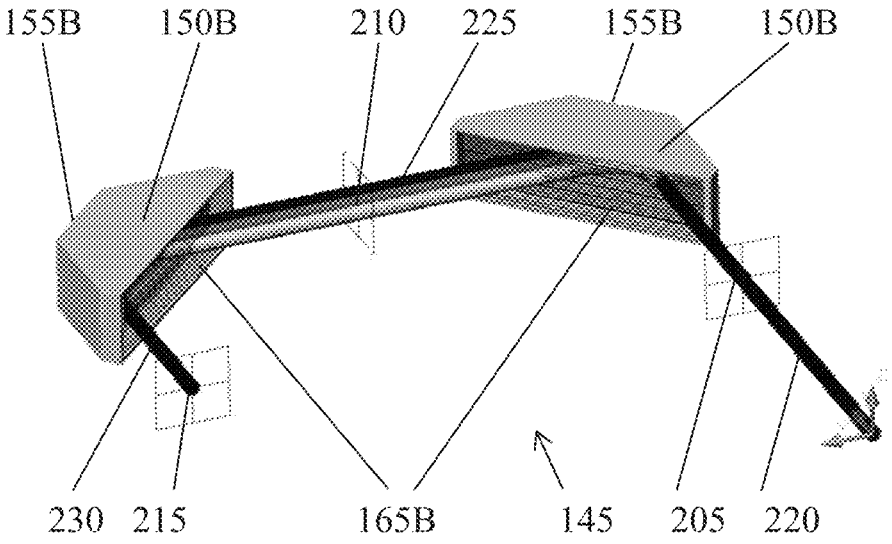
FIG. 14 is an isometric diagram illustrating representative third embodiments of electrostatic mirror prisms having the representative first electrostatic mirror prism arrangement for a representative TOF mass analyzer apparatus embodiment and a representative TOF-MS system embodiment.
Figure 15:
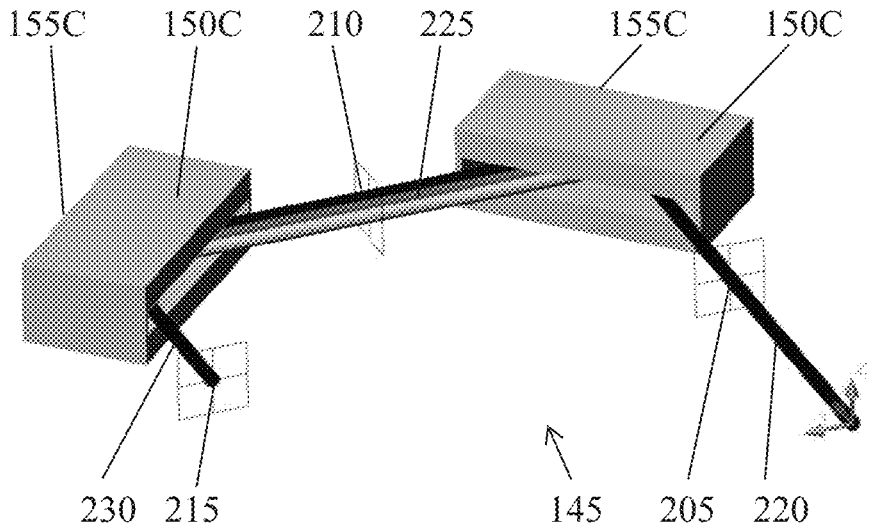
FIG. 15 is an isometric diagram illustrating representative fourth embodiments of electrostatic mirror prisms having the representative first electrostatic mirror prism arrangement for a representative TOF mass analyzer apparatus embodiment and a representative TOF-MS system embodiment.
Figure 16:
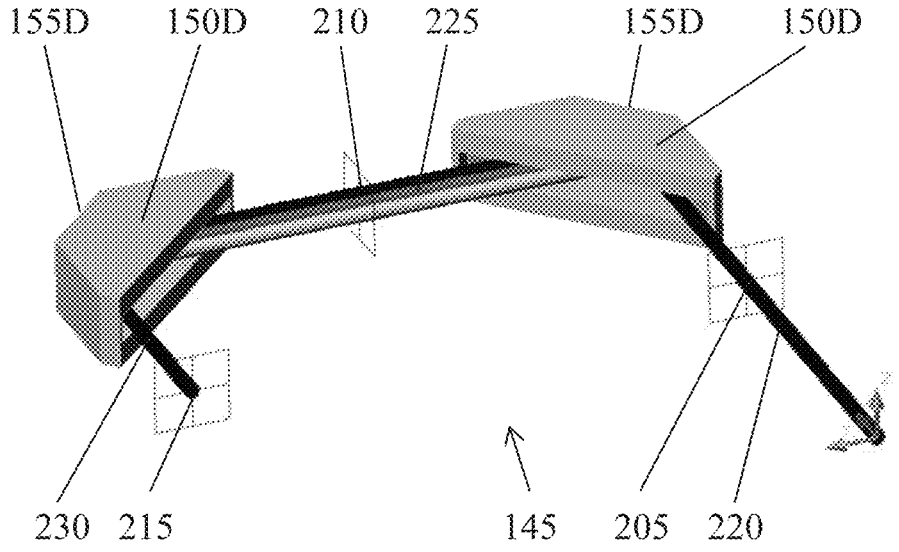
FIG. 16 is an isometric diagram illustrating representative fifth embodiments of electrostatic mirror prisms having the representative first electrostatic mirror prism arrangement for a representative TOF mass analyzer apparatus embodiment and a representative TOF-MS system embodiment.

FIG. 14 is an isometric diagram illustrating representative third embodiments of trapezoidal electrostatic mirror prisms 150B, also having the first grid electrode 165B and a third, solid planar third or rear electrode 155B, with the second electrode 160 not illustrated separately in this view, and having the representative first electrostatic mirror prism arrangement 145 for a representative TOF mass analyzer 100, 100A apparatus embodiment and a representative TOF system 200, 200A apparatus embodiment. FIG. 15 is an isometric diagram illustrating representative fourth embodiments of gridless rectangular electrostatic mirror prisms 150C, and having the representative first electrostatic mirror prism arrangement 145 for a representative TOF mass analyzer 100, 100A apparatus embodiment and a representative TOF system 200, 200A apparatus embodiment. FIG. 16 is an isometric diagram illustrating representative fifth embodiments of gridless, trapezoidal electrostatic mirror prisms 150D, and having the representative first electrostatic mirror prism arrangement 145 for a representative TOF mass analyzer 100, 100A apparatus embodiment and a representative TOF system 200, 200A apparatus embodiment.

Figure 17:
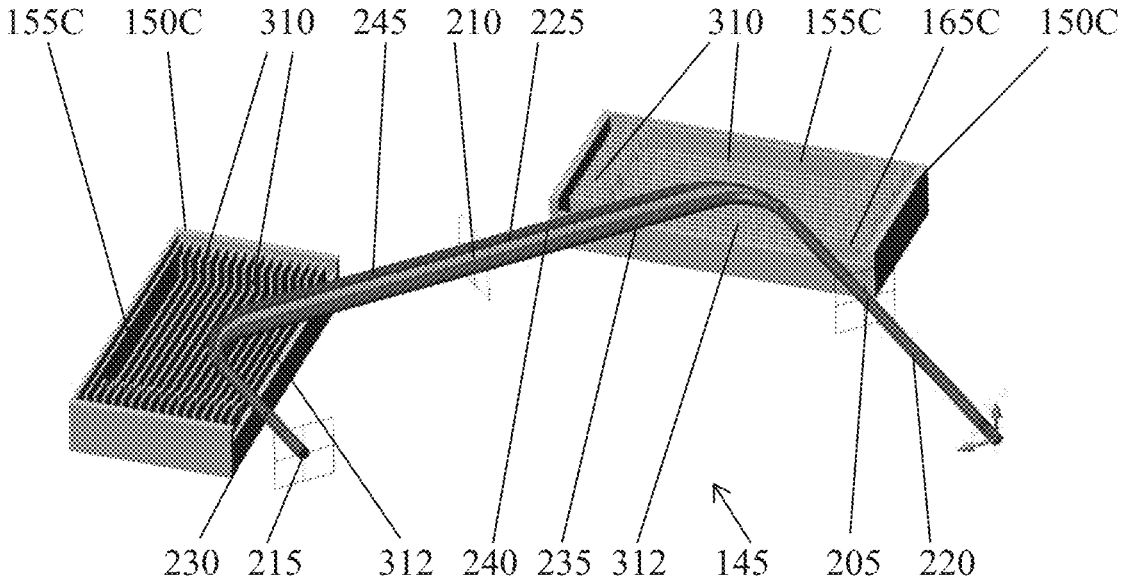
FIG. 17 is an isometric, cross-sectional diagram illustrating representative fourth embodiments of electrostatic mirror prisms having the representative first electrostatic mirror prism arrangement for a representative TOF mass analyzer apparatus embodiment and a representative TOF-MS system embodiment.
Figure 18:
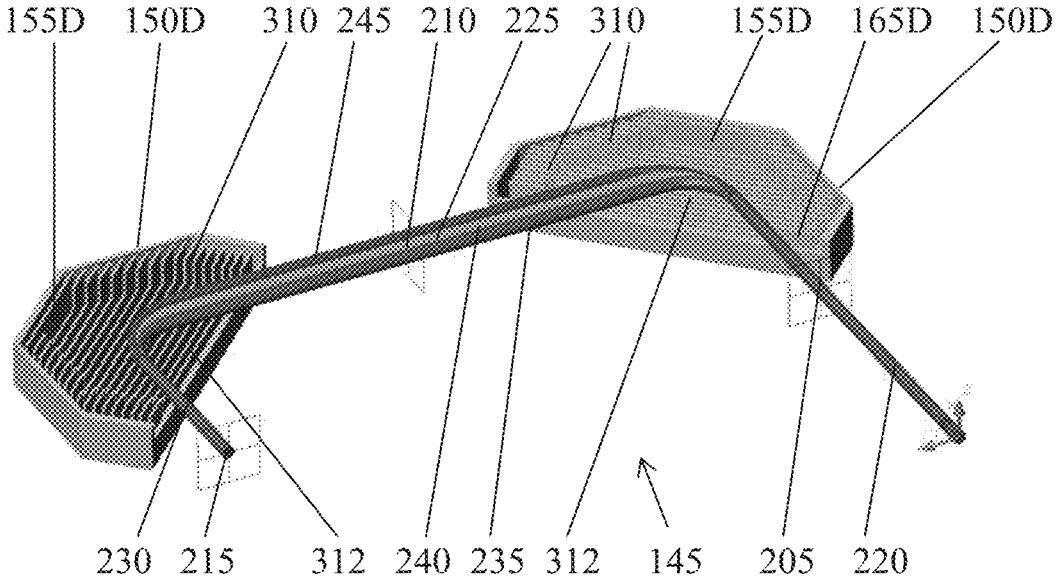
FIG. 18 is an isometric, cross-sectional diagram illustrating representative fifth embodiments of electrostatic mirror prisms having the representative first electrostatic mirror prism arrangement for a representative TOF mass analyzer apparatus embodiment and a representative TOF-MS system embodiment.

FIG. 17 is an isometric, cross-sectional diagram illustrating representative fourth embodiments of gridless, rectangular electrostatic mirror prisms 150C, and having the representative first electrostatic mirror prism arrangement 145 for a representative TOF mass analyzer 100, 100A apparatus embodiment and a representative TOF system 200, 200A apparatus embodiment. FIG. 18 is an isometric, cross-sectional diagram illustrating representative fifth embodiments of gridless, trapezoidal electrostatic mirror prisms 150D, and having the representative first electrostatic mirror prism arrangement 145 for a representative TOF mass analyzer 100, 100A apparatus embodiment. As illustrated in FIGS. 17 and 18, for gridless configurations of electrostatic mirror prisms 150, such as electrostatic mirror prisms 150C and 150D, each electrode 310 (except the rear electrode 155) typically comprises a planar conductor having a centrally-located opening or slit 312, which also has a corresponding applied voltage to provide the desired electric field, while also allowing the various ions to pass through the opening or slit 312 of the electrode 310 and move deeper into the electrostatic mirror prism 150C and/or 150D.

Figure 19:
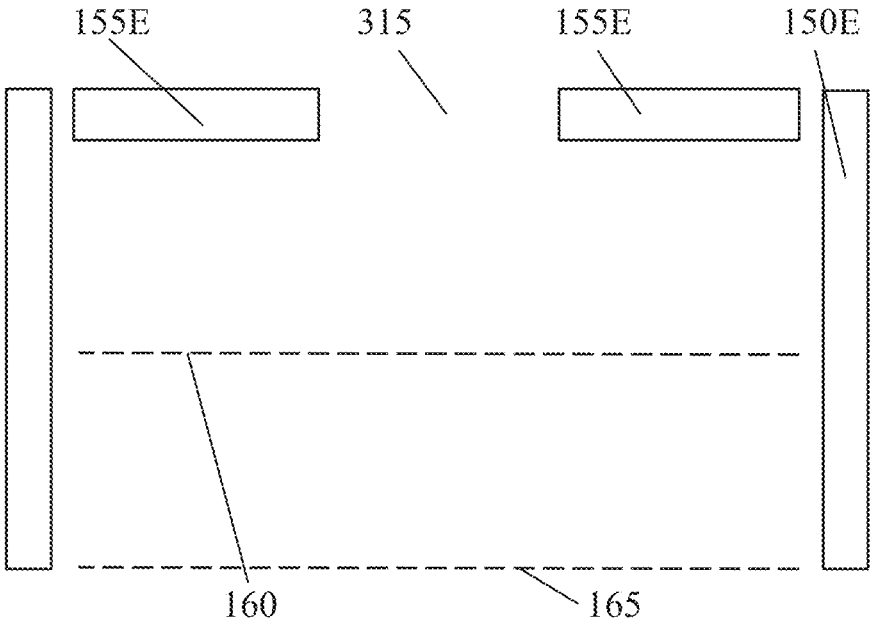
FIG. 19 is a cross-sectional diagram illustrating a representative sixth embodiment of an electrostatic mirror prism for use in various electrostatic mirror prism arrangements for representative TOF mass analyzer apparatus embodiments and representative TOF system embodiments.

FIG. 19 is a cross-sectional diagram illustrating a representative sixth embodiment of an electrostatic mirror prism 150E for use in any of the various electrostatic mirror prism arrangements for representative TOF mass analyzer 100, 100A apparatus embodiments and representative TOF system 200, 200A apparatus embodiments, and especially suitable for the eighth and ninth electrostatic mirror prism arrangements illustrated and discussed below with reference to FIGS. 27 and 28. The electrostatic mirror prism 150E differs from the electrostatic mirror prism 150 insofar as the third, rear electrode 155E is ion-transparent: the electrostatic mirror prism 150E has a slit or opening 315 in the third, rear electrode 155E, which and allows for the ion beam (e.g., second or secondary ion beam 225 or third or tertiary ion beam 230) to pass through the electrostatic mirror prism 150E without significant disturbance when the electrostatic mirror prism 150E is off and not electrostatically biased to deflect ions.

Figure 20:
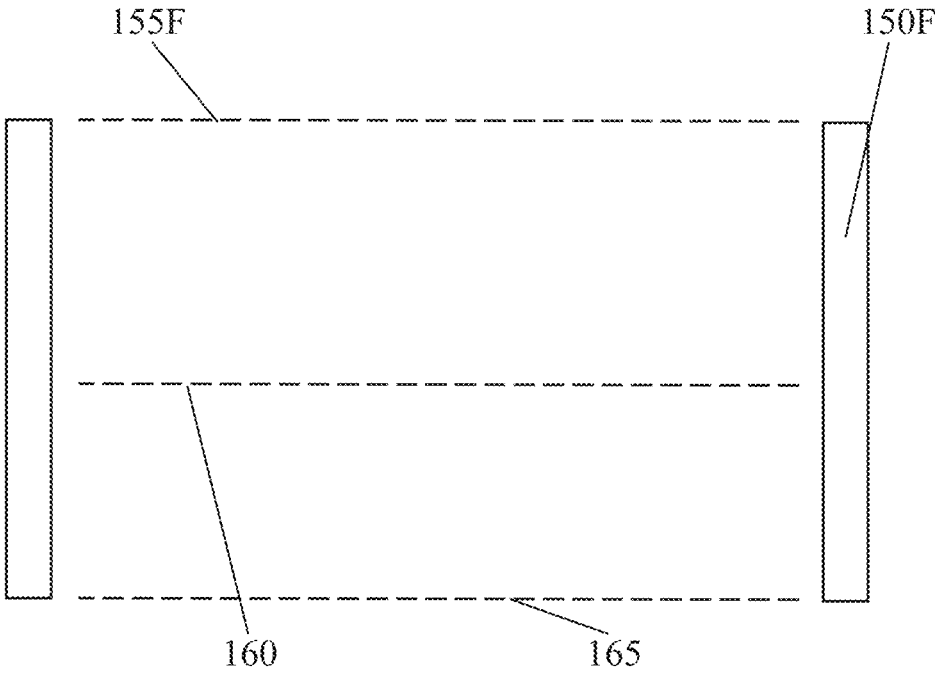
FIG. 20 is a cross-sectional diagram illustrating a representative seventh embodiment of an electrostatic mirror prism for use in various electrostatic mirror prism arrangements for a representative TOF mass analyzer apparatus embodiment and a representative TOF-MS system embodiment.

FIG. 20 is a cross-sectional diagram illustrating a representative seventh embodiment of an electrostatic mirror prism 150F for use in any of the various electrostatic mirror prism arrangements for representative TOF mass analyzer 100, 100A apparatus embodiments and representative TOF system 200, 200A apparatus embodiments, and especially suitable for the eighth and ninth electrostatic mirror prism arrangements illustrated and discussed below with reference to FIGS. 27 and 28. The electrostatic mirror prism 150F differs from the electrostatic mirror prism 150 insofar as the third, rear electrode 155F is ion-transparent: the electrostatic mirror prism 150F has a grid configuration of the third, rear electrode 155F, which also allows for the ion beam (e.g., second or secondary ion beam 225 or third or tertiary ion beam 230) to pass through the electrostatic mirror prism 150F without significant disturbance when the electrostatic mirror prism 150F is off and not electrostatically biased to deflect ions.

In addition, any of the gridless embodiments, such as electrostatic mirror prism 150C and electrostatic mirror prism 150D, also can use these arrangements with a rear ion-transparent electrode, such as either a grid electrode or a solid electrode with an opening 315.

It should also be noted that the dimensions of these electrostatic mirror prisms 150 depend both on the distance "D" separating them and on the kinetic energy of ions they reflect.

Figure 22A:
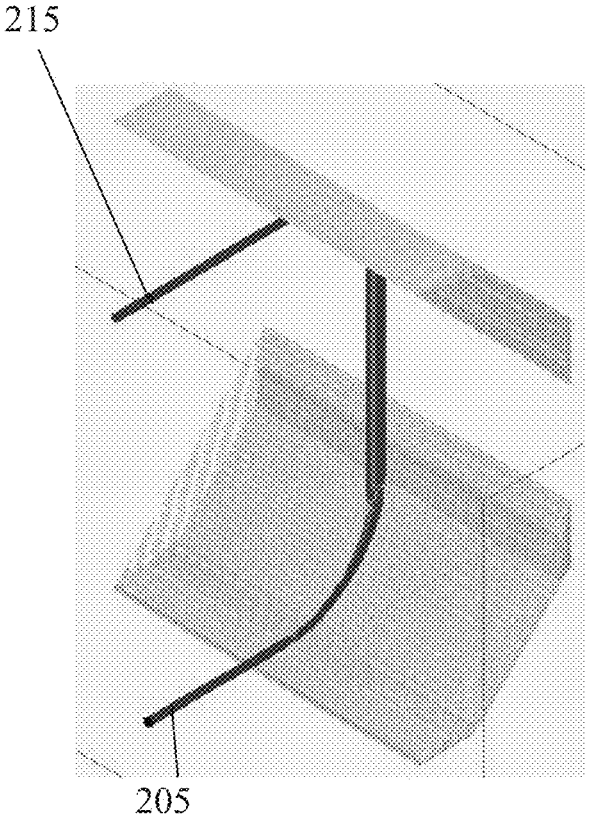
FIGS. 22A, 22B, 22C, and 22D are diagrams illustrating representative stigmatic imaging using electrostatic mirror prisms having the representative first electrostatic mirror prism arrangement for a representative TOF mass analyzer apparatus embodiment and a representative TOF-MS system embodiment.
Figure 22B:
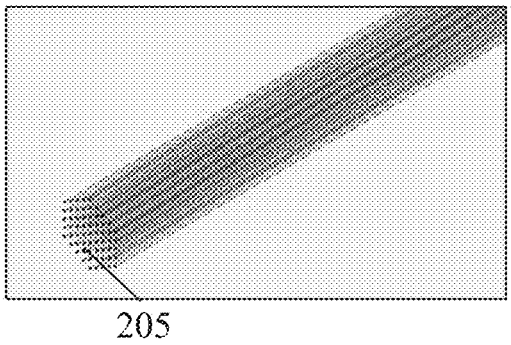
Figure 22C:
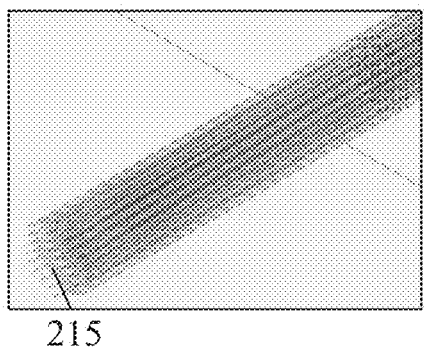
Figure 22D:
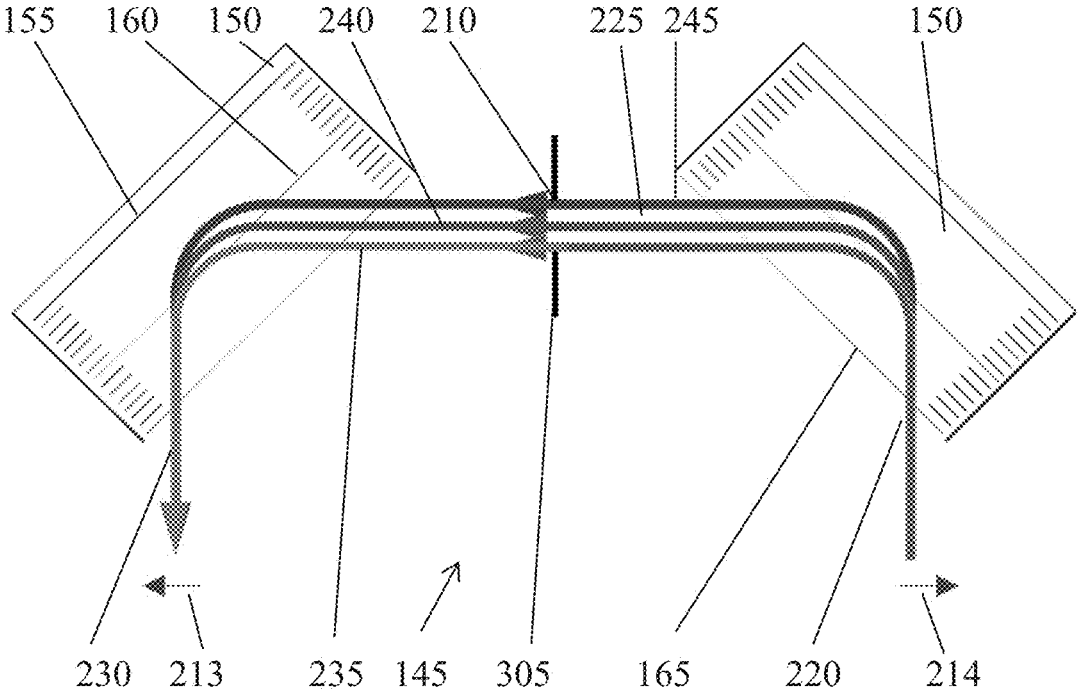

FIGS. 22A, 22B, 22C, and 22D are diagrams illustrating representative stigmatic imaging using electrostatic mirror prisms 150, and having the representative first electrostatic mirror prism arrangement 145 for a representative TOF mass analyzer 100, 100A apparatus embodiment and a representative TOF system 200, 200A apparatus embodiment, forming a novel imaging multi-reflecction TOF-MS analyzer 100, 100A, with FIG. 22B showing the ion image of a hexagonal honeycomb pattern from the first or initial TOF focus 205 and with FIG. 22C showing the image of the same honeycomb pattern formed in the third or tertiary TOF focus 215. As described above, a collimated beam of ions with different kinetic energies, as the first or primary ion beam 220, entering the first electrostatic mirror prism $\mathbf{150}_1$ may exit the first electrostatic mirror prism $\mathbf{150}_1$ having been dispersed or split into a set of parallel beams of ions having different kinetic energies, in second or secondary ion beam 225. When this second or secondary ion beam 225 is directed into a second electrostatic mirror prism $\mathbf{150}_2$ whose position and orientation is arranged as a mirror reflection of the first electrostatic mirror prism $\mathbf{150}_1$ across the second or secondary TOF focus (or plane) 210, such as in representative electrostatic mirror prism arrangement 145, then the ions may exit the second electrostatic mirror prism $\mathbf{150}_2$ as a single, collimated third or tertiary ion beam 230. This third or tertiary ion beam 230 may form a third or tertiary TOF focus plane 215 located at the same distance from the exit of the second electrostatic mirror prism $\mathbf{150}_2$ as that between the first or initial TOF focus 205 and the entrance to the first electrostatic mirror prism $\mathbf{150}_1$. Moreover, in the third or tertiary TOF focus plane 215, this third or tertiary ion beam 230 may have a structure of an inverted ion image of the first or initial TOF focus 205 (a hexagonal honeycomb pattern in the case of FIGS. 22B and 22C, which is symmetrically inverted or flipped over or with respect to the second or secondary TOF focus 210), as indicated in FIG. 22D by arrows 213, 214 pointed opposite to each other with respect to the second or secondary TOF focus 210 or symmetry plane 305).

The capability of the representative electrostatic mirror prism arrangement 145 to image the initial (input) TOF focus (or focal plane) 205 onto the third or tertiary (output) TOF focus (or focal plane) 215 may make it an excellent "building block" for assembly of stigmatically imaging for representative TOF mass analyzer 100 apparatus embodiments and representative TOF system 200 embodiments with ultra-high mass resolution and accuracy that are based on multiple-pass (multi-"ricochet") principles. To this end, multiple pairs of electrostatic mirror prisms 150 can be interfaced via these input and output TOF focuses 205, 215, as combined output-input focuses as discussed above, with the output TOF focus of every previous pair of electrostatic mirror prisms 150 serving as the input TOF focus for every next pair of electrostatic mirror prisms 150, thus creating cascade arrangements, with several examples discussed in greater detail below. Because rotating the ion image on such an interfacing (combined output-input) TOF focus plane around its center does affect TOF focusing and can be accounted for, the mutual orientation of the cascaded pairs of electrostatic mirror prisms 150 can be flexible. For example and without limitation, a coiled, stacked or other two- and three-dimensional space-saving geometry may be used to cascade pairs of electrostatic mirror prisms 150 and achieve large numbers of passes, increasing the time-of-flight "T" and improving mass resolving power "T/ΔT". The representative TOF mass analyzer 100 apparatus embodiments may also be compatible with orthogonal acceleration TOF-MS arrangements, such as the one exemplified in FIG. 1.

Figure 23:
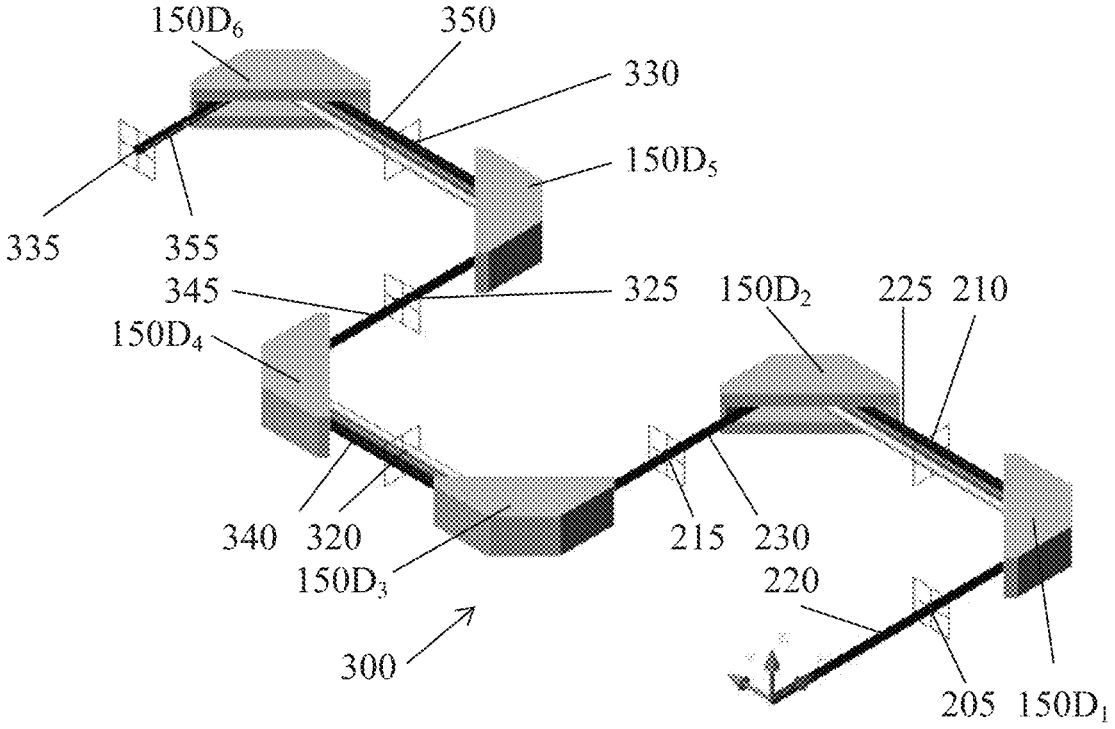
FIG. 23 is an isometric diagram illustrating a representative fifth electrostatic mirror prism arrangement having representative electrostatic mirror prisms in a first cascaded arrangement or configuration for a representative TOF mass analyzer apparatus embodiment and a representative TOF-MS system embodiment.
Figure 24:
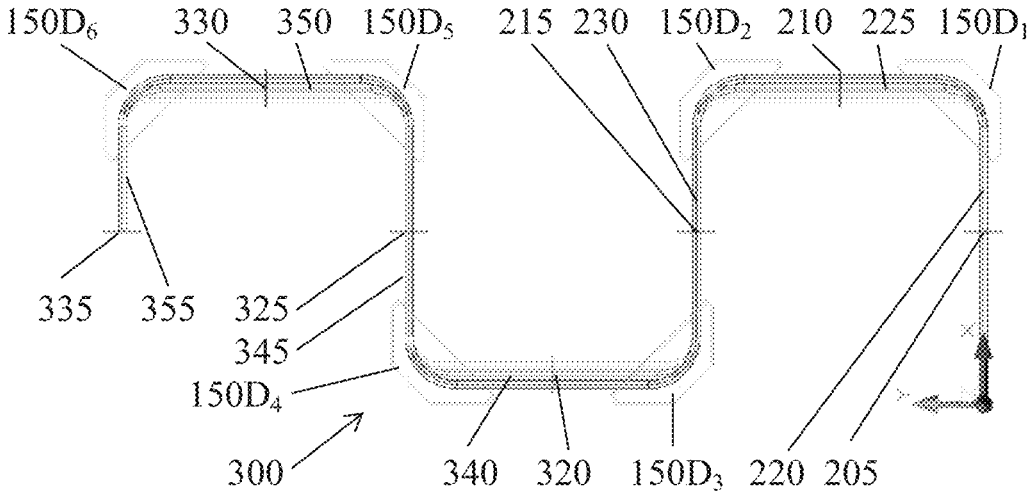
FIG. 24 is a cross-sectional diagram illustrating the representative fifth electrostatic mirror prism arrangement having representative electrostatic mirror prisms in the first cascaded arrangement or configuration for a representative TOF mass analyzer apparatus embodiment and a representative TOF-MS system embodiment of FIG. 23.

FIG. 23 is an isometric diagram illustrating a representative fifth electrostatic mirror prism arrangement 300 having representative electrostatic mirror prisms 150D in a first cascaded arrangement or configuration for a representative TOF mass analyzer 100 apparatus embodiment and a representative TOF system 200 embodiment. FIG. 24 is a cross-sectional diagram illustrating the representative fifth electrostatic mirror prism arrangement 300 having representative electrostatic mirror prisms 150D having the first cascaded arrangement or configuration for the representative TOF mass analyzer 100 apparatus embodiment and the representative TOF system 200 embodiment of FIG. 23. As mentioned above, the electrostatic mirror prisms 150 are arranged pair-wise, in groups of two electrostatic mirror prisms 150. As illustrated in FIGS. 23 and 24, six electrostatic mirror prisms 150D have been cascaded, i.e., arranged serially, with a first electrostatic mirror prism 150$D_1$ paired with a second electrostatic mirror prism 150$D_2$, with a third electrostatic mirror prism 150$D_3$ paired with a fourth electrostatic mirror prism 150$D_4$, and with a fifth first electrostatic mirror prism 150$D_5$ paired with a sixth electrostatic mirror prism 150$D_6$. The output TOF focus of one pair of electrostatic mirror prisms 150 becomes the input TOF focus of the next pair of electrostatic mirror prisms 150, as combined output-input focuses. It is important to recognize that all system 200, 200A embodiments with a TOF analyzer 100, 100A having electrostatic mirror prism arrangements and/or any of the electrostatic mirror prisms shown in FIGS. 12-20 are compatible with this cascaded arrangement, as well as with the arrangements shown below in FIGS. 25 and 26. As illustrated in FIGS. 23 and 24, there are seven TOF focuses 205, 210, 215, 320, 325, 330, and 335, and seven ion beams 220, 225, 230, 340, 345, 350, and 355, from which 225, 340 and 350 have ions which are dispersed in space due to prismatic properties of the electrostatic mirror prism arrangements, with beam cross-sections as show in FIG. 5B.

This representative fifth electrostatic mirror prism arrangement 300 is an example of multi-reflection (cascade) electrostatic mirror prism 150 TOF-MS design using three pairs of gridless electrostatic mirror prisms 150D. All three pairs of electrostatic mirror prisms 150 lie in the same "energy dispersion plane", and there are seven TOF focuses as mentioned above: the input focus 205 (from a pulsed ion source 105 or intervening components), three "intermediate" focuses for spatially dispersed ions of different energies (210, 320, 330), two combined output-input focuses (215, 325) to interface between the pairs or sets of electrostatic mirror prisms 150 (the first pair with the second pair, and the second pair with the third pair, as illustrated), and the last output focus 335 where an ion detector 120 can be placed.

As illustrated in FIGS. 23 and 24, for the first pair of electrostatic mirror prisms 150D, a first or primary ion beam 220 (having a first or initial TOF focus 205) is input into the first electrostatic mirror prism 150$D_1$, which generates a second or intermediate (i.e., spatially-dispersed) ion beam 225 (having a second or secondary TOF focus 210) to the second electrostatic mirror prism 150$D_2$, which generates a third or tertiary ion beam 230 (having a third or tertiary TOF focus plane 215, as a combined output-input focus). For the second pair of electrostatic mirror prisms 150D, the third or tertiary ion beam 230 is input into the third electrostatic mirror prism 150$D_3$, which generates a next intermediate (i.e., spatially-dispersed) ion beam 340 (having an intermediate TOF focus 320) provided to the fourth electrostatic mirror prism 150$D_4$, which generates another ion beam 345 (having a TOF focus plane 325, as another combined output-input focus), which in turn is provided to the third pair of electrostatic mirror prisms 150D and is input into the fifth electrostatic mirror prism 150$D_5$, which generates a next intermediate (i.e., spatially-dispersed) ion beam 350 (having an intermediate TOF focus 330) provided to the sixth electrostatic mirror prism 150$D_6$, which generates another, output ion beam 355 (having an output TOF focus plane 335). As described above, an ion detector 120 is typically positioned at this output TOF focus plane 335, and together with the representative electrostatic mirror prism arrangement 300, forms another representative TOF mass analyzer 100 apparatus embodiment. With this serial cascade arrangement, the time-of-flight "T" has been increased 3-fold, while the width of the mass spectrum at one-half the maximum "ΔT" has changed insignificantly due to multiple TOF focusing events, thus considerably increasing the mass resolving power. In addition, the implementation of band-pass energy filtering may be implemented as described above, at any or at all of the three intermediate focuses 210, 320, 330 for spatially dispersed ions of different energies will further narrow "ΔT" and further improve mass resolution.

Figure 25:
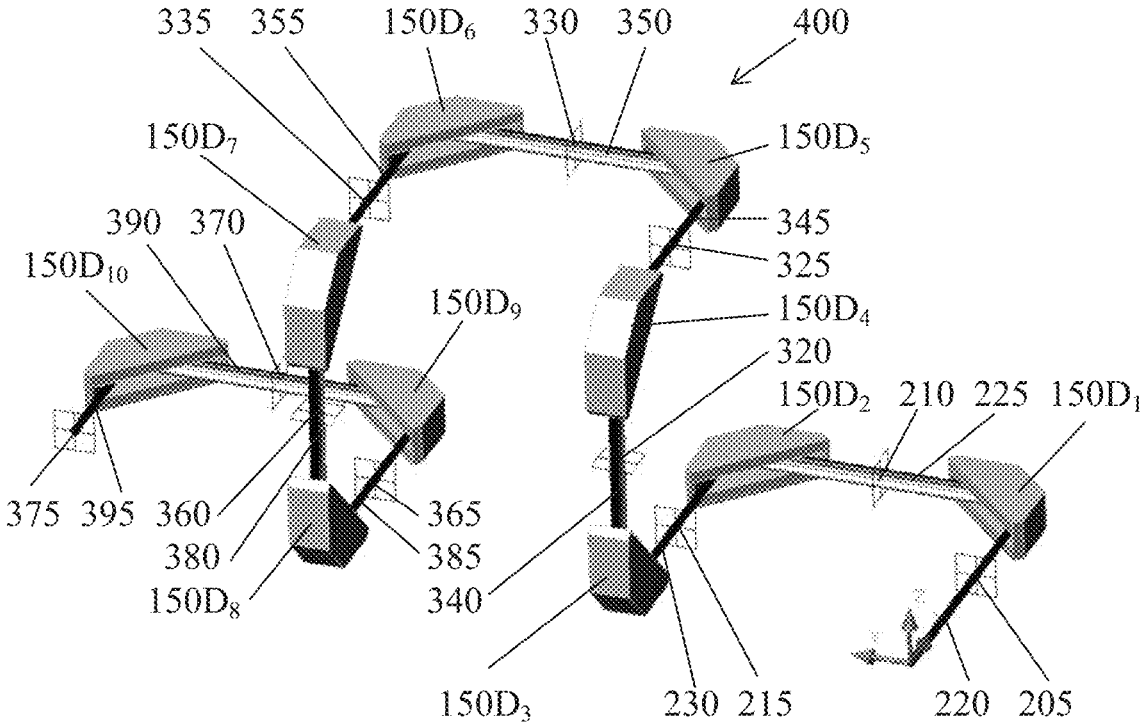
FIG. 25 is an isometric diagram illustrating a representative sixth electrostatic mirror prism arrangement having representative electrostatic mirror prisms in a second cascaded arrangement or configuration for a representative TOF mass analyzer apparatus embodiment and a representative TOF-MS system embodiment.

FIG. 25 is an isometric diagram illustrating a representative sixth electrostatic mirror prism arrangement 400 having representative electrostatic mirror prisms 150D in a second cascaded arrangement or configuration for a representative TOF mass analyzer 100 apparatus embodiment and a representative TOF system 200 embodiment. As mentioned above, the electrostatic mirror prisms 150 are arranged pair-wise, in groups of two electrostatic mirror prisms 150. As illustrated in FIG. 25, ten electrostatic mirror prisms 150$D_1$ through 150$D_{10}$ have been cascaded in pairs, i.e., arranged serially, with the output TOF focus of one pair of electrostatic mirror prisms 150D being the input TOF focus of the next pair of electrostatic mirror prisms 150D. In addition to having additional electrostatic mirror prisms 150D, this second cascaded arrangement or configuration forming representative electrostatic mirror prism arrangement 400 differs from the first cascaded arrangement or configuration 405 (representative electrostatic mirror prism arrangement 300) insofar as the representative electrostatic mirror prism arrangement 400 is non-planar (i.e., not confined to the illustrated x-y plane, also referred to as the "energy dispersion plane"), and extends into a third dimension along the z-axis, as illustrated. Also as illustrated, there are eleven TOF focuses 205, 210, 215, 320, 325, 330, 335, 360, 365, 370, and 375, and eleven ion beams 220, 225, 230, 340, 345, 350, 355, 380, 385, 390, and 395, of which ion beams 225, 340, 350, 380 and 390 are secondary or intermediate ion beams which have ions which are dispersed in space due to prismatic properties of the electrostatic mirror prism arrangements, with beam cross-sections as show in FIG. 5B. As described above, an ion detector 120 is typically positioned at this last output TOF focus plane 375, and together with the representative electrostatic mirror prism arrangement 400, forms another representative TOF mass analyzer 100 apparatus embodiment. With this serial cascade arrangement, the time-of-flight "T" has been increased 5-fold, while the width of the mass spectrum at one-half the maximum "ΔT" has changed insignificantly due to multiple TOF focusing events, thus considerably increasing the mass resolving power. In addition, implementation of bandpass energy filtering as described above, at any or all of the five intermediate focuses (210, 320, 330, 360, 370) for spatially dispersed ions of different energies will further narrow "ΔT" and further improve mass resolution.

For the cascaded arrangements 300, 400 and 415 shown in FIGS. 23-26, it is important to recognize that the implementation of the bandpass energy filtering at multiple TOF focuses will considerably improve the attenuation of energies outside the intended energy passband, which will result in improved shapes of mass spectral peaks with significantly suppressed "tails".

This representative electrostatic mirror prism arrangement 400 is three-dimensional, such that four rotations of energy dispersion planes by 90° occur at four intermediate output-input focuses (215, 325, 335, 365) where the pairs of electrostatic mirror prisms 150D are sequentially interfaced (the first pair with the second pair, the second pair with the third pair, the third pair with the fourth pair, and the fourth pair with the fifth pair). It is important to recognize that rotations at these focuses are possible because ions of different energies have been recombined in one single beam for traversing or flying through these intermediate output-input focuses (215, 325, 335, 365). As mentioned above, there are eleven TOF focuses: the input focus 205 (from a pulsed ion source 105 or intervening components), five intermediate focuses (210, 320, 330, 360, 370) for spatially dispersed ions of different energies, where the bandpass filter 140 energy control slit(s) 255 can be positioned for kinetic energy filtering, four combined output-input focuses (215, 325, 335, 365), and an output TOF focus 375 where the TOF ion detector 120 can be placed.

Figure 26:
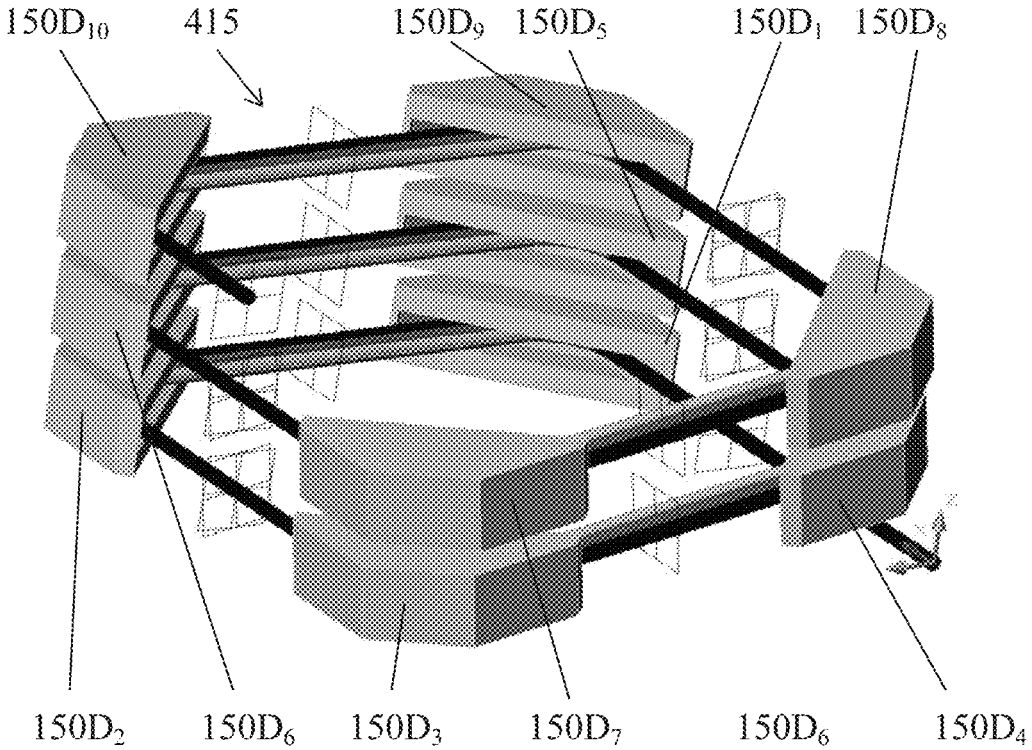
FIG. 26 is an isometric diagram illustrating a representative seventh electrostatic mirror prism arrangement having representative electrostatic mirror prisms in a third cascaded arrangement or configuration for a representative TOF mass analyzer apparatus embodiment and a representative TOF-MS system embodiment.

FIG. 26 is an isometric diagram illustrating a representative seventh electrostatic mirror prism arrangement 415 having representative electrostatic mirror prisms 150D in a third cascaded arrangement or configuration for a representative TOF mass analyzer 100 apparatus embodiment and a representative TOF system 200 embodiment. This third cascaded arrangement or configuration forming representative electrostatic mirror prism arrangement 415 differs from the representative electrostatic mirror prism arrangement 400 insofar as the representative electrostatic mirror prism arrangement 415 is more compact. This representative electrostatic mirror prism arrangement 415 is a folded three-dimensional equivalent to the representative electrostatic mirror prism arrangement 400, with the main difference that instead of four ninety degree rotations of energy dispersion planes, there are four rotations by 10° only.

In general, other folded, three-dimensional equivalents of the electrostatic mirror prism arrangement 400 shown in FIG. 25 can be obtained by changing these rotation angles. The range of these angles is limited by mechanical design constrains and generally can be chosen between 10° (as shown for arrangement 415 in FIG. 26) and 180° (as shown for arrangement 300 in FIGS. 23-24)

FIGS. 27A, 27B, 27C, and 27D (collectively referred to as "FIG. 27") are isometric diagrams illustrating a representative eighth electrostatic mirror prism arrangement 430 having representative electrostatic mirror prisms 150F with additional first and second electrostatic mirrors 150 of the reflectron-type design (referred to as "reflectrons") 420, 425 for a representative TOF mass analyzer 100 apparatus embodiment and a representative TOF system 200 embodiment. Electrostatic mirror prisms 150E may also be substituted for the electrostatic mirror prisms 150F and utilized equivalently for this representative electrostatic mirror prism arrangement 430, because both electrostatic mirror prisms 150E and 150F feature the ion-transparent rear electrode design, as shown in FIGS. 19 and 20. As mentioned above, the electrostatic mirror prism 150F differs from the other electrostatic mirror prisms insofar as the electrostatic mirror prism 150F has a grid configuration of the third, rear electrode 155F, which also allows for the ion beam (e.g., second or secondary ion beam 225 or third or tertiary ion beam 230) to pass through the electrostatic mirror prism 150F without significant disturbance when the electrostatic mirror prism 150F is off and its electrodes are not electrostatically biased to deflect ions. For this embodiment, the on and off states of the first electrostatic mirror prism $150F_1$, and the second electrostatic mirror prism $150F_2$ (and potentially the first and second reflectrons 420, 425) may be controlled by the processor 130 and/or more generally by the computing device 132, thereby controlling the generation of electric fields by these devices and, correspondingly, whether any retarding electric fields will be generated. (It should be noted that for the reflectrons 420, 425, no off state is needed, and they can be always on because they are outside of the electrostatic mirror prisms 150F (RAIMPs) and thus do not affect the trajectories of ions when they pass through the electrostatic mirror prisms 150F in its main operating mode.

Each of the first and second reflectrons 420, 425, as illustrated in FIG. 27, may be implemented as a type of electrostatic mirror prism 150, such as using an electrostatic mirror prism 150 or an electrostatic mirror prism 150A, for example and without limitation. For this embodiment, the electrostatic mirror prism 150, 150A is configured to have comparatively increased depth, as illustrated, with depth being in the direction or orientation from the front electrode 165, 165A to the rear electrode 155, 155A, and further the central axis 427 (i.e., the center and normal along the depth) of the electrostatic mirror prism 150, 150A is oriented and aligned to be coextensive or co-arranged with the incoming ion beam as illustrated in FIGS. 27A and 27C (i.e., the ion beam should have a zero or negligible angle of incidence, as defined above). As a result, with the retarding electric field generated by the electrostatic mirror prism 150, 150A forming the reflectron 420, 425, the incoming ion beam will enter the reflectron 420, 425, and its ions will decelerate to a complete stop, followed by accelerating in the opposite direction (180° from the incoming beam) out of the electrostatic mirror prism 150, 150A, with the output ion beam having about the same kinetic energy dispersion, if any, as the incoming ion beam.

The representative TOF mass analyzer 100 apparatus embodiment and representative TOF system 200 embodiment having this representative electrostatic mirror prism arrangement 430 have several different modes of operation, a first operating mode utilizing only the first electrostatic mirror prism 150$F_1$ and the second electrostatic mirror prism 150$F_2$, and a second, "shuttle" operating mode using both the first and second reflectrons 420, 425 with both of the first electrostatic mirror prism 150$F_1$ and the second electrostatic mirror prism 150$F_2$ in an off state. For these various operating modes, the first electrostatic mirror prism 150$F_1$ and the second electrostatic mirror prism 150$F_2$ are turned on and off, generally through a remotely controlled switching system (not separately illustrated), which is under the control of the processor 130.

The representative electrostatic mirror prism arrangement 430 comprises a pair of two electrostatic mirror prisms 150F having an angular offset of 90 degrees, such as for a representative electrostatic mirror prism arrangement 145 discussed above. As such, for the first operating mode, the first electrostatic mirror prism 150$F_1$ will receive the first or primary (incoming) ion beam 220 having the first or initial TOF focus 205, and when the first electrostatic mirror prism 150$F_1$ is on and its electrodes are electrostatically biased to deflect ions (i.e., by generating an electric field), will generate the second or secondary ion beam 225 having the second or secondary TOF focus 210. In turn, the second or secondary ion beam 225 is provided to the second electrostatic mirror prism 150$F_2$, and when the second electrostatic mirror prism 150$F_2$ is on and its electrodes are electrostatically biased to deflect ions, will generate the third or tertiary ion beam 230 having the third or tertiary TOF focus plane 215, where an ion detector 120 is positioned, as discussed above, and as illustrated in FIG. 27A. In this operating mode, which can also be called a "survey mode", the electrostatic mirror prism arrangement 430 can be used for TOF-MS measurements with moderate resolution and with no limit on the detected range of ion masses.

Figure 27A:
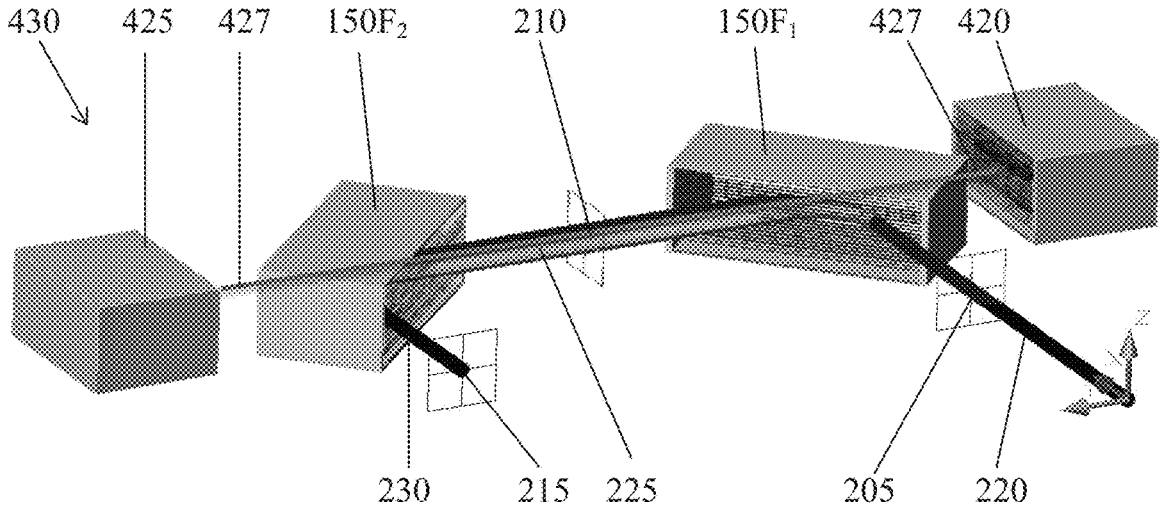
FIGS. 27A, 27B, 27C, and 27D (collectively referred to as "FIG. 27") are isometric diagrams illustrating a representative eighth electrostatic mirror prism arrangement having representative electrostatic mirror prisms with additional reflectrons for a representative TOF mass analyzer apparatus embodiment and a representative TOF-MS system embodiment.
Figure 27B:
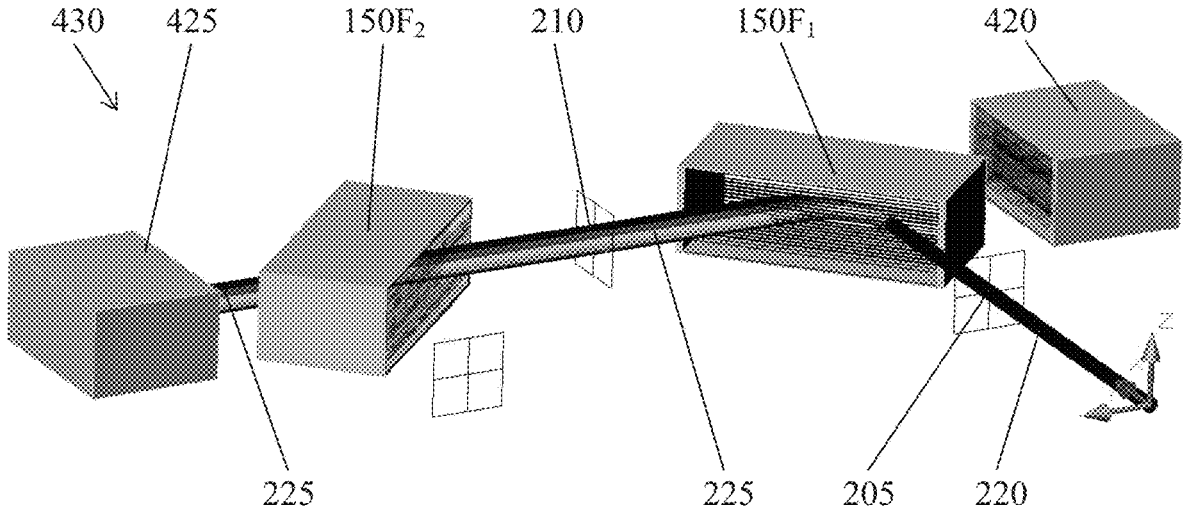

In addition, for this representative electrostatic mirror prism arrangement 430, the additional first and second reflectrons 420, 425 are arranged linearly with respect to the two electrostatic mirror prisms 150F, i.e., in line with the second or secondary ion beam 225, and having the same intermediate TOF focus 210, which for the first and second reflectrons 420, 425, is also a combined output-input focus. As such, for the second operating mode, the first electrostatic mirror prism 150$F_1$ also will receive the first or primary (incoming) ion beam 220 having the first or initial TOF focus 205, and when the first electrostatic mirror prism 150$F_1$ is on and its electrodes are electrostatically biased to deflect ions, will generate the second or secondary ion beam 225 having the second or secondary TOF focus 210. This allows the first or primary (incoming) ion beam 220 to be "injected" and used to produce the second or secondary ion beam 225 for this second operating mode. Also for this second operating mode, the second electrostatic mirror prism 150$F_2$ is turned off at this time. As a result, when the second electrostatic mirror prism 150$F_2$ is not generating an electric field (i.e., is not on and its electrodes are not electrostatically biased to deflect ions) and becoming ion-transparent, so that the second or secondary ion beam 225 will pass (substantially undisturbed) through the second electrostatic mirror prism 150$F_2$ into the second reflectron 425, as illustrated in FIG. 27B. It should be noted that due to prismatic functionality of the first electrostatic mirror prism 150$F_1$, these ions are separated in the energy dispersion plane into parallel beams of ions with different energies, as discussed above. These ions enter the second reflectron 425 orthogonally to its retarding electrostatic field, so that they are reflected back in the same direction from which they came. Since the second electrostatic mirror prism 150$F_2$ is off, the ions fly straight through it, without being affected, and reach the second or secondary (intermediate) TOF focus 210.

Figure 27C:
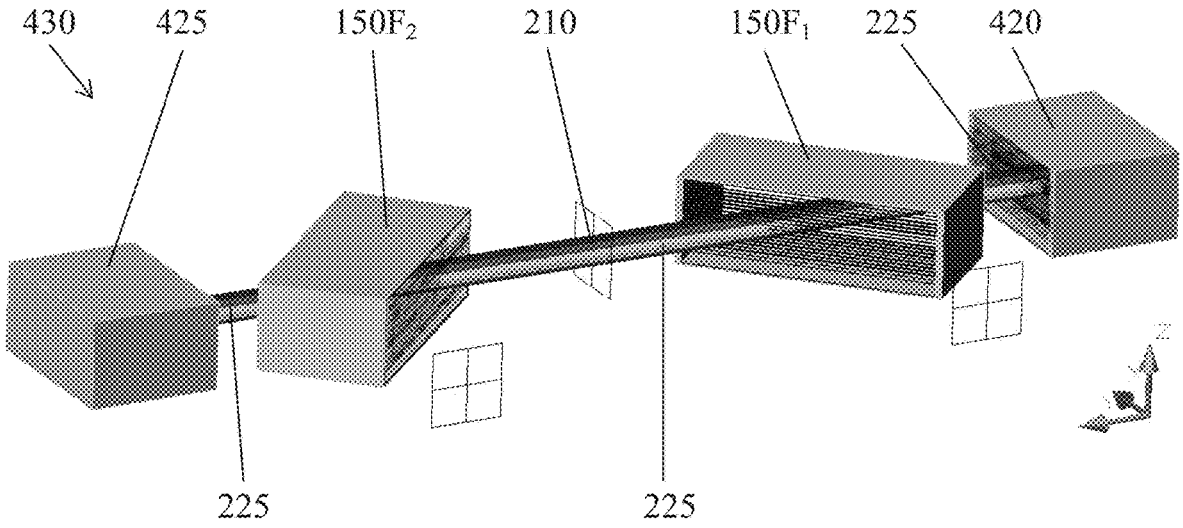

Then, in this second operating mode, when the second reflectron 425 is on and its electrodes are electrostatically biased to deflect ions, and when both the first electrostatic mirror prism 150$F_1$ and the second electrostatic mirror prism 150$F_2$ are not generating electric fields (i.e., both are off and their electrodes are not electrostatically biased to deflect ions), the second or secondary ion beam 225 is reflected by the second reflectron 425 and passes (substantially undisturbed) through both the second electrostatic mirror prism 150$F_2$ and the first electrostatic mirror prism 150$F_1$ to the first reflectron 420, as illustrated in FIG. 27C. With the first reflectron 420 also being on and its electrodes are electrostatically biased to deflect ions, and when both the first electrostatic mirror prism 150$F_1$ and the second electrostatic mirror prism 150$F_2$ continue to be off and are not generating electric fields (i.e., both are off and their electrodes are not electrostatically biased to deflect ions) and thus staying in ion-transparent state, the second or secondary ion beam 225 is reflected back by the first reflectron 420 and passes (substantially undisturbed) through both the first electrostatic mirror prism 150$F_1$ and the second electrostatic mirror prism 150$F_2$ to the second reflectron 425, also as illustrated in FIG. 27C. In this second operating mode, with both the first reflectron 420 and the second reflectron 425 being on and generating electric fields, and with both the first electrostatic mirror prism 150$F_1$ and the second electrostatic mirror prism 150$F_2$ continuing to be off and not generating electric fields, the second or secondary ion beam 225 will continue to be reflected back and forth in a shuttle-type motion between the first and second reflectrons 420, 425, until ejection, as controlled by the processor 130 and/or by the computing device 132, as described below.

Potentials on the electrodes of the first electrostatic mirror prism 150$F_1$ are turned off (to ground potential) when the lightest ions of the mass range of interest to be examined with high mass resolving power pass through the second or secondary TOF focus 210 on their way back from the second reflectron 425. These ions then can fly straight through the first electrostatic mirror prism 150$F_1$ and enter the first reflectron 420 (also orthogonally to its retarding field) to get reflected straight back towards the second or secondary TOF focus 210, as a combined output-input focus. In this case, a process of consecutive and alternating back and forth reflections between the first and second reflectrons 420, 425 (the shuttle movement) can go until the second electrostatic mirror prism 150$F_2$ is switched on again. This switching is done when the lightest ions of the mass range of interest to be examined with high mass resolving power pass through the second or secondary TOF focus 210 on their way back from the first reflectron 420. At each reflection, ions pass through the second or secondary TOF focus 210, where their "ΔT" becomes small while "T" (the total time of flight) keeps increasing, potentially providing a mass resolving power in excess of 100,000.

Figure 27D:
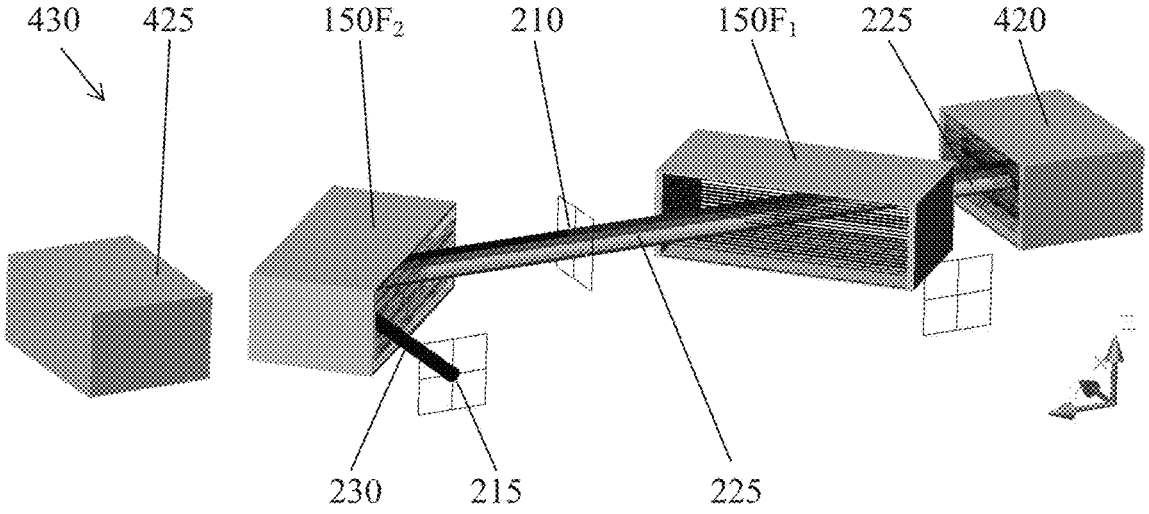

In this representative electrostatic mirror prism arrangement 430, therefore, in the second operating mode, the time-of-flight "T" can be varied and controlled, based upon user preference or selection, while the width of the mass spectrum at one-half the maximum "ΔT" is maintained small (due to multiple TOF focusing events), with the reflections back and forth between the first and second reflectrons 420, 425 continuing until terminated, with the reflected ions "ejected" in the third or tertiary ion beam 230, as illustrated in FIG. 27D, generally as controlled by the processor 130 and/or the computing device 132. When the user-selected time-of-flight "T" has elapsed, under the control of the processor 130 and/or the computing device 132, as the second or secondary ion beam 225 is provided to the second electrostatic mirror prism 150$F_2$ following reflection from the first reflectron 420, instead of passing through the second electrostatic mirror prism 150$F_2$, the second electrostatic mirror prism 150$F_2$ is turned on and its electrodes are electrostatically biased to deflect ions, which will generate the third or tertiary ion beam 230 having the third or tertiary TOF focus plane 215, simultaneously recombining laterally dispersed ion beams with different energies into a single ion beam (i.e., cancelling chromatic aberrations), for detection by the ion detector 120 positioned at the third or tertiary TOF focus plane 215, as discussed above and as illustrated in FIG. 27D.

The dimensions of the first and second reflectrons 420, 425 and the number of back-and-forth reflections will define, in this representative electrostatic mirror prism arrangement 430, the width of the mass range of interest. The input ion package for the first and second reflectrons 420, 425 will be formed by masses located before the first reflection between the first or initial TOF focus 205 (heaviest masses) and the second or secondary TOF focus 210 (lightest masses). This ion package is widening when the number of reflections increases. The output ion package will be formed by masses located after the last reflection between the second or secondary TOF focus 210 (lightest masses) and the back plate of the first reflectron 420 (heaviest masses). Thus, choosing the moments of when the first electrostatic mirror prism 150$F_1$ and the second electrostatic mirror prism 150$F_2$ are turned on and off will determine or define the mass range of interest examined with ultra-high mass resolution.

One distinctive feature of the representative electrostatic mirror prism arrangement 430 is that because the electrostatic mirror prisms 150$F_1$, 150$F_2$ and reflectrons 420, 425 share the same TOF focus 210, ions are injected into and ejected from inside the pair of first and second reflectrons 420, 425, via the first electrostatic mirror prism 150$F_1$ and the second electrostatic mirror prism 150$F_2$ located in between the first and second reflectrons 420, 425, while in the prior art describing coaxial reflectron pairs with shuttle-type multi-reflection ion movement, the injection of ions is conducted through the back electrode of one of the reflectrons. Another distinctive feature is that the second or secondary ion beam 225 which is going back and forth between the first and second reflectrons 420, 425 is spatially dispersed into parallel beams of ions with different kinetic energies due to the prismatic properties of the first electrostatic mirror prism 150$F_1$. This further permits installation of an energy bandpass filter 140 having an energy control slit 255 at the second or secondary TOF focus 210, so that ions with undesired energies can be cut off multiple times in order to suppress "tails" of TOF mass spectral peaks and filter out low energy fragment ions. It is important to note that the implementation of the bandpass energy filtering at the single TOF focus 210, which ions pass through many times during their shuttle motion, will significantly improve the attenuation of energies outside the intended passband, which will result in improved shapes of mass spectral peaks with drastically suppressed "tails", thus further improving the effective mass resolving power of the electrostatic mirror prism arrangement 430.

Thus the TOF mass analyzer 110 and system 200 embodiments having the representative electrostatic mirror prism arrangement 430 comprises the energy-isochronous multi-pass TOF MS with band-pass energy filtering, which are novel and nonobvious features.

In addition, for this representative electrostatic mirror prism arrangement 430, first and second reflectrons 420, 425 with elliptical or rectangular front cross-sections may be utilized to better accommodate spatially dispersed sheet-like ion beams, such as the second or secondary ion beam 225, in addition to or alternatively to using coaxial cylindrical reflectrons having large diameters.

FIGS. 28A, 28B, 28C, and 28D (collectively referred to as "FIG. 28") are isometric diagrams illustrating a representative ninth electrostatic mirror prism arrangement 450 having representative electrostatic mirror prisms 150, 150D, and 150F in a fourth cascaded arrangement or configuration for a representative TOF mass analyzer 100 apparatus embodiment and a representative TOF system 200 embodiment, utilizing a first electrostatic mirror prism 150$_1$, a second electrostatic mirror prism 150$_2$, a third electrostatic mirror prism 150$F_3$, a fourth electrostatic mirror prism 150$D_4$, a fifth electrostatic mirror prism 150$D_5$ and a sixth electrostatic mirror prism 150$F_6$. Electrostatic mirror prisms 150E may also be substituted for the electrostatic mirror prisms 150F and utilized equivalently for this representative electrostatic mirror prism arrangement 450, because both electrostatic mirror prisms 150E and 150F feature the ion-transparent rear electrode design, as shown in FIGS. 19 and 20, as well as the gridless electrostatic mirror prism embodiments, such as 150C and 150D, if their rear electrode is modified to become ion-transparent by implementing a grid or a solid plate with an opening 315, as previously described. As mentioned above, the electrostatic mirror prism 150F differs from the electrostatic mirror prism 150 insofar as the electrostatic mirror prism 150F has a gridded configuration (i.e., ion-transparent) of the third, rear electrode 155F, which also allows for the ion beam to pass through the electrostatic mirror prism 150F without significant disturbance when the electrostatic mirror prism 150F is off and its electrodes are not electrostatically biased to deflect ions. For this embodiment, the on and off states of the electrostatic mirror prisms 150$F_3$ and 150$F_6$ also may be controlled by the processor 130 and/or more generally by the computing device 132, thereby controlling the generation of electric fields by these devices and, correspondingly, whether any retarding electric fields will be generated. It should also be noted that, for this embodiment, the states of the first electrostatic mirror prism 150$_1$, the second electrostatic mirror prism 150$_2$, the fourth electrostatic mirror prism 150$D_4$, and the fifth electrostatic mirror prism 150$D_5$, may be always on.

The representative TOF mass analyzer 100 apparatus embodiment and representative TOF system 200 embodiment having this representative electrostatic mirror prism arrangement 450 have several different modes of operation, a first operating mode utilizing only the first electrostatic mirror prism 150$_1$ and the second electrostatic mirror prism 150$_2$, and a second, "ring" operating mode using all four of the third electrostatic mirror prism 150$F_3$, the fourth electrostatic mirror prism 150$D_4$, the fifth electrostatic mirror prism 150$D_5$ and the sixth electrostatic mirror prism 150$F_6$, and then also using both of the first electrostatic mirror prism 150$_1$ and the second electrostatic mirror prism 150$_2$ for ion ejection. It should also be noted that other types of electrostatic mirror prisms 150 may be substituted equivalently for these various electrostatic mirror prisms 150 illustrated in FIG. 28, with the caveat that while they all can be of gridded and gridless designs, the electrostatic mirror prisms 150F require implementation of ion-transparent back electrodes as discussed above. For these various operating modes, the third electrostatic mirror prism 150$F_3$ and the sixth electrostatic mirror prism 150$F_6$ are turned on and off, generally through a remotely controlled switching system (not separately illustrated), which is under the control of the processor 130.

The representative electrostatic mirror prism arrangement 450 comprises: (1) a first pair of two electrostatic mirror prisms 150, the first electrostatic mirror prism 150$_1$ and the second electrostatic mirror prism 150$_2$, having an angular offset of 90 degrees, such as for a representative electrostatic mirror prism arrangement 145 discussed above; (2) a second pair of two electrostatic mirror prisms 150, the third electrostatic mirror prism 150$F_3$ and the fourth electrostatic mirror prism 150$D_4$, also having an angular offset of 90 degrees, such as for a representative electrostatic mirror prism arrangement 145 discussed above; and (3) a third pair of two electrostatic mirror prisms 150, the fifth electrostatic mirror prism 150$D_5$ and the sixth electrostatic mirror prism 150$F_6$, also having an angular offset of 90 degrees, such as for a representative electrostatic mirror prism arrangement 145 discussed above. It is important to note that: (1) the first electrostatic mirror prism 150$_1$ and the third electrostatic mirror prism 150$F_3$ have the same primary input TOF focus 460; (2) TOF focus 460 is also a combined output-input TOF focus of the sixth electrostatic mirror prism 150$F_6$; (3) the combined output-input TOF focus 480 is interfacing the second and third pairs of electrostatic mirror prisms (the third electrostatic mirror prism 150$F_3$ and the fourth electrostatic mirror prism 150$D_4$ interfacing with the fifth electrostatic mirror prism 150$D_5$ and the sixth electrostatic mirror prism 150$F_6$).

Figure 28A:
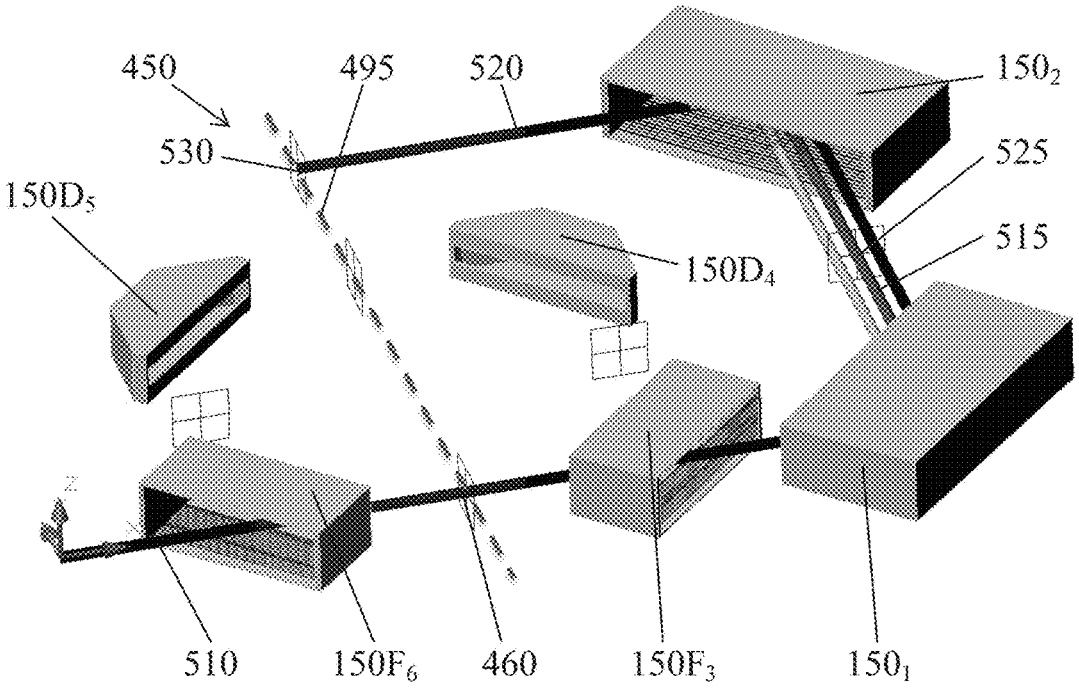
FIGS. 28A, 28B, 28C, and 28D (collectively referred to as "FIG. 28") are isometric diagrams illustrating a representative ninth electrostatic mirror prism arrangement having representative electrostatic mirror prisms in a fourth cascaded arrangement or configuration for a representative TOF mass analyzer apparatus embodiment and a representative TOF-MS system embodiment.

As such, for the first operating mode, the third electrostatic mirror prism 150$F_3$ and the sixth electrostatic mirror prism 150$F_6$ are off, so that the first electrostatic mirror prism 150$_1$ will receive the first or primary (incoming) ion beam 510 having the first or initial TOF focus 460, passing through the sixth electrostatic mirror prism 150$F_6$ and the third electrostatic mirror prism 150$F_3$. Since the first electrostatic mirror prism 150$_k$ is on and its electrodes are electrostatically biased to deflect ions, the first electrostatic mirror prism 150$_1$ will generate an intermediate ion beam 515 (with spatially-dispersed ions according to their kinetic energies, as previously described) having an intermediate TOF focus 525. In turn, the intermediate ion beam 515 is provided to the second electrostatic mirror prism 150$_2$, and since the second electrostatic mirror prism 150$_2$ is also on and its electrodes are electrostatically biased to deflect ions, will generate an output ion beam 520 having an output TOF focus plane 530, where an ion detector 120 is to be positioned as discussed above for FIGS. 3 and 4, and as illustrated in FIG. 28A. In this operating mode, which can also be called a "survey mode", the arrangement 450 electrostatic mirror prism arrangement 450 can be used for TOF-MS measurements with moderate resolution and with no limit on detected range of ion masses.

Figure 28B:
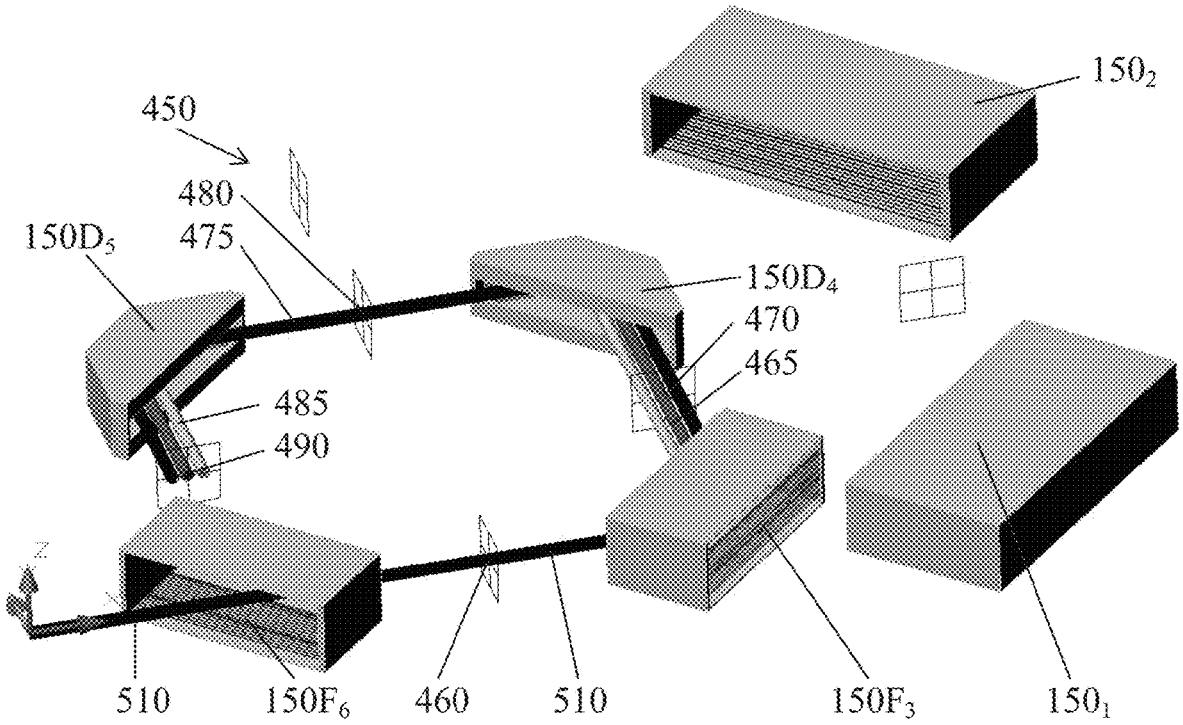

In addition, for this representative electrostatic mirror prism arrangement 450, the fourth electrostatic mirror prism 150$D_4$ and the fifth electrostatic mirror prism 150$D_5$ are arranged to form a square or rectangular ring structure with the third electrostatic mirror prism 150$F_3$ and the sixth electrostatic mirror prism 150$F_6$. As such, for the second "ring" operating mode, the sixth electrostatic mirror prism 150$F_6$ also will receive the first or primary (incoming) ion beam 510 having the input TOF focus 460, and when the sixth electrostatic mirror prism 150$F_6$ is off, the first or primary (incoming) ion beam 510 will pass through the sixth electrostatic mirror prism 150$F_6$ to the third electrostatic mirror prism 150$F_3$. The third electrostatic mirror prism 150$F_3$ is now on and its electrodes are electrostatically biased to deflect ions, so that it will generate a fourth ion beam 465, having spatially-dispersed kinetic energies as described above, and having a fourth (intermediate) TOF focus 470. This allows the first or primary (incoming) ion beam 510 to be "injected" and used to produce a series of ion beams for this second operating mode, as illustrated in FIG. 28B. Also for this second operating mode, the fourth electrostatic mirror prism 150$D_4$ and fifth electrostatic mirror prism 150$D_5$ are also on at this time (either turned on for this mode or always on). It should be noted that due to prismatic functionality of the third electrostatic mirror prism 150$F_3$, these ions are separated in the energy dispersion plane into parallel beams of ions in the fourth ion beam 465 with different energies, as discussed above.

Figure 28C:
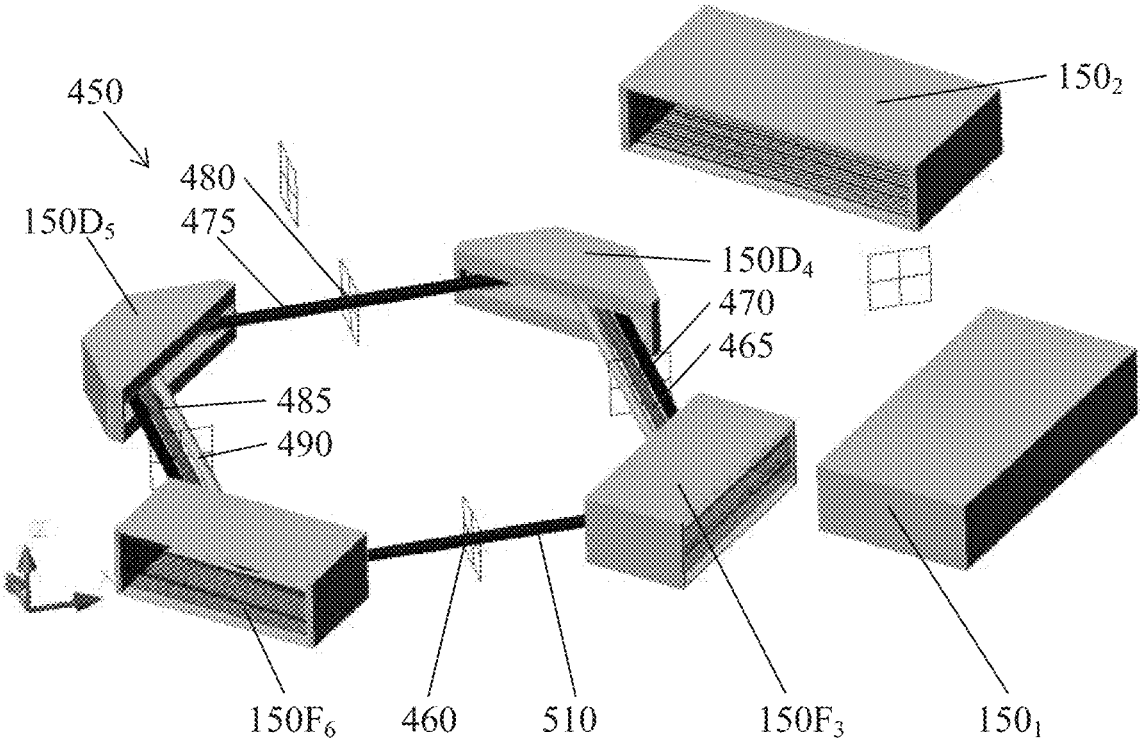
Figure 28D:
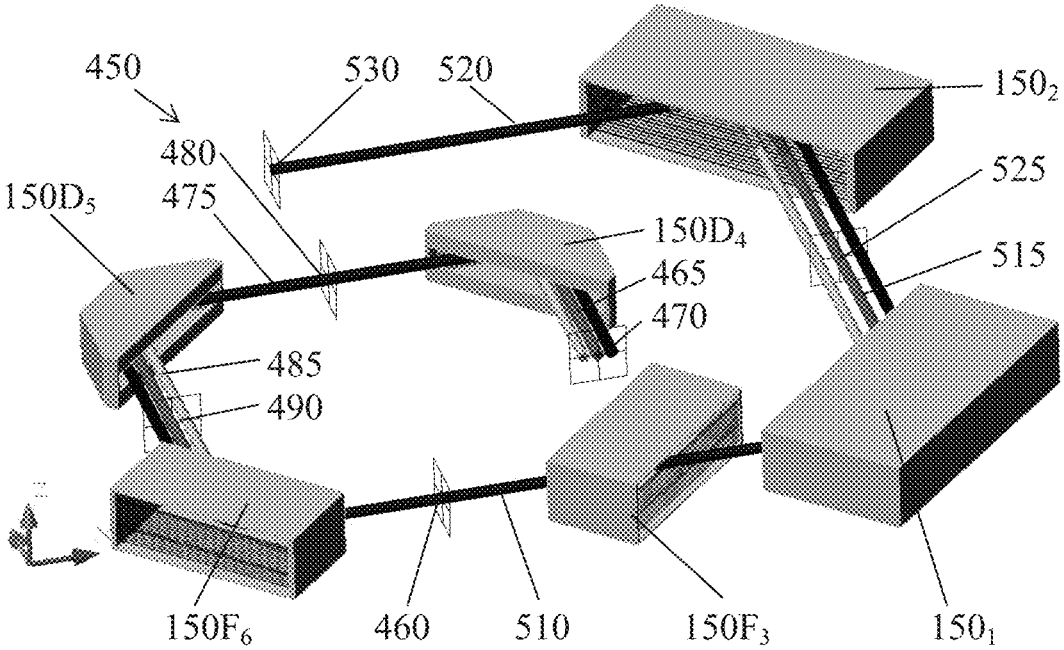

The fourth ion beam 465 is provided to the fourth electrostatic mirror prism 150$D_4$ which generates a fifth, convergent ion beam 475 having a fifth, output TOF focus 480, which is also the input TOF focus for the fifth electrostatic mirror prism 150$D_5$, which generates a sixth ion beam 485, having spatially-dispersed kinetic energies as described above, and having a sixth (intermediate) TOF focus 490, which is also the input TOF focus for sixth electrostatic mirror prism 150$F_6$, as illustrated in FIG. 28B. Then, in this second operating mode, with the sixth electrostatic mirror prism 150$F_6$ now being turned on with its electrodes electrostatically biased to deflect ions, the sixth ion beam 485 is reflected by the sixth electrostatic mirror prism 150$F_6$ and generates a seventh, convergent ion beam 455 having the combined output-input TOF focus 460, which is also the input TOF focus to the third electrostatic mirror prism 150$F_3$ (and also to the first electrostatic mirror prism 150$_1$), as illustrated in FIG. 28C. In this second operating mode, with all four of the third electrostatic mirror prism 150$F_3$, the fourth electrostatic mirror prism 150$D_4$, the fifth electrostatic mirror prism 150$D_5$, and the sixth electrostatic mirror prism 150$F_6$ being on and generating electric fields, the ion beams 455, 465, 475, and 485 will continue to be generated along this square or rectangular ring of electrostatic mirror prisms 150, as controlled by the processor 130 and/or by the computing device 132.

To enable this high mass resolution operation mode, potentials on the electrodes of the third electrostatic mirror prism 150$F_3$ are turned on no later than when the lightest ions of the mass range of interest to be examined pass through the input TOF focus 460, and potentials on the electrodes of the sixth electrostatic mirror prism 150$F_6$ are turned on no later than when the lightest ions of the mass range of interest to be examined with high mass resolving power first pass through the sixth (intermediate) TOF focus 490. In this case, a process of consecutive reflections around the square or rectangular ring of electrostatic mirror prisms 150 can go until the third electrostatic mirror prism 150$F_3$ is switched off again, to pass the ions to the pair of electrostatic mirror prisms 150$_1$ and 150$_2$, which transfers them from input TOF focus 460 to the output TOF focus 530. This switching is done when the lightest ions of the mass range of interest to be examined with high mass resolving power pass through the input TOF focus 460. At each cycle of reflections, ions pass through the TOF focuses 460, 470, 480, and 490, where their "$\Delta T$" becomes small while "T" (the total time of flight) keeps increasing, also potentially providing a mass resolving power in excess of 100,000.

In this representative electrostatic mirror prism arrangement 450, therefore, in the second operating mode, the time-of-flight "T" can be varied and controlled, based upon user preference or selection, with the reflections continuing around the square or rectangular ring of the third electrostatic mirror prism 150$F_3$, the fourth electrostatic mirror prism 150$D_4$, the fifth electrostatic mirror prism 150$D_5$, and the sixth electrostatic mirror prism 150$F_6$, until terminated. When the user-selected time-of-flight "T" has elapsed, under the control of the processor 130 and/or the computing device 132, the reflected ions are then "ejected" when the third electrostatic mirror prism 150$F_3$ is turned off. Because both the first electrostatic mirror prism 150$_1$ and the second electrostatic mirror prism 1502 have been kept on (or are turned on), with the convergent ion beam 455 passing through the third electrostatic mirror prism 150$F_3$, reflected by the first electrostatic mirror prism 150$_1$ to form the intermediate ion beam 515, which in turn is reflected by the second electrostatic mirror prism 150$_2$ to provide the output ion beam 520, again recombining laterally dispersed ion beams with different energies into a single ion beam (i.e., cancelling chromatic aberrations), for detection by the ion detector 120 positioned at the output TOF focus plane 530, as discussed above and as illustrated in FIG. 28D. The moment the third electrostatic mirror prism 150$F_3$ is switched off determines the range of masses that can be detected.

This representative electrostatic mirror prism arrangement 450 for a representative TOF mass analyzer 100, 100A apparatus embodiment and a representative TOF system 200, 200A apparatus embodiment provides another example of an energy-isochronous multi-pass TOF MS with bandpass energy filtering based on electrostatic mirror prisms 150 only. It is important to note that the implementation of the bandpass energy filtering at two intermediate TOF focuses (470 and 490) which ions pass through many times during their motion through the rectangular ring geometry and, finally, at intermediate TOF focus 525, which they pass on their way to an ion detector 120, will significantly improve the attenuation of energies outside the intended passband, which will result in improved shapes of mass spectral peaks with strongly suppressed "tails" thus further improving the effective mass resolving power of the electrostatic mirror prism arrangement 450. Moreover, the electrostatic mirror prism arrangement 450 has an important scaling feature, namely, increasing lateral dimensions of the electrostatic mirror prisms 150 leads to a prolongation of the ion flight path between the input and output TOF focuses 460, 530, respectively. In a first embodiment, the first electrostatic mirror prism 150$_1$ and the second electrostatic mirror prism 150$_2$ are comparatively larger than the other four electrostatic mirror prisms (the third electrostatic mirror prism 150$F_3$, the fourth electrostatic mirror prism 150$D_4$, the fifth electrostatic mirror prism 150$D_5$, and the sixth electrostatic mirror prism 150$F_6$), also achieving higher mass resolving power for single ion pass operation.

To summarize the operations of the electrostatic mirror prism arrangement 450, in one operating mode, the electrode potentials are always on for the first electrostatic mirror prism 150$_1$ and the second electrostatic mirror prism 150$_2$, allowing measurements of the whole TOF mass spectrum with moderate mass resolving power. In front of these mirrors, four comparatively smaller electrostatic mirrors (the third electrostatic mirror prism 150$F_3$, the fourth electrostatic mirror prism 150$D_4$, the fifth electrostatic mirror prism 150$D_5$, and the sixth electrostatic mirror prism 150$F_6$) are positioned to form another TOF MS system section with square or rectangular geometry such that:

(1) the energy dispersion planes of all six electrostatic mirror prisms coincide;

(2) the input TOF focus 460 of the first, larger mirror pair (the first electrostatic mirror prism 150$_1$ and the second electrostatic mirror prism 150$_2$) coincides with the input TOF focus 460 of the second, smaller mirror pair (the third electrostatic mirror prism 150$F_3$ and the fourth electrostatic mirror prism 150$D_4$), such that the input TOF focus 460 is also a scaling point of reference for proportional upscaling to determine the comparative sizes of the first, larger pair (first electrostatic mirror prism 150$_1$ and the second electrostatic mirror prism 150$_2$);

(3) the third (smaller) pair of electrostatic mirror prisms 150 (the fifth electrostatic mirror prism 150$D_5$ and the sixth electrostatic mirror prism 150$F_6$), is a symmetrical or mirror reflection of the second smaller pair of electrostatic mirror prisms 150 (the third electrostatic mirror prism 150$F_3$ and the fourth electrostatic mirror prism 150$D_4$), over the symmetry line 495 connecting the input TOF focus 460 of the first, larger pair (the first electrostatic mirror prism 150$_1$ and the second electrostatic mirror prism 150$_2$) and the second, smaller pair (the third electrostatic mirror prism 150$F_3$ and the fourth electrostatic mirror prism 150$D_4$) and the output TOF focuses 530, 480, respectively, of the first (larger) pair (the first electrostatic mirror prism 150$_1$ and the second electrostatic mirror prism 150$_2$) and the second (smaller) pair (the third electrostatic mirror prism 150$F_3$ and the fourth electrostatic mirror prism 150$D_4$);

(4) the output TOF focus 530 of the first pair (the first electrostatic mirror prism 150$_1$ and the second electrostatic mirror prism 150$_2$) is also the main focus of the entire TOF-MS system 200 having an electrostatic mirror prism arrangement 450 (and where an ion detector 120 is located);

(5) the output TOF focus 480 of the second (smaller) pair (the third electrostatic mirror prism 150$F_3$ and the fourth electrostatic mirror prism 150$D_4$) is also a combined input TOF focus of the a third (smaller) pair (the fifth electrostatic mirror prism 150$D_5$ and the sixth electrostatic mirror prism 150$F_6$), thus forming a two-pair RAIMP cascade;

(6) importantly, the energy dispersion plane of the third (smaller) pair (the fifth electrostatic mirror prism 150$D_5$ and the sixth electrostatic mirror prism 150$F_6$) coincides with that of the second (smaller) pair (the third electrostatic mirror prism 150$F_3$ and the fourth electrostatic mirror prism 150$D_4$) because it was flipped (rotated by 180°) so that the output TOF focus 460 of the third (smaller) pair (the fifth electrostatic mirror prism 150$D_5$ and the sixth electrostatic mirror prism 150$F_6$) coincides with the input TOF focus of the second (smaller) pair (the third electrostatic mirror prism 150$F_3$ and the fourth electrostatic mirror prism 150$D_4$), and this energy dispersion plane also coincides with that for the first, larger pair (the first electrostatic mirror prism 150$_1$ and the second electrostatic mirror prism 150$_2$);

(7) there are two intermediate TOF focuses 470, 490 for the ring arrangement, located symmetrically on each side of the symmetry or mirror line 495, and energy bandpass filters 140 (each having a variable width control slit 255) can be positioned or arranged at these intermediate TOF focuses 470, 490 to improve the signal-to-noise ratio and effective mass resolution of this portion of the system 200 embodiment, as discussed above for electrostatic mirror prism arrangements 300, 400, 415, and 430; and (8) an energy bandpass filter 140 (having a variable width control slit 255) can be positioned or arranged at the intermediate TOF focus 525 to improve the signal-to-noise ratio and effective mass resolution of this portion of the system 200 embodiment having the first electrostatic mirror prism 150$_1$ and the second electrostatic mirror prism 150$_2$.

The mass range which can be measured using this representative TOF mass analyzer 100 apparatus embodiment and representative TOF system 200 embodiment having this representative electrostatic mirror prism arrangement 450 will depend on the number of turns through the second pair (the third electrostatic mirror prism 150$F_3$ and the fourth electrostatic mirror prism 150$D_4$) and the third pair (the fifth electrostatic mirror prism 150$D_5$ and the sixth electrostatic mirror prism 150$F_6$). The input ion package for multi-turn analysis will be formed by masses located before the first turn between the input TOF focus 460 for the second pair (the third electrostatic mirror prism 150$F_3$ and the fourth electrostatic mirror prism 150$D_4$) (heaviest masses) and the intermediate TOF focus 490 of the third pair (the fifth electrostatic mirror prism 150$D_5$ and the sixth electrostatic mirror prism 150$F_6$) (lightest masses). The output ion package for multi-turn TOF-MS analysis will be formed by masses located after the last turn between the input TOF focus 460 (lightest masses) and the intermediate TOF focus 470 (heaviest masses) of the second pair (the third electrostatic mirror prism 150$F_3$ and the fourth electrostatic mirror prism 150$D_4$). Thus, choosing the moments of when the third electrostatic mirror prism 150$F_3$ and the sixth electrostatic mirror prism 150$F_6$ are turned on and off will determine the mass range of interest examined with ultra-high mass resolution. It should be noted that for the first (survey TOF-MS) operation mode using only the first, larger pair (first electrostatic mirror prism 150$_1$ and the second electrostatic mirror prism 150$_2$), the mass range has no limits except those imposed by ion detection scheme, data acquisition hardware and/or data storage capabilities.

FIG. 29 is an isometric diagram illustrating a tenth representative electrostatic mirror prism arrangement 500 having a plurality of representative electrostatic mirror prisms 150D having a fifth cascaded and tandem arrangement or configuration, for a representative TOF mass analyzer 100 apparatus embodiment and a representative TOF system 200 embodiment, and is a variation of the representative fifth electrostatic mirror prism arrangement 300 discussed above. For the tenth representative electrostatic mirror prism arrangement 500, four electrostatic mirror prisms 150 are utilized, with electrostatic mirror prisms 150D illustrated for example and without limitation, in conjunction with a dissociation device 505, such as a laser beam generator (i.e., a laser) or an electron beam generator, for example and without limitation, to cause photo-dissociation or electron impact dissociation of selected masses of interest.

As mentioned above, the electrostatic mirror prisms 150 are arranged pair-wise, in groups of two electrostatic mirror prisms 150. As illustrated in FIG. 29, four electrostatic mirror prisms 150D have been cascaded, i.e., arranged serially, with a first electrostatic mirror prism 150$D_1$ paired with a second electrostatic mirror prism 150$D_2$ as a first pair, and with a third electrostatic mirror prism 150$D_3$ paired with a fourth electrostatic mirror prism 150$D_4$ as a second pair. The output TOF focus of one pair of electrostatic mirror prisms 150 becomes the input TOF focus of the next pair of electrostatic mirror prisms 150. As illustrated, there are five TOF focuses 205, 210, 215, 320, and 325, and five ion beams 220, 225, 230, 340, and 345.

This tenth representative electrostatic mirror prism arrangement 500 is also an example of multi-reflection (cascade) electrostatic mirror prism 150 TOF-MS design using two pairs of gridless electrostatic mirror prisms 150D, although any type of electrostatic mirror prisms 150 discussed above (gridded or gridless) may be utilized equivalently. The two pairs of electrostatic mirror prisms 150 lie in the same "energy dispersion plane", and there are five TOF focuses as mentioned above: the input focus 205 (from a pulsed ion source 105 or intervening components), two "intermediate" focuses for spatially dispersed ions of different energies (210, 320), one combined output-input focus (215) to interface between the first and second pairs or sets of electrostatic mirror prisms 150, and the last output focus 325 where an ion detector 120 can be placed.

As illustrated, for the first pair of electrostatic mirror prisms 150D, a first or primary ion beam 220 (having a first or initial TOF focus 205) is input into the first electrostatic mirror prism 150$D_1$, which generates a second or secondary ion beam 225 (having spatially-dispersed ions according to their kinetic energies and having a second or secondary (intermediate) TOF focus 210) to the second electrostatic mirror prism 150$D_2$, which generates a converged or recombined third or tertiary ion beam 230 (having a third or tertiary TOF focus 215, as a combined output-input focus). For the second pair of electrostatic mirror prisms 150D, the third or tertiary ion beam 230 is input into the third electrostatic mirror prism 150$D_3$, which generates a next intermediate ion beam 340 (having spatially-dispersed ions according to their kinetic energies and having an intermediate TOF focus 320) provided to the fourth electrostatic mirror prism 150$D_4$, which generates another, converged or recombined output ion beam 345 (having an output TOF focus 325). As described above, an ion detector 120 is typically positioned at this output TOF focus plane 325, and together with the representative electrostatic mirror prism arrangement 500, forms another representative TOF mass analyzer 100 apparatus embodiment. In addition, any bandpass energy filtering may be implemented as described above, at any of the two intermediate focuses 210 and 320, for spatially dispersed ions of different energies, and is illustrated using first and second bandpass filters 140A and 140B, respectively.

The multi-"ricochet" representative electrostatic mirror prism arrangement 500 has the capability of operating in MS-MS mode, also referred to as a tandem mode. To this end, the first energy bandpass filter 140A having an energy bandpass control slit 255 should be positioned or arranged at the first intermediate TOF focus 210, and a second bandpass filter 140B at the next intermediate TOF focus 320. The energy bandpass filter 140A at intermediate TOF focus 210 assures that no fragment ions penetrate beyond its location. When thus formed (or filtered) fragment-free mass spectrum of ions is passing through the third or tertiary TOF focus 215, ions with different m/z may be well confined in space but spread over time. In this case, a group of MS peaks corresponding to a molecular ion, which may be identified (referred to herein as a "precursor"), can be intercepted at a chosen moment either by a well-focused pulsed laser beam or by an electron beam generated by the dissociation device 505 in order to trigger intense molecular fragmentation (either via photo-dissociation or electron impact dissociation) and produce fragment ions.

The kinetic energies these fragment ions may be lower than those of the precursor, being a fraction of its energy proportional to the ratio between the fragment and precursor masses. When there is no the energy bandpass filter at the intermediate TOF focus 320, the dispersed in space fragment ions may pass through the fourth electrostatic mirror prism 150$D_4$ and reach an ion detector 120 (positioned at the output TOF focus 325) with unique flight times. In the mass spectrum, this may be seen as either a disappearance or an attenuation of the precursor peak and appearance of new peaks at different times. If the energy bandpass filter 140B is installed at TOF focus 320, it may be aligned, if needed, such that only the fragment ions are passing through the mirror prism 150$D_4$ and reaching ion detector 120. In both cases, for these new peaks, fractions of kinetic energy divided between the fragments can be calculated based on the knowledge of the geometry of the representative electrostatic mirror prism arrangement 500. Having the energy bandpass filter 140B implemented at TOF focus 320 may help better calibrate MS-MS operation and improve fragment identification. This will permit unambiguous identification of the precursor ion and its fragmentation channels. Furthermore, this MS-MS operation mode can be run as one half of the TOF-MS duty cycle so that fragment ions may be formed just for one out of two ion pulses, and each half may be acquired with a separate time-to-digital converter or digitizer. In this case, MS-MS analysis may be conducted in real time and quasi-simultaneously with regular TOF-MS analysis. This means that 50% of ion pulses may produce regular mass spectra with un-fragmented precursors and the other 50% may produce mass spectra with precursor experiencing fragmentation. This will improve accuracy of MS analyses by assuring precursors and fragments are coming from the same analytical volumes.

Time-of-flight mass spectrometry in an MS-MS mode may be performed using two sets of the representative electrostatic mirror prism arrangement 500 operating in parallel, each with an incoming ion beam 220 generated from the pulsed ion source 105, but with fragmentation occurring in only one of the two parallel representative electrostatic mirror prism arrangements 500. In this situation, the knowledge of the representative electrostatic mirror prism arrangement 500 geometry and the nominal kinetic energy of ions permits the determination of the kinetic energy of detected fragment ions from their time of flight. Furthermore, the knowledge of the kinetic energy of detected fragment ions permits the determination of fragmentation channels and thus identification of the molecular precursor ion. Performing the TOF-MS detection with two time-to-digital converters or digitizers triggered in alternating fashion (such that the pulsed laser or electron beam are fired at only one out of two triggering pulses, and the pulsed ion source is triggered at every pulse) enables quasi-parallel measurements of fragment-free and fragment-containing TOF-MS spectra that can be directly compared to assure that precursor and fragment ions come from the same analytical volume.

Numerous advantages of the representative embodiments are readily apparent. Multiple embodiments of a TOF-MS apparatus 100, 100A and system 200, 200A, using a plurality of representative electrostatic mirror prism arrangement, have been disclosed which can select and/or control the kinetic energies of the ions comprising the ion beam, to create an ion beam having a selectable and comparatively narrow band of kinetic energies. Such embodiments of a TOF-MS apparatus 100, 100A and system 200, 200A also provide for selectable or configurable time-of-flight in various system embodiments, and may include multiple TOF focuses and tandem operation. Such embodiments of a TOF-MS apparatus 100, 100A and system 200, 200A also selectively preserve spatial information in detection, to allow for stigmatic imaging. In addition, such embodiments of a TOF-MS apparatus 100, 100A and system 200, 200A are capable of multimode operation, to selectively operate or configure the embodiments of a TOF-MS apparatus 100, 100A and system 200, 200A for these various features and in various combinations.

As mentioned above, the pulsed ion source 105 may optionally include any ion optics, ion guides or ion accelerators, and provides a first or primary ion beam 220 to the TOF mass analyzer 100, 100A. The ion optics are typically arranged in an evacuated volume (e.g., substantially devoid of neutral gas-phase molecules to be essentially collision-free) of a desired axial length between the ion guide(s) 110 and the entrance to the TOF mass analyzer 100, 100A. The ion optics (e.g., ion lenses arranged about an axis) may be, as examples, a cylindrical electrode coaxial with the axis, a plate with an aperture on-axis, or pair of plates or half-cylinders separated by a gap on-axis. DC potentials may be applied to one or more of the ion lenses. One or more of the ion lenses may be configured as an ion slicer that ensures that the geometry of the ion beam matches the acceptance area of the entrance to the TOF mass analyzer 100, 100A. If a continuous ion beam is generated, such ion optics will also be capable of transforming the continuous ion beam into a pulsed (or packet-based) ion beam 220.

One or more optional ion guides may be utilized, generally to interface a variety of continuous beam ion sources, sometimes at elevated pressures, with the ion optics operated in a vacuum, and may include an arrangement of electrodes configured for confining ions along an axis while enabling the ions to be transmitted along the axis. Depending on the type of ion guide, radio frequency (RF) and/or direct current (DC) voltages may be applied to the ion guide electrodes. An ion guide may have a converging geometry, for example, that compresses the ion beam so as to improve transmission into the next device. As an example, an ion guide may be configured as a multipole structure with electrodes elongated generally along the direction of ion travel; or alternatively may be configured as a straight cylindrical stacked-ring structure or an ion funnel, with ring-shaped electrodes or aperture-containing plate electrodes oriented orthogonal to the direction of ion travel; or may have a planar geometry, for example and without limitation.

As used herein, a "processor" (or "controller") 130 may be any type of processor or controller, and may be embodied as one or more processor(s) 130 configured, designed, programmed or otherwise adapted to perform the functionality discussed herein. As the term processor or controller is used herein, a processor 130 may include use of a single integrated circuit ("IC"), or may include use of a plurality of integrated circuits or other components connected, arranged or grouped together, such as controllers, microprocessors, digital signal processors ("DSPs"), array processors, graphics or image processors, parallel processors, multiple core processors, custom ICs, application specific integrated circuits ("ASICs"), field programmable gate arrays ("FPGAs"), adaptive computing ICs, associated memory (such as RAM, DRAM and ROM), and other ICs and components, whether analog or digital. As a consequence, as used herein, the term processor or controller should be understood to equivalently mean and include a single IC, or arrangement of custom ICs, ASICs, processors, microprocessors, controllers, FPGAs, adaptive computing ICs, or some other grouping of integrated circuits which perform the functions discussed herein, with associated memory, such as microprocessor memory or additional RAM, DRAM, SDRAM, SRAM, MRAM, ROM, FLASH, EPROM or $E^2$PROM. A processor 130, with associated memory, may be adapted or configured (via programming, FPGA interconnection, or hard-wiring) to perform the methodology of the invention, as discussed herein, such as to control the various embodiments of a TOF-MS apparatus 100, 100A and system 200, 200A. For example, the methodology may be programmed and stored, in a processor 130 with its associated memory (and/or memory 125) and other equivalent components, as a set of program instructions or other code (or equivalent configuration or other program) for subsequent execution when the processor 130 is operative (i.e., powered on and functioning). Equivalently, when the processor 130 may implemented in whole or part as FPGAs, custom ICs and/or ASICs, the FPGAs, custom ICs or ASICs also may be designed, configured and/or hard-wired to implement the methodology of the invention. For example, the processor 130 may be implemented as an arrangement of analog and/or digital circuits, controllers, microprocessors, DSPs and/or ASICs, collectively referred to as a "processor" or "controller", which are respectively hard-wired, programmed, designed, adapted or configured to implement the methodology of the invention, including possibly in conjunction with a memory 125.

The memory 125, which may include a data repository (or database), may be embodied in any number of forms, including within any computer or other machine-readable data storage medium, memory device or other storage or communication device for storage or communication of information, currently known or which becomes available in the future, including, but not limited to, a memory integrated circuit ("IC"), or memory portion of an integrated circuit (such as the resident memory within a processor 130 or processor IC), whether volatile or non-volatile, whether removable or non-removable, including without limitation RAM, FLASH, DRAM, SDRAM, SRAM, MRAM, FeRAM, ROM, EPROM or $E^2$PROM, or any other form of memory device, such as a magnetic hard drive, an optical drive, a magnetic disk or tape drive, a hard disk drive, other machine-readable storage or memory media such as a floppy disk, a CDROM, a CD-RW, digital versatile disk (DVD) or other optical memory, or any other type of memory, storage medium, or data storage apparatus or circuit, which is known or which becomes known, depending upon the selected embodiment. The memory 125 may be adapted to store various look up tables, parameters, coefficients, other information and data, programs or instructions (of the software of the present invention), and other types of tables such as database tables.

As indicated above, the processor 130 is hard-wired or programmed, using software and data structures of the invention, for example, to perform the methodology of the present invention. As a consequence, the system and related methods of the present invention may be embodied as software which provides such programming or other instructions, such as a set of instructions and/or metadata embodied within a non-transitory computer readable medium, discussed above. In addition, metadata may also be utilized to define the various data structures of a look up table or a database. Such software may be in the form of source or object code, by way of example and without limitation. Source code further may be compiled into some form of instructions or object code (including assembly language instructions or configuration information). The software, source code or metadata of the present invention may be embodied as any type of code, such as C, C++, Matlab, SystemC, LISA, XML, Java, Brew, SQL and its variations (e.g., SQL 99 or proprietary versions of SQL), DB2, Oracle, or any other type of programming language which performs the functionality discussed herein, including various hardware definition or hardware modeling languages (e.g., Verilog, VHDL, RTL) and resulting database files (e.g., GDSII). As a consequence, a "construct", "program construct", "software construct" or "software", as used equivalently herein, means and refers to any programming language, of any kind, with any syntax or signatures, which provides or can be interpreted to provide the associated functionality or methodology specified (when instantiated or loaded into a processor or computer and executed, including the processor 130, for example).

The software, metadata, or other source code of the present invention and any resulting bit file (object code, database, or look up table) may be embodied within any tangible, non-transitory storage medium, such as any of the computer or other machine-readable data storage media, as computer-readable instructions, data structures, program modules or other data, such as discussed above with respect to the memory 125, e.g., a floppy disk, a CDROM, a CD-RW, a DVD, a magnetic hard drive, an optical drive, or any other type of data storage apparatus or medium, as mentioned above.

The network interface 135 is utilized for appropriate connection to a relevant channel, network or bus; for example, the network interface 135 may provide impedance matching, drivers and other functions for a wireline interface, may provide demodulation and analog to digital conversion for a wireless interface, and may provide a physical interface, respectively, for the computing device 132 and/or for the processor 130 and/or memory 125, with other devices. In general, the network interface 135 is used to receive and transmit data, depending upon the selected embodiment, such as program instructions, parameters, configuration information, control messages, data and other pertinent information.

The network interface 135 may be implemented as known or may become known in the art, to provide data communication between the processor 130 and any type of network or external device, such as wireless, optical, or wireline, and using any applicable standard (e.g., one of the various PCI, USB, RJ 45, Ethernet (Fast Ethernet, Gigabit Ethernet, 300ase-TX, 300ase-FX, etc.), IEEE 802.11, WCDMA, WiFi, GSM, GPRS, EDGE, 3G and the other standards and systems mentioned above, for example and without limitation), and may include impedance matching capability, voltage translation for a low voltage processor to interface with a higher voltage control bus, wireline or wireless transceivers, and various switching mechanisms (e.g., transistors) to turn various lines or connectors on or off in response to signaling from processor 130. In addition, the network interface 135 may also be configured and/or adapted to receive and/or transmit signals externally to the computing device 132 and/or system 200, respectively, such as through hard-wiring or RF or infrared signaling, for example, to receive information in real-time for output on a display, for example. The network interface 135 may provide connection to any type of bus or network structure or medium, using any selected architecture. By way of example and without limitation, such architectures include Industry Standard Architecture (ISA) bus, Enhanced ISA (EISA) bus, Micro Channel Architecture (MCA) bus, Peripheral Component Interconnect (PCI) bus, SAN bus, or any other communication or signaling medium, such as Ethernet, ISDN, T1, satellite, wireless, and so on.

The present disclosure is to be considered as an exemplification of the principles of the invention and is not intended to limit the invention to the specific embodiments illustrated. In this respect, it is to be understood that the invention is not limited in its application to the details of construction and to the arrangements of components set forth above and below, illustrated in the drawings, or as described in the examples. Systems, methods and apparatuses consistent with the present invention are capable of other embodiments and of being practiced and carried out in various ways.

Although the invention has been described with respect to specific embodiments thereof, these embodiments are merely illustrative and not restrictive of the invention. In the description herein, numerous specific details are provided, such as examples of electronic components, electronic and structural connections, materials, and structural variations, to provide a thorough understanding of embodiments of the present invention. One skilled in the relevant art will recognize, however, that an embodiment of the invention can be practiced without one or more of the specific details, or with other apparatus, systems, assemblies, components, materials, parts, etc. In other instances, well-known structures, materials, or operations are not specifically shown or described in detail to avoid obscuring aspects of embodiments of the present invention. In addition, the various Figures are not drawn to scale and should not be regarded as limiting.

Reference throughout this specification to "one embodiment", "an embodiment", or a specific "embodiment" means that a particular feature, structure, or characteristic described in connection with the embodiment is included in at least one embodiment of the present invention and not necessarily in all embodiments, and further, are not necessarily referring to the same embodiment. Furthermore, the particular features, structures, or characteristics of any specific embodiment of the present invention may be combined in any suitable manner and in any suitable combination with one or more other embodiments, including the use of selected features without corresponding use of other features. In addition, many modifications may be made to adapt a particular application, situation or material to the essential scope and spirit of the present invention. It is to be understood that other variations and modifications of the embodiments of the present invention described and illustrated herein are possible in light of the teachings herein and are to be considered part of the spirit and scope of the present invention.

For the recitation of numeric ranges herein, each intervening number there between with the same degree of precision is explicitly contemplated. For example, for the range of 6-9, the numbers 7 and 8 are contemplated in addition to 6 and 9, and for the range 6.0-7.0, the number 6.0, 6.1, 6.2, 6.3, 6.4, 6.5, 6.6, 6.7, 6.8, 6.9, and 7.0 are explicitly contemplated. In addition, every intervening subrange within range is contemplated, in any combination, and is within the scope of the disclosure. For example, for the range of 5-10, the sub-ranges 5-6, 5-7, 5-8, 5-9, 6-7, 6-8, 6-9, 6-10, 7-8, 7-9, 7-10, 8-9, 8-10, and 9-10 are contemplated and within the scope of the disclosed range.

It will also be appreciated that one or more of the elements depicted in the Figures can also be implemented in a more separate or integrated manner, or even removed or rendered inoperable in certain cases, as may be useful in accordance with a particular application. Integrally formed combinations of components are also within the scope of the invention, particularly for embodiments in which a separation or combination of discrete components is unclear or indiscernible. In addition, use of the term "coupled" herein, including in its various forms such as "coupling" or "couplable", means and includes any direct or indirect electrical, structural or magnetic coupling, connection or attachment, or adaptation or capability for such a direct or indirect electrical, structural or magnetic coupling, connection or attachment, including integrally formed components and components which are coupled via or through another component.

Furthermore, any signal arrows in the drawings/Figures should be considered only exemplary, and not limiting, unless otherwise specifically noted. Combinations of components of steps will also be considered within the scope of the present invention, particularly where the ability to separate or combine is unclear or foreseeable. The disjunctive term "or", as used herein and throughout the claims that follow, is generally intended to mean "and/or", having both conjunctive and disjunctive meanings (and is not confined to an "exclusive or" meaning), unless otherwise indicated. As used in the description herein and throughout the claims that follow, "a", "an", and "the" include plural references unless the context clearly dictates otherwise. Also as used in the description herein and throughout the claims that follow, the meaning of "in" includes "in" and "on" unless the context clearly dictates otherwise.

The foregoing description of illustrated embodiments of the present invention, including what is described in the summary or in the abstract, is not intended to be exhaustive or to limit the invention to the precise forms disclosed herein. From the foregoing, it will be observed that numerous variations, modifications and substitutions are intended and may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

It is claimed:

1. A mass analyzing system for time-of-flight ("TOF") mass spectrometry analysis, the system coupleable to a pulsed ion source providing a first, pulsed ion beam having an input TOF focus, the system comprising:

an electrostatic mirror prism arrangement comprising:

a first electrostatic mirror prism having a first plurality of planar electrodes to generate a first retarding electric field to reflect the first ion beam and provide a second, intermediate ion beam having a spatial dispersion of ions proportional to ion kinetic energies, the second ion beam having an intermediate TOF focus; and a second electrostatic mirror prism spaced apart from the first electrostatic mirror prism by a first predetermined distance and further arranged to have a predetermined first angular offset from the first electrostatic mirror prism, the second electrostatic mirror prism having a second plurality of planar electrodes to generate a second retarding electric field to reflect the second ion beam and converge the spatial dispersion of ions to provide a third, recombined ion beam, the third ion beam having an output TOF focus; and an ion detector arranged at the output TOF focus to receive the third ion beam, the ion detector adapted to detect a plurality of ions of the third ion beam.

2. The system of claim 1, wherein the detector is further adapted to detect ion impact position on the detector surface to generate a stigmatic image of a cross-section of the third ion beam.

3. The system of claim 1, wherein the predetermined first angular offset is ninety degrees.

4. The system of claim 1, wherein the third, recombined ion beam has cancelled the spatial dispersion of ions of the second, intermediate ion beam.

5. The system of claim 1, wherein the electrostatic mirror prism arrangement further comprises:

a bandpass filter having a moveable energy bandpass control slit, the bandpass filter arranged at the intermediate TOF focus to selectively allow propagation of ions of the second ion beam having a selected range of ion kinetic energies.

6. The system of claim 1, wherein the first plurality of electrodes and the second plurality of electrodes each comprises:

a first, front electrode having a first, ground electrical potential;

a second electrode having a second electrical potential;

a third, rear electrode having a third electrical potential; and a plurality of intermediate electrodes, each coupled to one of the second and third electrodes via a resistive voltage divider such that each of the plurality of intermediate electrodes has a respective electrical potential different from the first, second, and third electrical potentials.

7. The system of claim 1, wherein each electrode of the first plurality of electrodes and the second plurality of electrodes comprise at least one electrode type selected from the group consisting of: a grid electrode, a solid electrode, a solid electrode having a central opening, and combinations thereof.

8. The system of claim 1, wherein the electrostatic mirror prism arrangement further comprises:

a first reflectron arranged spaced apart from the first electrostatic mirror prism in a first direction; and a second reflectron arranged spaced apart from the second electrostatic mirror prism in a second direction opposite the first direction;

wherein the first and second reflectrons each have a corresponding central axis, the first and second reflectrons further arranged with each central axis aligned and coextensive with the second ion beam.

9. The system of claim 8, wherein when the first and second electrostatic mirror prisms are in an off state, the second ion beam is reflected between the first and second reflectrons to provide a selectable number of reflections proportional to a selected time-of-flight.

10. The system of claim 9, further comprising:

a processor coupled to the electrostatic mirror prism arrangement, the processor adapted to control on and off states of the first and second electrostatic mirror prisms to determine the number of reflections between the first and second reflectrons in response to the selected time-of-flight.

11. The system of claim 10, wherein when the second electrostatic mirror prism is in an on state, the second ion beam is reflected to provide the third ion beam.

12. The system of claim 1, wherein the electrostatic mirror prism arrangement further comprises:

a third electrostatic mirror prism having a third plurality of ion-transparent planar electrodes to generate a third retarding electric field to reflect the first ion beam or a seventh ion beam and provide a fourth ion beam having a spatial dispersion of ions proportional to ion kinetic energies, the fourth ion beam having a fourth TOF focus;

a fourth electrostatic mirror prism spaced apart from the third electrostatic mirror prism by a second predetermined distance and further arranged to have a predetermined second angular offset from the third electrostatic mirror prism, the fourth electrostatic mirror prism having a fourth plurality of planar electrodes to generate a fourth retarding electric field to reflect the fourth ion beam and converge the spatial dispersion of ions to provide a fifth, recombined ion beam, the fifth ion beam having a fifth TOF focus;

a fifth electrostatic mirror prism having a fifth plurality of electrodes to generate a fifth retarding electric field to reflect the fifth ion beam and provide a sixth ion beam having a spatial dispersion of ions proportional to ion kinetic energies, the sixth ion beam having a sixth TOF focus; and a sixth electrostatic mirror prism spaced apart from the fifth electrostatic mirror prism by a third predetermined distance and further arranged to have a predetermined third angular offset from the fifth electrostatic mirror prism, the sixth electrostatic mirror prism having a sixth plurality of ion-transparent planar electrodes to generate a sixth retarding electric field to reflect the sixth ion beam and converge the spatial dispersion of ions to provide the seventh, recombined beam, the seventh ion beam having a seventh TOF focus collocated with the first TOF focus.

13. The system of claim 12, wherein when the third electrostatic mirror prism and the sixth electrostatic mirror prism are in an off state, the first ion beam is transmitted to the first electrostatic mirror prism.

14. The system of claim 12, wherein when the third electrostatic mirror prism is in an off state, the seventh ion beam is transmitted to the first electrostatic mirror prism.

15. The system of claim 12, wherein when the third electrostatic mirror prism, the fourth electrostatic mirror prism, the fifth electrostatic mirror prism, and the sixth electrostatic mirror prism are in an on state, the fourth, fifth, sixth and seventh ion beams are generated cyclically to provide a selectable number of reflections proportional to a selected time-of-flight.

16. The system of claim 15, further comprising:

a processor coupled to the electrostatic mirror prism arrangement, the processor adapted to control the on and off states of the third and sixth electrostatic mirror prisms to determine the number of reflections in response to the selected time-of-flight.

17. The system of claim 15, wherein the time-of-flight is user selectable to provide predetermined levels of a mass resolving power and a signal-to-noise ratio.

18. The system of claim 12, wherein the first electrostatic mirror prism, the second electrostatic mirror prism, the third electrostatic mirror prism, the fourth electrostatic mirror prism, the fifth electrostatic mirror prism, and the sixth electrostatic mirror prism are coplanar in an energy dispersion plane.

19. A mass analyzing system for time-of-flight ("TOF") mass spectrometry analysis, the system coupleable to a pulsed ion source providing a first, pulsed ion beam having an input TOF focus, the system comprising:

an electrostatic mirror prism arrangement comprising:

a first electrostatic mirror prism having a first plurality of planar electrodes to generate a first retarding electric field to reflect the first ion beam and provide a second, intermediate ion beam having a spatial dispersion of ions proportional to ion kinetic energies, the second ion beam having an second, intermediate TOF focus;

a second electrostatic mirror prism spaced apart from the first electrostatic mirror prism by a first predetermined distance and further arranged to have a predetermined first angular offset from the first electrostatic mirror prism, the second electrostatic mirror prism having a second plurality of planar electrodes to generate a second retarding electric field to reflect the second ion beam and converge the spatial dispersion of ions to provide a third, recombined ion beam, the third ion beam having a third TOF focus;

a third electrostatic mirror prism having a third plurality of planar electrodes to generate a third retarding electric field to reflect the third ion beam and provide a fourth ion beam having a spatial dispersion of ions proportional to ion kinetic energies, the fourth ion beam having a fourth, intermediate TOF focus; and a fourth electrostatic mirror prism spaced apart from the third electrostatic mirror prism by a second predetermined distance and further arranged to have a predetermined second angular offset from the third electrostatic mirror prism, the fourth electrostatic mirror prism having a fourth plurality of planar electrodes to generate a fourth retarding electric field to reflect the fourth ion beam and converge the spatial dispersion of ions to provide a fifth, recombined ion beam, the fifth ion beam having a fifth, output TOF focus; and an ion detector arranged at the fifth, output TOF focus to receive the fifth ion beam, the ion detector adapted to detect a plurality of ions of the fifth ion beam.

20. The system of claim 19, further comprising:

a dissociation device adapted to generate a laser beam or an electron beam to fragment molecules of the third ion beam at the third TOF focus.

21. The system of claim 20, further comprising:

a processor coupled to the dissociation device, the processor adapted to control the on and off states of the dissociation device to selectively fragment molecules of the third ion beam at the third TOF focus.

22. The system of claim 21, wherein the processor is further adapted to turn the dissociation device on or off at a selected duty cycle to provide a tandem operating mode for mass spectra having a plurality of fragment molecules and mass spectra having fragment-free molecules.

23. The system of claim 19, wherein the electrostatic mirror prism arrangement further comprises:

a first bandpass filter having a moveable energy bandpass control slit, the first bandpass filter arranged at the second, intermediate TOF focus to selectively allow propagation of ions of the second ion beam having a first selected range of ion kinetic energies; and a second bandpass filter having a moveable energy bandpass control slit, the bandpass filter arranged at the fourth, intermediate TOF focus to selectively allow propagation of ions of the fourth ion beam having a second selected range of ion kinetic energies.

24. The system of claim 19, wherein the first electrostatic mirror prism, the 30 second electrostatic mirror prism, the third electrostatic mirror prism, and the fourth electrostatic mirror prism are coplanar in an energy dispersion plane.

25. The system of claim 19, wherein the third electrostatic mirror prism and the fourth electrostatic mirror prism are not coplanar with the first electrostatic mirror prism and the second electrostatic mirror prism.

26. The system of claim 19, wherein the predetermined first and second angular offsets are each greater than or equal to 45° and less than or equal to 135°.

27. A mass analyzing system for time-of-flight ("TOF") mass spectrometry analysis, the system coupleable to a pulsed ion source providing a first, pulsed ion beam having an input TOF focus, the system comprising:

a plurality of pairs of electrostatic mirror prisms, each pair of electrostatic mirror prisms of the plurality of pairs of electrostatic mirror prisms comprising:

a first electrostatic mirror prism having a first plurality of planar electrodes to generate a first retarding electric field to reflect the first ion beam or a next recombined ion beam and provide an intermediate ion beam having a spatial dispersion of ions proportional to ion kinetic energies, the intermediate ion beam having a intermediate TOF focus; and a second electrostatic mirror prism spaced apart from the first electrostatic mirror prism by a first predetermined distance and further arranged to have a predetermined first angular offset from the first electrostatic mirror prism, the second electrostatic mirror prism having a second plurality of planar electrodes to generate a second retarding electric field to reflect the intermediate ion beam and converge the spatial dispersion of ions to provide the next recombined ion beam, the next recombined ion beam having a combined output-input TOF focus;

a bandpass filter having a moveable energy bandpass control slit, the bandpass filter arranged at at least one intermediate TOF focus of a plurality of intermediate TOF focuses provided by the plurality of pairs of electrostatic mirror prisms, to selectively allow propagation of ions of a corresponding intermediate ion beam having a selected range of ion kinetic energies; and an ion detector arranged at the combined output-input TOF focus to receive the next recombined ion beam provided by a last pair of electrostatic mirror prisms of the plurality of pairs of electrostatic mirror prisms, the ion detector adapted to detect a plurality of ions of the next recombined ion beam.

28. The system of claim 1, wherein the intermediate TOF focus is located at one-half of the first predetermined distance from the first electrostatic mirror prism.

* * * * *